US008863549B2

(12) United States Patent
Cho et al.

(10) Patent No.: US 8,863,549 B2
(45) Date of Patent: Oct. 21, 2014

(54) REFRIGERATOR AND RAPID FLUID COOLING APPARATUS

(75) Inventors: Yeonwoo Cho, Seoul (KR); Yanggyu Kim, Seoul (KR); Younseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 218 days.

(21) Appl. No.: 13/182,206

(22) Filed: Jul. 13, 2011

(65) Prior Publication Data

US 2012/0011885 A1 Jan. 19, 2012

Related U.S. Application Data

(60) Provisional application No. 61/415,537, filed on Nov. 19, 2010, provisional application No. 61/415,519, filed on Nov. 19, 2010.

(30) Foreign Application Priority Data

| | | |
|---|---|---|
| Jul. 13, 2010 | (KR) | 10-2010-0067196 |
| Jul. 15, 2010 | (KR) | 10-2010-0068244 |
| Jul. 15, 2010 | (KR) | 10-2010-0068461 |
| Jul. 15, 2010 | (KR) | 10-2010-0068466 |
| Jul. 19, 2010 | (KR) | 10-2010-0069358 |
| Nov. 19, 2010 | (KR) | 10-2010-0115536 |
| Nov. 19, 2010 | (KR) | 10-2010-0115549 |
| Jun. 28, 2011 | (KR) | 10-2011-0062878 |

(51) Int. Cl.
*F25D 17/06* (2006.01)

(52) U.S. Cl.
CPC ..... *F25D 17/065* (2013.01); *F25D 2331/803* (2013.01); *F25D 2317/0666* (2013.01); *F25D 2400/28* (2013.01); *F25D 2317/061* (2013.01); *F25D 2331/805* (2013.01)
USPC ..... 62/426; 62/408; 62/419

(58) Field of Classification Search
CPC ..... F25D 2400/04; F25D 2400/28; F25D 2400/30; F25D 17/06; F25D 17/062; F25D 19/003
USPC ..... 62/426, 408, 419, 440, 62, 64, 441, 344
See application file for complete search history.

(56) References Cited

U.S. PATENT DOCUMENTS 5,888,133 A * 3/1999 Mori et al. ..... 454/318
5,966,964 A * 10/1999 Pattee ..... 62/457.4

(Continued)

FOREIGN PATENT DOCUMENTS

CN 1459611 A 12/2003
CN 1517647 A 8/2004

(Continued)

OTHER PUBLICATIONS

PCT International Search Report dated Apr. 4, 2012 for Application No. PCT/KR2011/005150, 4 pages.

(Continued)

*Primary Examiner* — Cheryl J Tyler
*Assistant Examiner* — Ana Vazquez
(74) *Attorney, Agent, or Firm* — Fish & Richardson P.C.

(57) ABSTRACT

Provided is a chilling device or cooling apparatus that quickly chills a beverage. The chilling device or cooling apparatus may be provided to a refrigerator or a refrigerating storage.

8 Claims, 42 Drawing Sheets

(56) References Cited

U.S. PATENT DOCUMENTS

| | | | | |
|---|---|---|---|---|
| 2004/0144103 | A1* | 7/2004 | Lee et al. | 62/62 |
| 2006/0090480 | A1* | 5/2006 | Loibl et al. | 62/64 |
| 2007/0151284 | A1 | 7/2007 | Freesmeier et al. | |

FOREIGN PATENT DOCUMENTS

| | | | |
|---|---|---|---|
| CN | 1856687 | A | 11/2006 |
| JP | 2003-262448 | A | 9/2003 |
| JP | 2006-200786 | A | 8/2006 |
| JP | 2009-024979 | A | 2/2009 |
| KR | 20-2000-0000951 | A | 1/2000 |
| KR | 10-2000-009208 | A | 2/2000 |
| KR | 10-2002-0027724 | A | 4/2002 |
| KR | 10-2005-0041036 | A | 5/2005 |
| KR | 2005-0109757 | A | 11/2005 |
| KR | 10-0569892 | B1 | 4/2006 |

OTHER PUBLICATIONS

PCT International Search Report dated Apr. 4, 2012 for Application No. PCT/KR2011/005155, 4 pages.
PCT International Search Report dated Apr. 4, 2012 for Application No. PCT/KR2011/005158, 4 pages.
PCT International Search Report dated Apr. 4, 2012 for Application No. PCT/KR2011/005160, 4 pages.
PCT International Search Report dated Apr. 4, 2012 for Application No. PCT/KR2011/005162, 4 pages.
Chinese Search Report dated Jun. 13, 2014 for Chinese Application No. 2011800347219, in English, 3 pages.

* cited by examiner

REFRIGERATOR AND RAPID FLUID COOLING APPARATUS

CROSS REFERENCE TO RELATED APPLICATIONS

The present application claims the benefit of priority to Korean Patent Applications No. 10-2010-0067196 (filed on Jul. 13, 2010), 10-2010-0068244 (filed on Jul. 15, 2010), 10-2010-0068461 (filed on Jul. 15, 2010), 10-2010-0068466 (filed on Jul. 15, 2010), 10-2010-0069358 (filed on Jul. 19, 2010), 10-2010-0115536 (filed on Nov. 19, 2010), 10-2010-0115549 (filed on Nov. 19, 2010), and 10-2011-0062878 (filed on Jun. 28, 2011), which are herein incorporated by reference in their entirety.

The present application also claims the benefit of U.S. Provisional Application No. 61/415,537 and U.S. Provisional Application No. 61/415,519, filed Nov. 19, 2010, which are herein incorporated by reference in their entirety.

FIELD

The present disclosure relates to a refrigerator and cooling apparatus.

BACKGROUND

A refrigerator is a home appliance providing a low-temperature storage that can be opened and closed by a door for storing foods at a low temperature. To this end, the storage of the refrigerator is chilled by using air which is cooled by heat exchange with refrigerant in a refrigeration cycle.

Along with the change of people's eating patterns and preference, large and multifunctional refrigerators have been introduced, and various comfortable structures have been added to refrigerators.

SUMMARY

In one aspect, a refrigerator includes a refrigerator body, and a refrigerating compartment and a freezing compartment being configured to maintain operating temperatures that differ, with the freezing compartment having an operating temperature that is lower than an operating temperature of the refrigerating compartment. The refrigerator also includes a cooling apparatus that is positioned in the refrigerating compartment and that is configured to cool liquid held by a container positioned in the cooling apparatus to a refrigerated temperature faster than the refrigerating compartment. The cooling apparatus includes a case configured to receive the container holding the liquid and an agitating member that is positioned within the case and that is configured to agitate the container holding the liquid. The cooling apparatus also includes a power generator configured to generate a driving force that causes the agitating member to agitate the container holding the liquid. The power generator includes a motor configured to generate a rotation force and a power transmission unit that connects to the motor, that connects to the agitating member, and that is configured to move the agitating member based on the rotation force generated by the motor.

Implementations may include one or more of the following features. For example, the agitating member may be configured to swing the container holding the liquid, and the power transmission unit may be configured to transmit the rotation force generated by the motor to a driving force that causes the agitating member to swing.

In some implementations, the power transmission unit may include a rotation member that connects to a rotation shaft of the motor and a rod with a first end that connects to the rotation member and a second end that connects to the agitating member. In these implementations, the first end of the rod may be disposed at an eccentric position from a rotation center of the rotation member so that a reciprocating motion of a length direction of the rod is converted into a swinging motion of the agitating member. Further, in these implementations, the refrigerator may include a connection member that connects the second end of the rod to a rotation shaft of the agitating member. A position at which the second end of the rod is connected to the connection member may be eccentrically disposed from a rotation center of the agitating member.

In some examples, the agitating member may include holder shafts that are spaced a distance from each other and that are configured to support the container agitated by the agitating member. In these examples, the agitating member also may include a front support that connects to front ends of the holder shafts and a rear support that connects to rear ends of the holder shafts. The rear ends of the holder shafts may be opposite of the front ends of the holder shafts.

The power transmission unit may connect to the rear support of the agitating member. The agitating member may include a guide support that is coupled to the holder shafts between the front support and the rear support and that is disposed in the case in a manner that enables at least partial rotation of the guide support. The holder shafts may be provided with a neck holder that is configured to move along the holder shafts and that varies a space of the holder shafts available to support a container based on the movement of the neck holder.

In some implementations, the case may include an opening through which the container holding the liquid is placed within the case and removed from the case. In these implementations, the cooling apparatus may include a cover configured to open and close the opening of the case. The cover may block air from escaping the case through the opening when the cover closes the opening of the case and the cooling apparatus operates. The opening of the case may be inclined downward, and the cover may rotate to open and close the opening of the case.

In addition, the refrigerator may include a partition wall that separates the refrigerating compartment and the freezing compartment. The cooling apparatus may be positioned on the partition wall that separates the refrigerating compartment and the freezing compartment. Further, the case may include an inlet and an outlet, and the cooling apparatus may include a suction fan that is positioned at the outlet and that is configured to draw air into the case through the inlet, draw air entering the case over the container holding the liquid positioned in the cooling apparatus, and expel air from the case through the outlet.

In another aspect, a cooling apparatus is configured to cool liquid held by a container positioned in the cooling apparatus to a refrigerated temperature. The cooling apparatus includes a case configured to receive the container holding the liquid, and an agitating member that is positioned within the case and that is configured to agitate the container holding the liquid. The cooling apparatus also includes a power generator configured to generate a driving force that causes the agitating member to agitate the container holding the liquid. The power generator includes a motor configured to generate a rotation force and a power transmission unit that connects to the motor, that connects to the agitating member, and that is configured to move the agitating member based on the rotation force generated by the motor.

Implementations may include one or more of the following features. For example, the agitating member may be configured to swing the container holding the liquid and the power transmission unit may be configured to transmit the rotation force generated by the motor to a driving force that causes the agitating member to swing.

In some implementations, the power transmission unit may include a rotation member that connects to a rotation shaft of the motor and a rod with a first end that connects to the rotation member and a second end that connects to the agitating member. In these implementations, the first end of the rod may be disposed at an eccentric position from a rotation center of the rotation member so that a reciprocating motion of a length direction of the rod is converted into a swinging motion of the agitating member. Further, in these implementations, the cooling apparatus may include a connection member that connects the second end of the rod to a rotation shaft of the agitating member. A position at which the second end of the rod is connected to the connection member may be eccentrically disposed from a rotation center of the agitating member.

In some examples, the agitating member may include holder shafts that are spaced a distance from each other and that are configured to support the container agitated by the agitating member. In these examples, the agitating member also may include a front support that connects to front ends of the holder shafts and a rear support that connects to rear ends of the holder shafts. The rear ends of the holder shafts may be opposite of the front ends of the holder shafts. Further, in these examples, the power transmission unit may connect to the rear support of the agitating member.

The details of one or more implementations are set forth in the accompanying drawings and the description, below. Other potential features of the disclosure will be apparent from the description and drawings, and from the claims.

DETAILED DESCRIPTION

Figure 1:
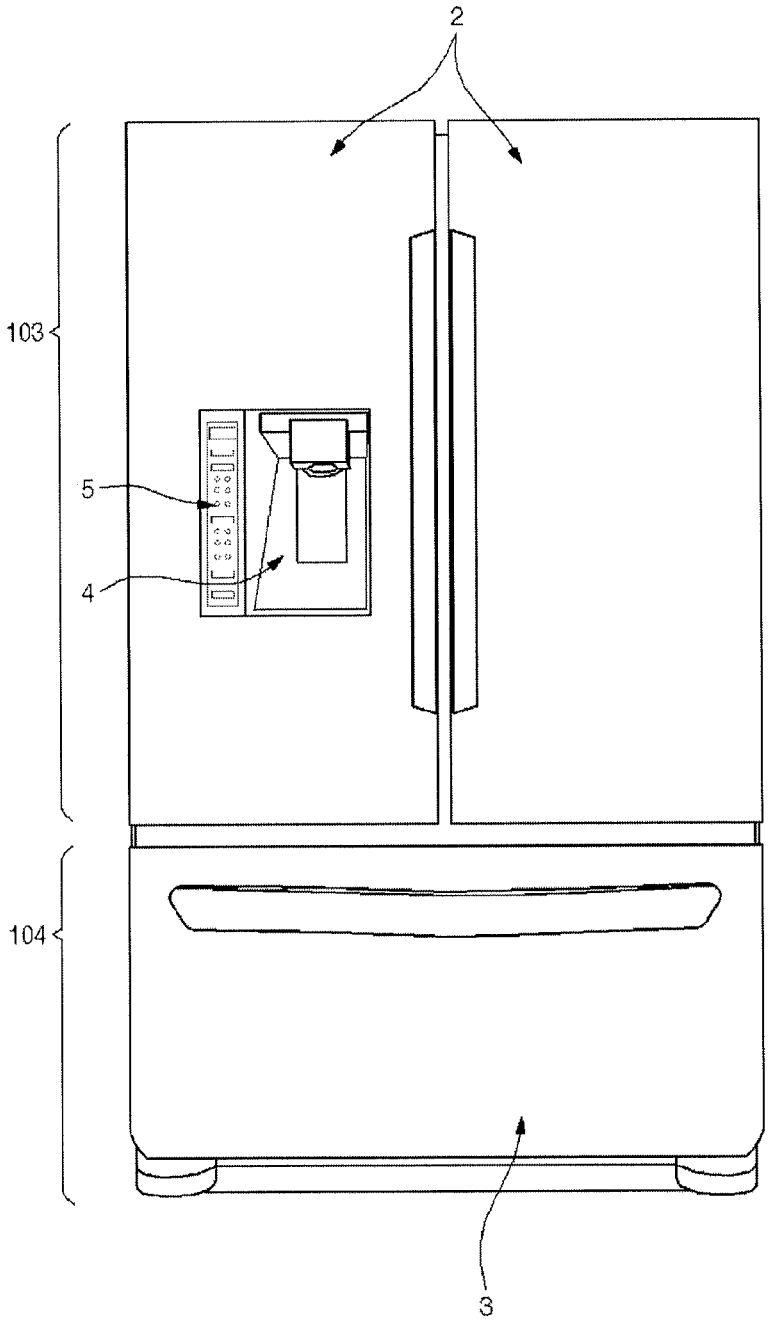
FIG. 1 is a front view illustrating a refrigerator.

Techniques are described for quickly cooling content in a container, such as a beverage container. In some implementations, a cooling apparatus is positioned in a refrigerating compartment of a refrigerator and cools liquid held by a container to a refrigerated temperature faster than the refrigerating compartment. The refrigerated temperature is a cool temperature, but higher than a freezing temperature. The cooling apparatus may include a case that receives the container holding the liquid and an agitating member that is positioned within the case and that agitates the container holding the liquid. The cooling apparatus also may include a power generator that generates a driving force that causes the agitating member to agitate the container holding the liquid. The power generator may include a motor configured to generate a rotation force and a power transmission unit that connects to the motor, that connects to the agitating member, and that moves the agitating member based on the rotation force generated by the motor.

In some examples, the case includes an inlet and an outlet and a suction fan is positioned at the outlet. In these examples, the suction fan draws air into the case through the inlet, draws air entering the case over the container holding the liquid positioned in the cooling apparatus, and expels air from the case through the outlet.

In further implementations, a controller may be used to control operation of the cooling apparatus based on one or more conditions of the refrigerator. In these implementations, the controller detects a condition of the refrigerator and controls operation of the cooling apparatus based on the detected condition of the refrigerator. The detected condition may include one or more of opening of a refrigerator door, a defrosting operation performed by the refrigerator, overworking of the cooling apparatus, a temperature of the refrigerator, or any other condition of the refrigerator and/or cooling apparatus. Upon detection of a condition, the controller may stop operation of the cooling apparatus, prevent operation of the cooling apparatus, or modify operational parameters (e.g., damper position, fan speed, etc.) of the cooling apparatus while allowing operation of the cooling apparatus.

The cooling apparatus or chilling device described throughout this disclosure and the refrigerator including the cooling apparatus or chilling device described throughout this disclosure may have one or more of the following effects.

First, the driving assembly of the refrigerator may swing the agitating member on which the beverage container is placed. Thus, a beverage is agitated in the beverage container to reduce a temperature variation of the beverage and quickly chill the beverage.

Secondly, the refrigerator may include the suction fan to increase a flow rate of cool air, thus, improving heat exchange between the beverage container and the cool air. Accordingly, heat exchange efficiency may be improved.

Cool air supplied into the case may have a high flow rate, and may collide with the beverage container at a perpendicular angle, so as to increase the amount of heat exchange per unit time, thereby potentially improving heat exchange efficiency.

Thirdly, when a cover is opened, an upper end of the cover is disposed at an upper outside of a rotation shaft of the cover. Thus, in this state, the cover may be closed in conjunction with the door of the refrigerator by closing the door without separate manipulation, thereby enhancing convenience of using the refrigerator.

Fourthly, since the refrigerator may include a single driving motor to drive the suction fan and the agitating member, when the cooling apparatus or chilling device is driven, a heat load in the refrigerator may be reduced (e.g., minimized), thereby reducing power consumption.

Fifthly, the agitating member may include a neck holder supported by an elastic member. Thus, a beverage container having an arbitrary size or a plurality of beverage containers may be stably placed on the agitating member, and the agitating member may stably operate.

Sixthly, cool air discharged to a beverage container may collide with the beverage container, and then, may be redirected to the beverage container by air guides. Thus, a contact area of the beverage container with the cool air may be increased, and the beverage container may be chilled multiple times, thereby improving chilling efficiency.

In some examples, a chilling device includes a case accommodating a beverage container, a cover opening and closing an open inlet of the case, and an agitating member disposed in the case. The beverage container to be cooled is placed on the agitating member. In these examples, the chilling device includes a fan motor assembly disposed at a side of the case to suck cool air into the case, chill the beverage container, and discharge the cool air from the case, and a driving assembly connected to the agitating member and supplying power to swing the agitating member.

The fan motor assembly may include a fan motor generating torque, and a suction fan rotated by the fan motor to suck air into the case. The fan motor may be disposed outside the case and may be disposed behind the suction fan. The fan motor assembly may be disposed outside the case.

The case may have a rear surface provided with the suction fan, and a bottom surface through which cool air is sucked. In this configuration, at least one portion of the rear and at least one portion of the bottom surface may be open.

A rear surface of the case may be provided with a fan housing receiving the suction fan, and the fan housing may guide cool air sucked into a center thereof to be discharged downward.

In some implementations, a chilling device includes a case accommodating a beverage container, a cover opening and closing an open inlet of the case, and an agitating member disposed in the case. The beverage container to be cooled is placed on the agitating member. In these implementations, the chilling device includes a fan motor assembly disposed at a side of the case and that forcibly moves cool air for chilling the beverage container, to pass through the case. A driving motor is disposed on the case to provide torque and a transmission unit connects the driving motor to the agitating member and converts a rotation of the driving motor into a reciprocating motion to swing the agitating member.

The driving motor may be disposed outside the case. The transmission unit may be disposed in the case. The transmission unit may include a rotation member connected to a rotation shaft of the driving motor and rotating together with the rotation shaft, and a connecting rod rotatably coupled to both a side of the rotation member eccentric from a rotation center thereof and a side of the agitating member eccentric from a rotation center thereof. The rotation member may include a shaft coupler connected to the rotation shaft of the driving motor, and an extension extending from a side of the shaft coupler eccentric from a rotation center thereof.

The agitating member may be rotatably shaft-coupled to a bottom surface of the case, and the transmission unit may be connected to a portion of the agitating member under a rotation shaft thereof. The agitating member may be rotatably shaft-coupled to an upper portion of the case, and the transmission unit may be connected to a portion of the agitating member under a rotation shaft thereof.

In some examples, a chilling device includes a case accommodating a beverage container, a cover opening and closing an open inlet of the case, and an agitating member disposed in the case. The beverage container to be cooled is placed on the agitating member. In these examples, the chilling device includes a fan disposed on the case to move cool air for chilling the beverage container, and a transmission unit disposed on the case and connected to the agitating member to swing the agitating member. The chilling device also includes a driving motor disposed on the case to simultaneously drive the fan and the transmission unit, and a gear assembly that is coupled to the driving motor, the fan, and transmission unit, and that transmits torque from the driving motor to the fan and the transmission unit.

The driving motor may be disposed behind the case. The number of rotations of the fan may be greater than the number of rotations of the driving motor, and the number of rotations of the transmission unit may be smaller than the number of rotations of the driving motor.

The gear assembly may include a driving shaft for transmitting torque from the driving motor to the fan, a transmission shaft transmitting torque to the transmission unit, and a speed changer gear connecting a driving shaft gear disposed on the driving shaft to a transmission shaft gear disposed on the transmission shaft, and decreasing a rotation speed of the transmission shaft.

The chilling device may further include a first fan gear disposed on a rotation shaft of the fan, and a second fan gear disposed on the driving shaft and connected to the first fan gear. A rotation speed of the fan is determined according to a gear ratio of the first fan gear to the second fan gear.

A fan housing may be disposed outside the case and may accommodate the fan. The gear assembly may be provided to the fan housing. The fan may include a suction fan that sucks cool air into the case and that discharges the cool air from the case.

In some examples, a chilling device includes a case accommodating a beverage container, a cover opening and closing an open inlet of the case, and an agitating member disposed in the case. The beverage container to be cooled is placed on the agitating member. In these examples, the chilling device includes a fan motor assembly disposed at a side of the case, sucking cool air into the case to chill the beverage container, and discharging the cool air from the case. The chilling device also includes a driving assembly connected to the agitating member and providing power to swing the agitating member, and a plurality air holes provided to the case and discharging cool air to a side outer surface of the beverage container.

A suction grill may be removably attached to a side opening of the case, and the air holes may be disposed in the suction grill. The air holes may be open in a direction crossing an outer surface of the beverage container. The air holes may be open in a direction crossing a longitudinal direction of the beverage container. The air holes may be disposed in a bottom surface of the case. The air holes may be disposed in a surface of the case to correspond to a position on which the beverage container is placed. The air holes may be arrayed from a surface of the case so as to correspond to a front end of the agitating member.

The agitating member may include a neck holder that moves along the agitating member and that defines a space in which the beverage container is placed. The air holes may be disposed at a position corresponding to that of the neck holder.

In some implementations, a chilling device includes a case accommodating a beverage container, a cover opening and closing an open inlet of the case, and an agitating member disposed in the case. The beverage container to be cooled is placed on the agitating member. In these implementations, the chilling device includes a fan motor assembly disposed at a side of the case and that forcibly moves cool air for chilling the beverage container such that the cool air passes through the case. The chilling device also includes a driving assembly connected to the agitating member and providing power to swing the agitating member. The agitating member includes at least a pair of holder shafts spaced apart from each other at left and right sides thereof and defining a space in which the beverage container is placed, a front support connecting front ends of the holder shafts to each other, and a rear support connecting rear ends of the holder shafts to each other.

The holder shafts may be provided in a pair at each of upper and lower sides of the agitating member, and a distance between the holder shafts at the upper side may be greater than a distance between the holder shafts at the lower side. A lower end of the front support and a lower end of the rear support may be shaft-coupled to a bottom surface of the case.

The holder shaft between the front support and the rear support may be provided with a guide support such that the agitating member is rotatably installed on a top surface of the case. A neck holder may be installed on the holder shaft to move along the holder shaft and define a space in which the beverage container is placed. The neck holder may be disposed between the front support and the rear support.

The holder shaft may be provided with an elastic member providing elastic force to return the neck holder to an original position thereof. The neck holder may have a curved top surface that is provided with a seat on which a neck of the beverage container having a bottle shape is placed.

The holder shaft may be provided with indents that are continuously bent to reduce (e.g., prevent) a collision with sucked cool air. The case may include a plurality of air holes for introducing cool air, and the holder shaft may include a plurality of indents that are disposed at an inside and an outside thereof to correspond to positions of the air holes and to reduce (e.g., prevent) a collision with cool air discharged from the air holes. The indents may be continuously arrayed at the inside and the outside of the holder shaft.

The holder shaft may be provided with an air guide that guides cool air passing through the indent to a surface of the beverage container. The air guide may be divided into a plurality of spaces to receive the indents, and have a curved inner surface.

The air guide may include an outer guide contacting the indent disposed at the inside and defining an inner space through which cool air passes, and a curved inner guide at a position corresponding to that of the indent disposed at the outside and defining a passage through which cool air passes. The holder shaft may be provided with an air guide that guides cool air along a surface of the beverage container. Air holes may be disposed in a bottom surface of the case to introduce cool air, and may be disposed between the holder shafts at the left and right sides.

In some implementations, a chilling device includes a case defining a space accommodating a beverage container to introduce and discharge cool air, a fan motor assembly disposed at a side of the case and supplying cool air into the case, an air hole disposed in the case to introduce cool air, and an agitating member rotatably disposed in the case. The beverage container is placed on the agitating member. In these implementations, the chilling device includes a driving assembly connected to the agitating member and that swings the agitating member back and forth to agitate a beverage in the beverage container, and air guides disposed at both sides of the beverage container to surround a portion of the beverage container and guide cool air to the beverage container.

The air guides may be installed on the agitating member. A lower end of the air guides may be disposed at an outside of the air hole. The air guides may have a curved inner surface to guide cool air along a surface of the beverage container. The air guides may include guide installation parts on inner surfaces thereof to fix the air guides to a side of the agitating member.

The air guides may include a round guide plate on an inner surface thereof, and the round guide plate may increase in inward length in an upward direction to guide cool air to the beverage container. The guide plate may be provided in plurality, and the guide plates may be arrayed from a front end of the air guides to a rear end thereof. The air guides may include a plurality guide plates protruding on an inner surface thereof, and the guide plates may be spaced a constant distance from one another to uniformly guide cool air to the beverage container.

In some examples, a refrigerator includes a cabinet defining a storing space for storing food, and an evaporating compartment accommodating an evaporator for generating cool air. In these examples, a chilling device is disposed in the storing space to quickly chill a beverage container with cool air supplied from the evaporator. The chilling device includes a case having a separate space in the storing space and accommodating the beverage container, a cool air passage connecting the case to a heat exchange space accommodating the evaporator to guide cool air, a fan motor assembly disposed on the case and supplying cool air into the case, and an agitating member rotatably disposed in the case. The beverage container is placed on the agitating member. A driving assembly is connected to the agitating member and swings the agitating member.

The storing space may be divided into a refrigerator compartment in an upper side thereof, and a freezer compartment in a lower side thereof by a partition. The case may be installed on a top surface of the partition. The case may contact a corner between a bottom surface and a side surface of the refrigerator compartment.

The cool air passage may pass through the partition and connect to the case. The cool air passage may include a suction duct connecting the evaporating compartment to the case and supplying cool air to the case, and a return duct connecting the case to the freezer compartment and returning cool air from the case to the freezer compartment. The return duct may be open in a top surface of the freezer compartment. An outlet of the suction duct and an inlet of the return duct may be open in a top surface of the partition.

The partition may be provided with a drawer assembly from which a drawer is pulled out and pushed in, and a side of the drawer may be provided with a chilling device accommodating part on which the chilling device is installed. A top surface of the chilling device may be closed by the drawer assembly. The cool air passage may be provided with a damper that closes the cool air passage when the fan motor assembly is stopped.

In some implementations, a refrigerator includes a cabinet defining at least one storing space, a door opening and closing the storing space, a case having a separate space in the refrigerator and accommodating the beverage container, a fan motor assembly supplying cool air into the case for chilling the beverage container, and an agitating member rotatably disposed in the case. The beverage container is placed on the agitating member. In these implementations, the chilling device also includes a driving assembly connected to the agitating member and that swings the agitating member back and forth to agitate a beverage in the beverage container, and a cover rotating to open and close an inlet of the case. When the door is closed with the cover opened, the door contacts the cover to rotate the cover and close the case.

A direction of a rotation shaft of the door may cross that of a rotation shaft of the cover. At least one portion of the cover may be transparent or translucent to see an inside of the case. The refrigerator may further include a gasket between the case and the cover to reduce leakage of cool air.

The case may be provided with a cover fixing part, and the cover may be provided with a fixing member. When the cover is closed, the fixing member is inserted into the cover to maintain the closing of the cover.

The cover may be provided with a locking unit manipulated to open and close the cover. The locking unit includes a manipulation part exposed out of the cover and manipulated by a user, a catching portion protruding from an end of the cover and locked to a side of the case when the cover is closed, and an elastic member disposed in the cover and providing elastic force for returning the catching portion.

A handle may be recessed from the cover, and be held by a user. A lower end of the cover may be shaft-coupled to a front lower end of the case. The cover may vertically rotate.

When the door rotates, a contact point between the door and the cover may be disposed over a rotation shaft of the cover. When the cover is opened, at least one portion of the cover may protrude out of the refrigerator.

The cover may include a first surface constituting a top surface of the cover, and a second surface constituting a front surface of the cover. The first surface contacts the second surface to define an obtuse angle. A contact between the first surface and the second surface may be rounded.

The cover may include a first surface constituting a top surface of the cover and inclined downward, and a second surface extending at an angle larger than that of the first surface from a lower end of the first surface to constitute a front surface of the cover.

The inlet of the case may protrude in length downward to form a slope inclined downward, and the cover may be placed on the slope of the inlet. At least one portion of the agitating member may be exposed through the inlet when the cover is opened.

The door may be provided with a display unit for displaying a driving state of the chilling device and manipulating the chilling device.

In some examples, a refrigerator includes a cabinet defining at least one storing space, a case having a separate space in the refrigerator and a space accommodating the beverage container, a fan motor assembly supplying cool air into the case for chilling the beverage container, and an agitating member rotatably disposed in the case. The beverage container is placed on the agitating member. In these examples, the chilling device also includes a driving assembly connected to the agitating member that swings the agitating member to agitate a beverage in the beverage container, and a vibration reduction member disposed on a bottom surface of the case. The vibration reduction member comprises an elastic material, and reduces a vibration generated when the case is installed.

A first installation part may be recessed from the bottom surface of the case, and have a corresponding shape to that of the vibration reduction member to receive the vibration reduction member. The vibration reduction member may include a coupling part passing through a center thereof and coupled to a screw for fixing, and a recess part recessed along an edge thereof and press coupled to an object.

The fan motor assembly may include a fan motor providing torque, a suction fan rotated by the fan motor and sucking cool air to pass through the case, a fan motor housing accommodating the fan motor, and at least one second installation part disposed at a side of the fan motor housing contacting a side of the case and provided with the vibration reduction member. The second installation part may have a ring shape on which the recess part is fitted. The vibration reduction member may be disposed between the case and the fan motor housing.

A third installation part on which the vibration reduction member is installed may be disposed on a bottom surface of the fan motor housing, and the fan motor housing may be supported by the vibration reduction member.

In some implementations, a method of controlling a refrigerator includes accommodating a beverage container in a chilling device disposed in a storing space in the refrigerator to quickly chill the beverage container and manipulating an input device for setting an operation of the chilling device. In these implementations, the method also includes driving a fan motor assembly provided to the chilling device to suck cool air from an evaporating compartment into the chilling device through a cool air passage, and simultaneously, driving a driving assembly for repeatedly swinging the beverage container to chill the beverage container. The method further includes outputting information, through an output member, that the operation of the chilling device is completed, or that operation of the chilling device will be completed after a set time.

In the chilling of the beverage container, when a door opening and closing the storing space is opened, the chilling device may be stopped, and counting of a driving time of the chilling device set using a display unit may be stopped. When the door is closed again and a signal for operating the chilling device is input, the chilling device may be driven for a rest of the set time. After the door is closed, unless a signal for operating the chilling device is input within a preset period, the driving time of the chilling device may be initialized.

When a signal for stopping the driving assembly is input, and then, the door is opened, the driving time of the chilling device may be initialized. When the chilling of the beverage container is completed, the fan motor assembly and the driving assembly may be turned off, and a damper provided to the cool air passage may be closed.

The chilling device may be disposed in a refrigerator compartment separated by a partition, and chilling of the refrigerator compartment may be stopped and cool air may be supplied to the chilling device, in the chilling of the beverage container.

When a signal for forcibly stopping the chilling device is input during the chilling of the beverage container, the chilling device may be driven for a remainder of a set driving time, and then, may be stopped. When the signal for forcibly stopping the chilling device is input, the chilling device may be stopped for a preset stopping time.

The signal for forcibly stopping the chilling device may be input when the chilling device continuously operates over a preset number of times or a preset time. The signal for forcibly stopping the chilling device may be input within a preset time during a defrosting operation of an evaporator or before/after the defrosting operation. The signal for forcibly stopping the chilling device may be input when the door is opened. The signal for forcibly stopping the chilling device may be input within a preset time after the refrigerator is initially turned on.

Figure 2:
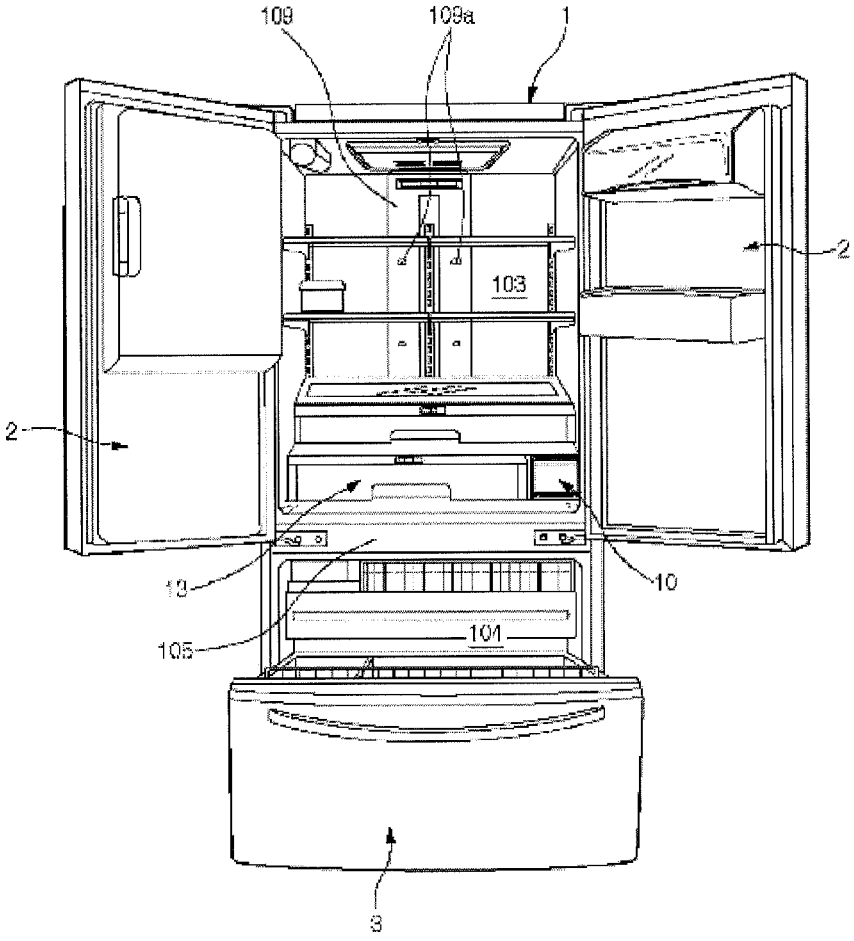
FIG. 2 is a front view illustrating a refrigerator door when oriented in an open position.
Figure 3:
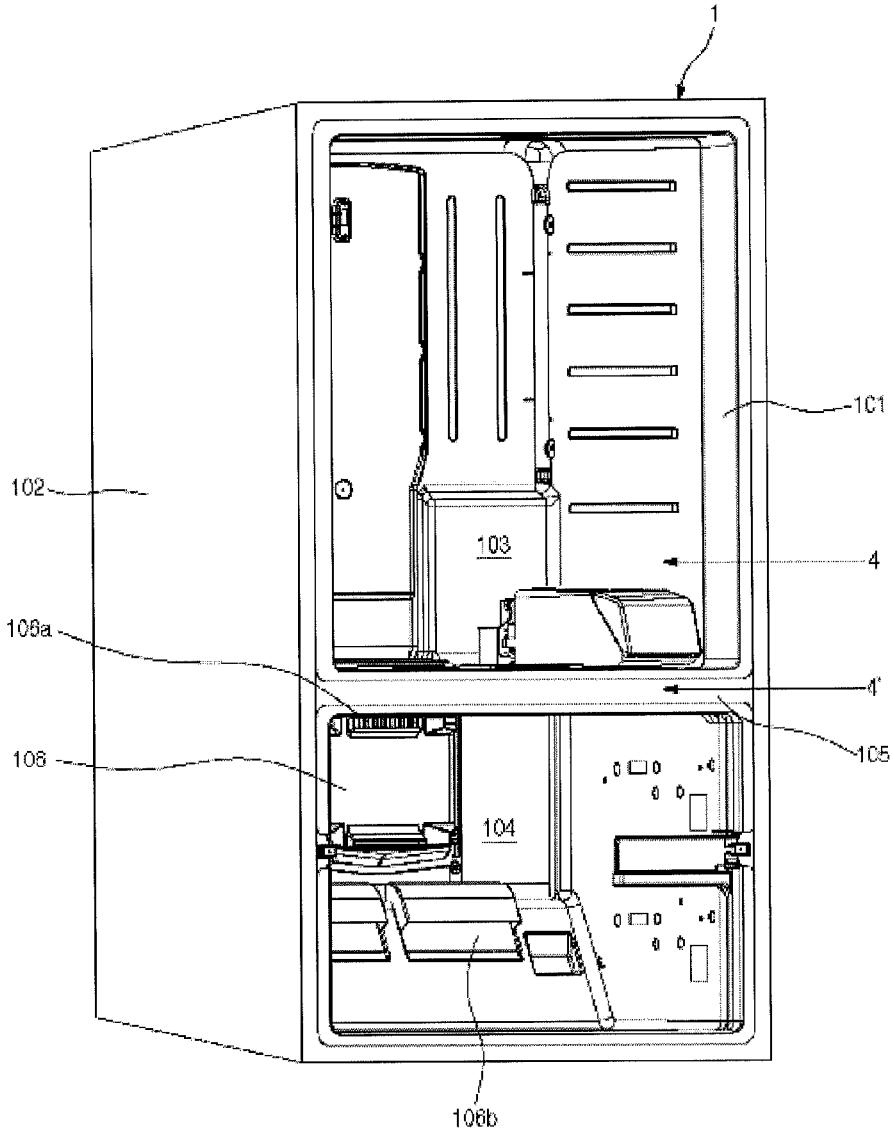
FIG. 3 is a perspective view illustrating an inner structure of a refrigerator including a chilling device.

FIG. 1 illustrates an example refrigerator. FIG. 2 illustrates an example refrigerator door when oriented in an open position. FIG. 3 illustrates an example inner structure of an example refrigerator including an example chilling device.

A chilling device (or cooling apparatus) may be disposed in a storing space of a refrigerator for storing a food at low temperature.

In detail, the chilling device is disposed in the refrigerator to perform a quick chilling operation with cool air generated in the refrigerator.

Although the chilling device is disposed in the refrigerator in the examples discussed, the chilling device may be installed on any apparatus for generating cool air, or may be a standalone appliance.

Referring to FIGS. 1 to 3, the refrigerator includes a cabinet 1 defining a refrigerator compartment 103 and a freezer compartment 104, and doors opening and closing the refrigerator compartment 103 and the freezer compartment 104. The cabinet 1 and the doors form an appearance of the refrigerator.

In addition, the cabinet 1 includes an outer case 102 constituting the appearance, an inner case 101 installed on the inner portion of the outer case 102 and defining an inner storing space, and an insulating member filling a space between the inner case 101 and the outer case 102.

The inner storing space may include the refrigerator compartment 103 for refrigerating a food, and the freezer compartment 104 for freezing a food. The refrigerator compartment 103 is opened and closed by rotations of a pair of refrigerator compartment doors 2, and the freezer compartment 104 is opened and closed by sliding of a freezer compartment door 3. In the example shown in FIGS. 1 to 3, the storing space is divided into upper and lower portions by a partition 105, and the refrigerator compartment 103 is disposed over the freezer compartment 104 to form a bottom freezer type refrigerator.

Furthermore, the chilling device may be installed on a top mount type refrigerator in which a freezer compartment is disposed over a refrigerator compartment, a side-by-side type refrigerator in which a freezer compartment and a refrigerator compartment are disposed side by side, or any type of refrigerator having a freezer compartment and a refrigerator compartment.

An evaporating compartment 107 (refer to FIG. 4) is defined at the rear surface of the freezer compartment 104 by an evaporating compartment wall 106, and the evaporating compartment 107 accommodates an evaporator 108. The evaporating compartment wall 106 may be provided with a cool air discharge opening 106*a* for discharging cool air into the freezer compartment 104, and a cool air suction opening 106*b* for returning cool air from the freezer compartment 104 to the evaporating compartment 107. Thus, cool air from the freezer compartment 104 and the evaporating compartment 107 circulates through the cool air discharge opening 106*a* and the cool air suction opening 106*b* to continually chill the freezer compartment 104.

A refrigerator compartment duct 109 vertically extends on the rear surface of the refrigerator compartment 103, and the lower end of the refrigerator compartment duct 109 communicates with the evaporating compartment 107. The front surface of the refrigerator compartment duct 109 may be provided with cool air discharge openings 109*a*, and an upper surface of the partition 105 may be provided with a cool air suction opening. Thus, cool air from the freezer compartment 103 and/or the evaporating compartment 107 circulates through the cool air discharge openings 109*a* and the cool air suction opening to chill the refrigerator compartment 103.

A chilling device 10 for quickly chilling a beverage or alcohol may be disposed at a side on the top surface of the partition 105. The chilling device 10 may be independently disposed on the top surface of the partition 105, or be coupled to a drawer assembly 13 installed on the partition 105. The chilling device 10 may include a passage connecting to the evaporating compartment 107 and/or the freezer compartment 104 to fluidly communicate with the evaporating compartment 107 and/or the freezer compartment 104. For example, the cool air generated in the evaporating compartment 107 may be supplied into the chilling device 10. A beverage container 6 (refer to FIG. 4) received in the chilling device 10 may be chilled by the cool air supplied into the chilling device 10. The cool air which is increased in temperature by heat-exchanging with the beverage container 6 in the chilling device 10 may return to the evaporating compartment 107. Here, the fluidic communication may represent that the cool air can be circulated between the evaporating compartment 107 and the chilling device 10 by a passage structure such as a duct. Also, the beverage container 6 may include various containers including bottles or cans in which water, a beverage, alcohol, or any liquid is contained. Also, the chilling device 10 may include a chilling compartment defining a space for receiving the beverage container 6 and/or a passage connecting the chilling compartment, the freezer compartment 104, and the evaporating compartment 107 to each other.

The front surface of one of the refrigerator compartment doors 2 may be provided with a dispenser 4 for dispensing ice or purified water at the outside of the refrigerator. The dispenser 4 may be provided with a display unit 5. The display unit 5 may be exposed through the front surface of the refrigerator compartment door 2, or be disposed on the other of the refrigerator compartment doors 2, independently from the dispenser 4.

The display unit 5 displays an operation state of the refrigerator and is used to manipulate an operation of the refrigerator, and may include a combination of a typical button and a display, and the display may be a touch-type display for displaying information.

The display unit 5 displays an operation state of the chilling device 10 or is used to manipulate an operation of the chilling device 10. That is, the display unit 5 is manipulated to turn the chilling device 10 on and off and select an operation time or a mode of the chilling device 10, thereby quickly chilling a beverage container. The display unit 5 may display an operation state of the chilling device 10 and an abnormal operation of the chilling device 10 to a user.

Figure 4:
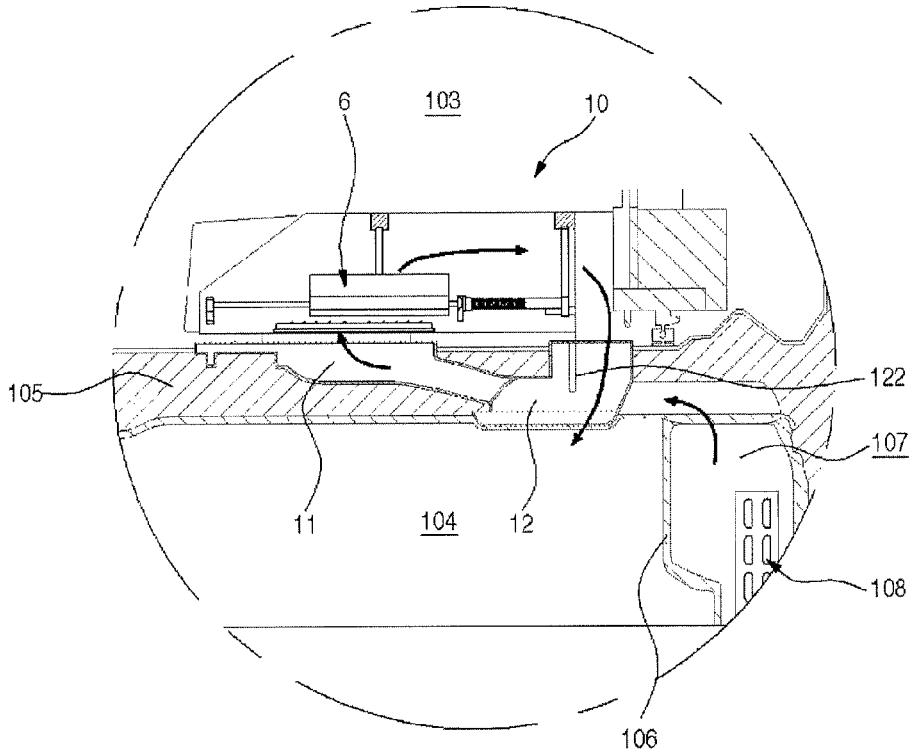
FIG. 4 is a cross-sectional view taken along line 4-4' of FIG. 3.
Figure 5:
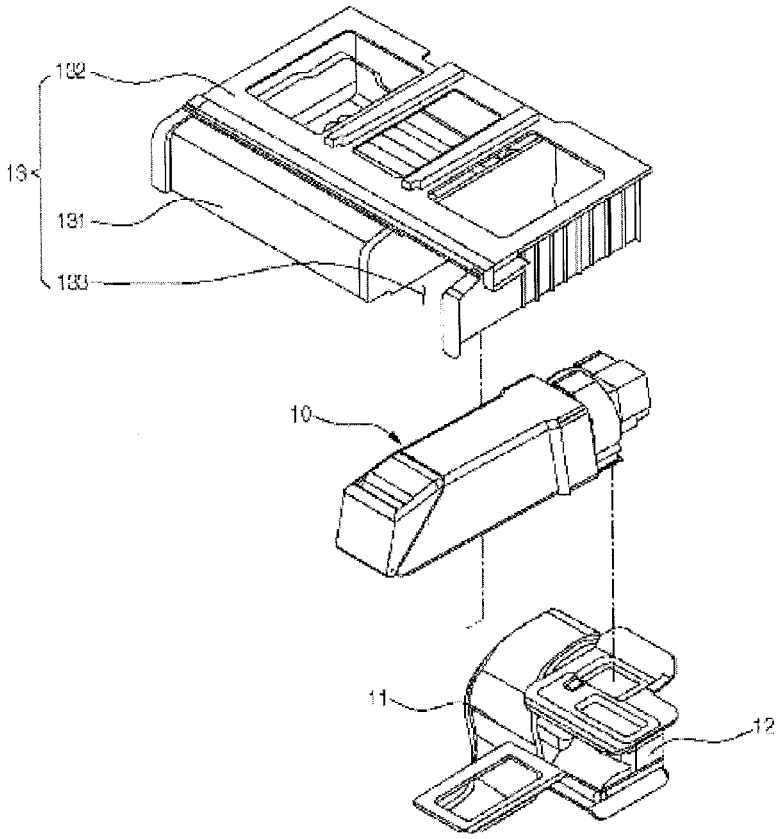
FIG. 5 is an exploded perspective view illustrating coupling of a chilling device, a drawer, and a cool air passage.

FIG. 4 is a cross-sectional view taken along line 4-4' of FIG. 3. FIG. 5 illustrates example coupling of the chilling device, the drawer, and the cool air passage.

Referring to FIGS. 4 and 5, the chilling device 10 may be disposed at a lower right corner in the refrigerator compartment 103, and may be positioned on the top surface of the partition 105 to connect to the cool air passage.

In detail, a drawer assembly 13 may be disposed in the lower portion of the refrigerator compartment 103, and may include a chilling device accommodating part 133 for accommodating the chilling device 10. The drawer assembly 13 may include a drawer 131 that is pushed in and pulled out, and a frame 132 that defines a space accommodating the drawer 131 and the chilling device 10. The chilling device 10 may be accommodated in the chilling device accommodating part 133, and may be integrally formed with the drawer 131.

The drawer assembly 13 may be installed on the top surface of the partition 105 and may define the lowest accommodation space of the refrigerator compartment 103. If necessary, another drawer assembly 13 may be disposed over the drawer assembly 13.

The cool air passage includes a suction duct 11 for supplying cool air from the evaporating compartment 107 to the chilling device 10, and a return duct 12 for returning cool air from the chilling device 10 to the evaporating compartment 107. The suction duct 11 and the return duct 12 may be disposed in the partition 105, or pass through the partition 105.

In detail, an outlet of the suction duct 11 and an inlet of the return duct 12 may be exposed to the top surface of the partition 105, and communicate with the chilling device 10 when the chilling device 10 is installed. The inlet of the suction duct 11 is open into the evaporating compartment 107, and the outlet of the return duct 12 is open into the freezer compartment 104.

A damper 122 may be disposed in the inlet of the return duct 12. When the chilling device 10 is driven, the damper 122 is opened to discharge cool air from a case of the chilling device 10 to the freezer compartment 104. While the chilling device 10 is not driven, the damper 122 closes the return duct 12 to reduce (e.g., prevent) a flow of cool air. Alternatively, the damper 122 may be disposed in the suction duct 11, or may be disposed in each of the suction duct 11 and the return duct 12.

The suction duct 11 and the return duct 12 may be formed of a plastic material through injection molding, and may be disposed in the partition 105. When the chilling device 10 is placed on the partition 105, the suction duct 11 and the return duct 12 may be coupled to the chilling device 10. The suction duct 11, the return duct 12, and the partition 105 may be integrally formed. At this point, a passage may be defined such that the chilling device 10, the freezer compartment 104, and the evaporating compartment 107 communicate with one another.

The cool air passage connects the evaporating compartment 107 to the chilling device 10 to supply cool air from the evaporating compartment 107 to the chilling device 10, and heat-exchanged cool air may be returned to the evaporating compartment 107.

Hereinafter, a configuration, an operation, and a function of the chilling device 10 is described in more detail with reference to the accompanying drawings.

Figure 6:
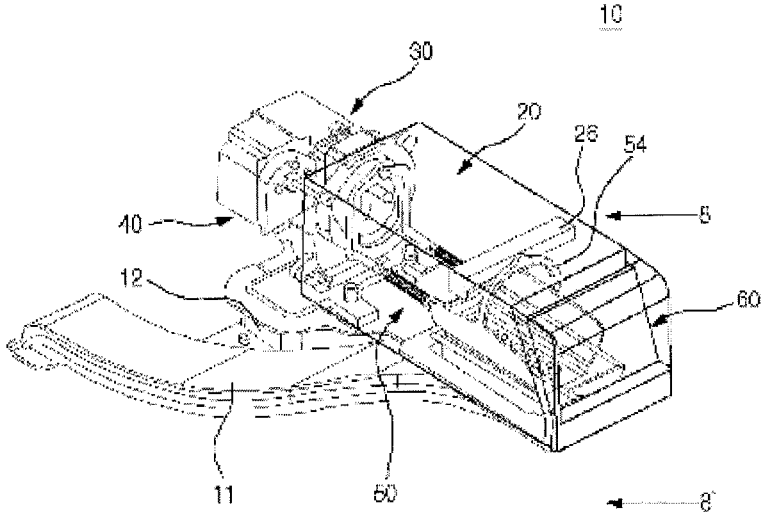
FIG. 6 is perspective view illustrating the chilling device.
Figure 7:
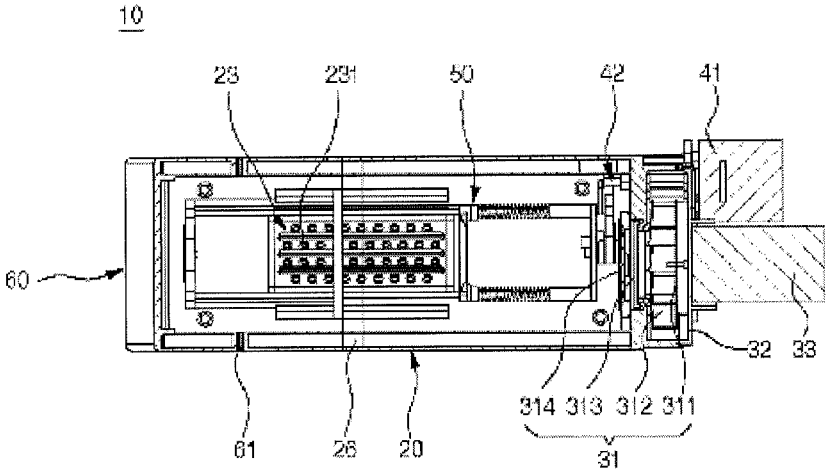
FIG. 7 is a plan view illustrating the chilling device.
Figure 8:
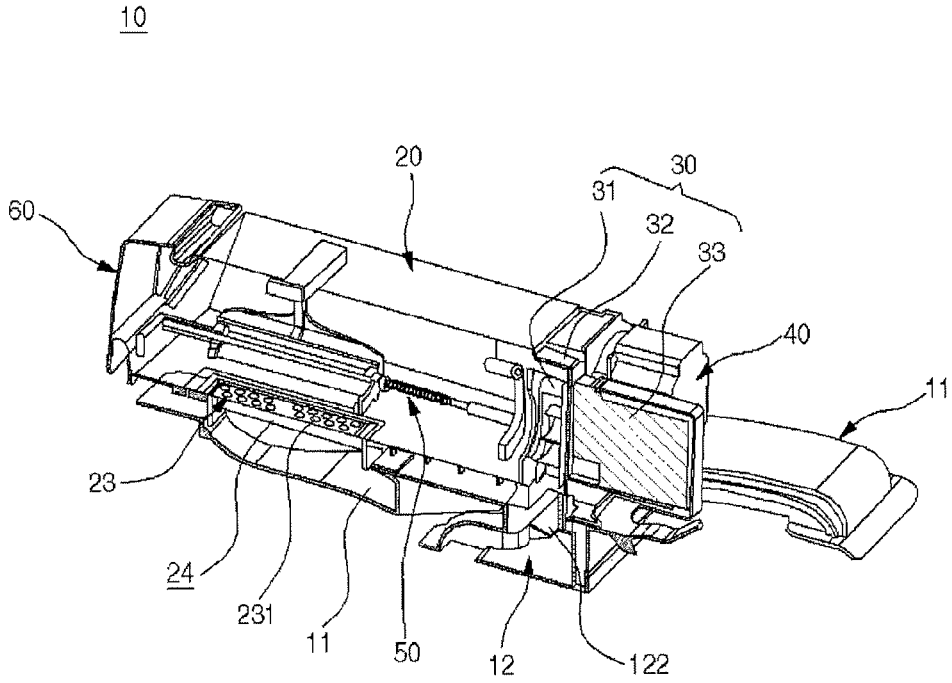
FIG. 8 is a cut-away perspective view taken along line 8-8' of FIG. 6.
Figure 9:
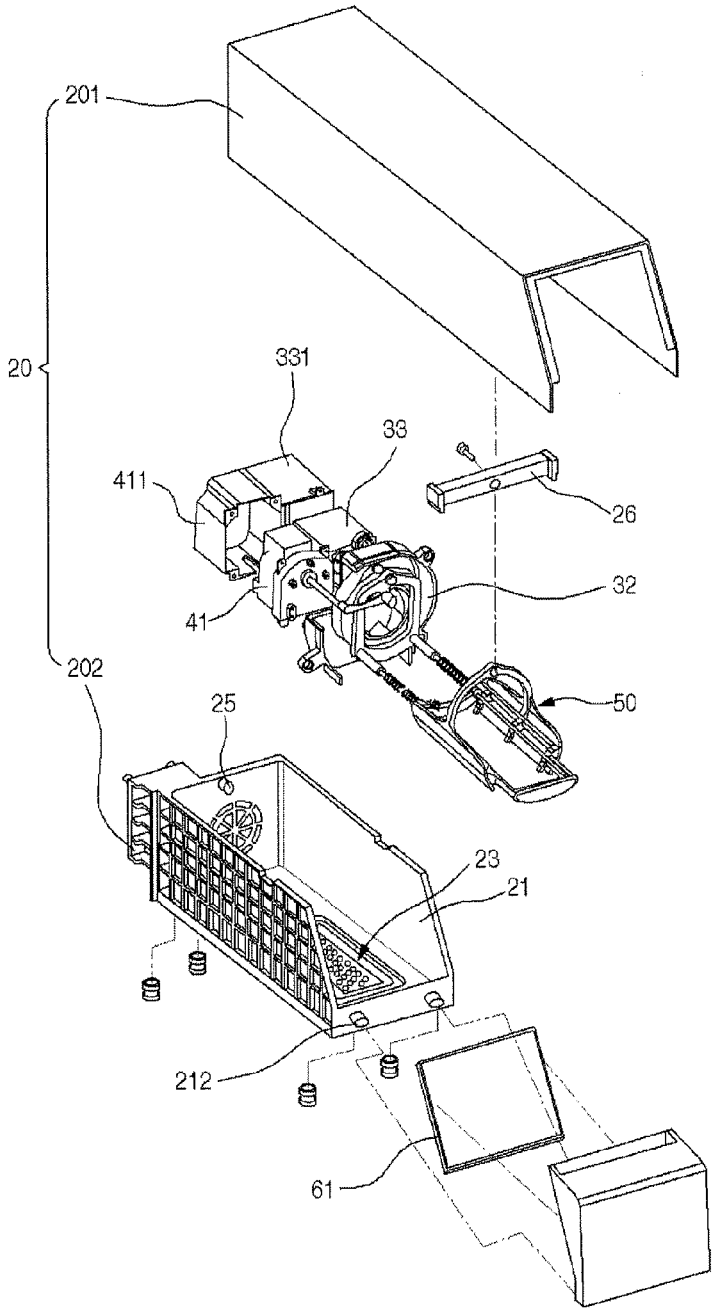
FIG. 9 is an exploded perspective view illustrating the chilling device.

FIG. 6 illustrates an example chilling device. FIG. 7 illustrates the example chilling device. FIG. 8 is a cut-away perspective view taken along line 8-8' of FIG. 6. FIG. 9 illustrates the example chilling device.

Referring to FIGS. 6 to 9, the chilling device 10 may include a chilling compartment and a cool air passage connected to the chilling compartment.

In detail, the chilling compartment may include a case 20 defining a storing space for the beverage container 6; a cover 60 opening and closing an inlet of the case 20, and an agitating member 50 selectively accommodated in the case 20. The beverage container 6 is placed on the agitating member 50. The chilling compartment also may include a fan motor assembly 30 installed on the case 20 to forcibly move cool air, and a driving assembly 40 coupled to the case 20 to drive the agitating member 50.

In more detail, the case 20 has front and rear openings, and has a space accommodating the agitating member 50 and the beverage container 6. The rear opening of the case 20 may be provided with the driving assembly 40, and the driving assembly 40 may close the rear opening of the case 20.

The case 20 may include an upper case 201 and a lower case 202 coupled to the upper case 201. The upper case 201 provides the top, left, and right surfaces of the case 20, and may surround the lower case 202. The lower case 202 is disposed inside the upper case 201, and provides the rear, left, right, and bottom surfaces of the case 20. A plurality of ribs are disposed on the side surfaces of the lower case 202. A predetermined space exists between the lower case 202 and the upper case 201 when coupled to each other. Thus, air layers for insulating are disposed in walls of the case 20, and deformation due to an impact may be reduced (e.g., prevented). Alternatively, an insulating member may be disposed between the upper case 201 and the lower case 202 to insulate the space between the chilling device 10 and the refrigerator compartment 103.

The front surface of the case 20 is provided with an inlet 21 for receiving the beverage container 6. The inlet 21 increases in length downward, and thus, is inclined downward, thereby facilitating access to the beverage container 6. The inlet 21 is opened and closed by the cover 60 having a corresponding shape to the inlet 21. The cover 60 constitutes the front appearance of the chilling device 10, and may have at least one transparent portion to see the inside of the case 20.

A gasket 61 may be disposed at the edge of the cover 60 or the front end of the case 20 to reduce (e.g., prevent) cool air from leaking between the cover 60 and the case 20. Furthermore, a fixing member may be disposed at the edge of the cover 60 or the front end of the case 20 to fix closing of the cover 60. When the chilling device 10 operates, the inside of the case 20 may be in a negative pressure state to maintain closing of the cover 60. Thus, the separate fixing member may not be used.

The lower end of the inlet 21 is provided with cover coupling parts 212. The cover coupling parts 212 are coupled to the lower end of the cover 60 through a shaft. Thus, the cover 60 may rotate about the cover coupling parts 212 as axes, to open and close the inlet 21.

A suction grill 23 may be removably attached to the bottom surface of the case 20, and may be disposed at the outlet of the suction duct 11. The suction grill 23 is installed on a cool air introduction opening 24 in the bottom surface of the case 20.

The cool air introduction opening 24 is disposed at a set position on the case 20. In this case, the set position of the cool air introduction opening 24 may be a position corresponding to the position of one beverage container 6 placed on the agitating member 50. Accordingly, cool air passing through the suction grill 23 is entirely directed to the outer surface of the beverage container 6 to chill the beverage container 6.

The bottom surface of the suction grill 23 may be provided with a plurality of air holes 231. In detail, since the air holes 231 have a small diameter, a flow rate of cool air quickly increases, passing through the outlet of the suction duct 11, that is, the suction grill 23. Thus, since cool air passing through the air holes 231 forms a jet stream, the air holes 231 may be called jet holes. The air holes 231 are spaced a constant distance from one another, and uniformly distributed in a surface of the suction grill 23.

The air holes 231 discharge cool air in a direction crossing a large area of the beverage container 6 placed on the agitating member 50. That is, since the large area of the beverage container 6, such as a typical bottle or can, may be a side surface thereof, the beverage container 6 is laid down on the agitating member 50, and cool air may be discharged from the air holes 231 to the side surface of the beverage container 6. As such, when cool air discharged from the air holes 231 perpendicularly contacts the beverage container 6, chilling efficiency for the beverage container 6 is increased (e.g., maximized).

The upper end of the suction grill 23 is bent outward and extends to rest on the bottom of the case 20, so that the suction grill 23 may be removably installed on the bottom of the case 20. In this case, a locking structure may be provided to stop removal of the suction grill 23 from the bottom of the case 20 due to sucked air.

The agitating member 50 can swing in the case 20. In detail, the rear end of the agitating member 50 is coupled to an agitating member support 25 as a shaft, and the other end thereof is coupled as a shaft to a support frame 26 at the front side.

In detail, the support frame 26 laterally extends (e.g., along left and right directions in FIG. 6) in the inner upper portion of the case 20. The support frame 26 may be disposed as a separate member in the case 20, and a guide support 54 part of the agitating member 50 may be rotatably installed on the support frame 26.

Accordingly, the agitating member 50 is shaft-coupled to swing back and forth in the case 20, and is connected to the driving assembly 40 to repeatedly and continuously swing a predetermined angle, thereby agitating a beverage in the beverage container 6. Configuration of the agitating member 50 is described in more detail later.

The chilling compartment may include the driving assembly 40 to provide driving force to the agitating member 50 that repeatedly rotates left and right in the case 20.

The fan motor assembly 30 may include a suction fan 31 for forcibly moving air, a fan housing 32 accommodating the suction fan 31 and installed on the rear surface of the case 20, and a fan motor 33 disposed behind the fan housing 32 and providing torque to the suction fan 31.

The fan motor 33 is disposed behind the case 20, and is connected to the suction fan 31 in the case 20. The fan motor 33 is accommodated in a fan motor housing 331 that is fixed to the fan housing 32 or the case 20, so that the fan motor 33 can be installed therein. The fan motor housing 331 may be supported by the partition 105.

In detail, cool air generated from the evaporating compartment 107 is sucked with relatively high suction force by the suction fan 31. Air introduced along the cool air passage into the case 20 is moved at relatively high speed to the rear side of the case 20 by suction force of the suction fan 31. At this point, the air contacts the outer surface of the beverage container 6 disposed in the case 20, to exchange heat. A flow rate of air sucked by the suction fan 31 may be higher than that of air blown by a blower fan. This may occur when pressure difference between the front and rear sides of the suction fan 31 is quickly increased. In addition, since the flow rate of the air sucked by the suction fan 31 increases, the amount of heat exchange between the beverage container 6 and the air increases. Accordingly, heat exchange efficiency may be improved.

Cool air sucked by the suction fan 31 exchanges heat with the beverage container 6 in the case 20 before the fan motor 33 driving the suction fan 31. Accordingly, the amount of heat exchange between the cool air and the beverage container 6 may increase, and thus, heat exchange efficiency may be improved. If a blower fan blows air, the air blown by the blower fan passes through a fan motor for driving the blower fan, and then, exchanges heat with the beverage container 6. That is, the blown cool air absorbs heat, passing through the fan motor, and then, exchanges heat with the beverage container 6. Thus, heat exchange efficiency of the suction fan 31 may be higher than that of a blower fan.

The suction fan 31 may be a centrifugal fan that axially sucks air to radially discharge the air. Air passing through the case 20 flows as a whole in a horizontal direction, and moves downward to return to the evaporating compartment 107. That is, the direction of the air passing through the case 20 crosses the direction of the air discharged from the suction fan 31. Thus, a centrifugal fan is provided to a passage in which the directions of air cross each other.

Pneumatic resistance of the suction fan 31 may be smaller than that of a blower fan. For example, air blown by a blower fan may not pass through a narrow gap or an obstacle in an air passage, and may be spread or flows back. For a suction fan, the suction fan 31 sucks air at the inlet thereof to cause pressure difference. Thus, air at the front side of a narrow gap or an obstacle passes through the narrow gap or the obstacle by pressure difference between the front and rear sides thereof. As a result, under the same condition, pneumatic resistance of air sucked by the suction fan 31 may be smaller than that of air blown by a blower fan, and a flow rate of air sucked by the suction fan 31 may be larger than that of air blown by a blower fan.

In addition, although the suction fan 31 may be a centrifugal fan, the structure of the suction fan 31 may be different from that of a typical centrifugal fan. In detail, the suction fan 31 includes a back plate 311 having a circular plate shape, blades 312 disposed on the front surface of the back plate 311, and a suction guide 313 disposed on the front end of the blades 312. The blades 312 have a predetermined width and protrude forward from the front surface of the back plate 311. The blades 312 are rounded with a predetermined curvature in a radial direction from the center of the back plate 311. The suction guide 313 functions as a combination of a bell mouth and an orifice. That is, the suction guide 313 smoothly guides an air flow from the front side of the fan housing 32 into the suction fan 31, and reduces (e.g., prevents) a backflow of air discharged in the radial direction along the surfaces of the blades 312.

In detail, the suction guide 313 protrudes forward from a circular bottom, and gradually decreases in diameter. In this regard, a vertical cross section of the suction guide 313 may have a round structure where the suction guide 313 gradually decreases in diameter on a horizontal cross-section from the bottom to the upper end, and has a constant diameter on the horizontal cross-section at a predetermined position. As such, since the outer surface of the suction guide 313 is smoothly rounded, pneumatic resistance applied on sucked air can be reduced (e.g., minimized), thereby providing a function of an orifice. In addition, the suction guide 313 has a barrel shape extending a predetermined length from the bottom of the suction guide 313 to reduce (e.g., minimize) a back flow of air sucked through the inlet of the suction guide 313, thereby providing a function of a bell mouth. A grill 314 may be disposed at the front side of the suction guide 313 to reduce (e.g., prevent) introduction of a foreign substance.

The cool air passage may include the suction duct 11 for supplying cool air from the evaporating compartment 107 to the case 20, and the return duct 12 for discharging cool air from the case 20 to the freezer compartment 104. In detail, the inlet (or suction opening) of the suction duct 11 may communicate with the evaporating compartment 107, and the outlet (or discharge opening) thereof may communicate with the bottom of the case 20. The inlet of the return duct 12 may be connected to the bottom of the fan housing 32, the outlet (or discharge opening) thereof may be connected to the freezer compartment 104. That is, the suction duct 11 introduces cool air from the evaporating compartment 107 into the case 20, and the return duct 12 discharges cool air from the case 20 into the freezer compartment 104 through the fan housing 32.

The driving assembly 40 generates torque, and may include a driving motor 41 accommodated in a driving motor housing 411 installed on the case 20, and a transmission unit 42 connecting the driving motor 41 to the agitating member 50 to rotate the agitating member 50, which is described in more detail later.

Figure 10:
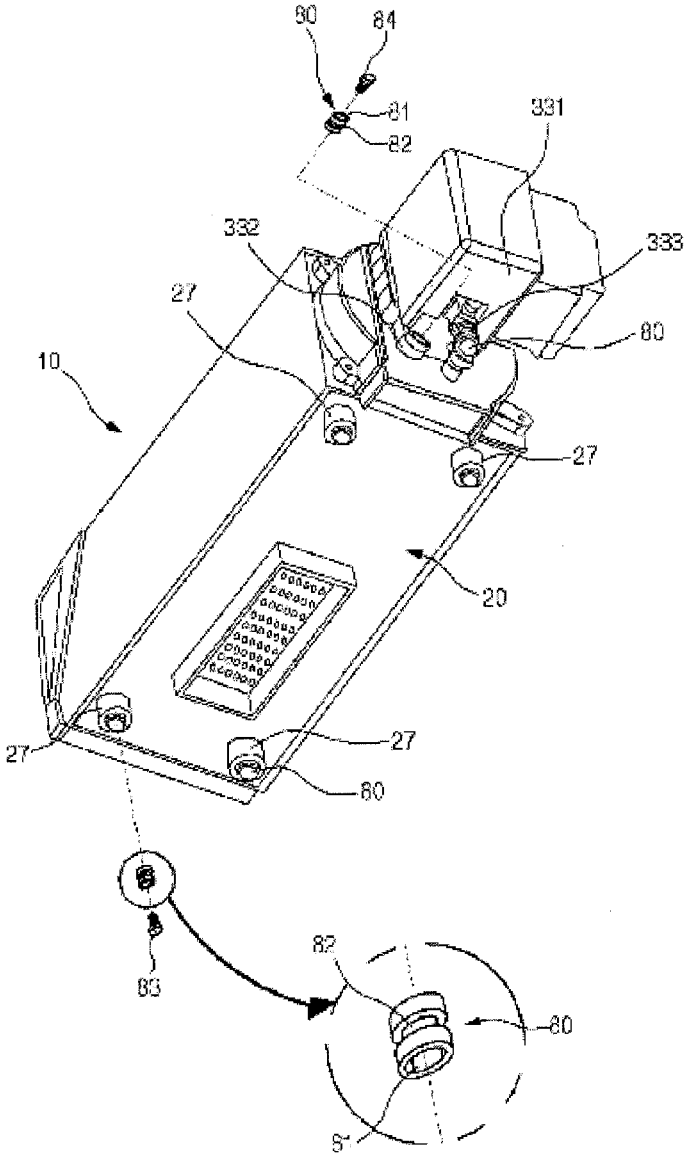
FIG. 10 is perspective view illustrating the lower portion of the chilling device.
Figure 11:
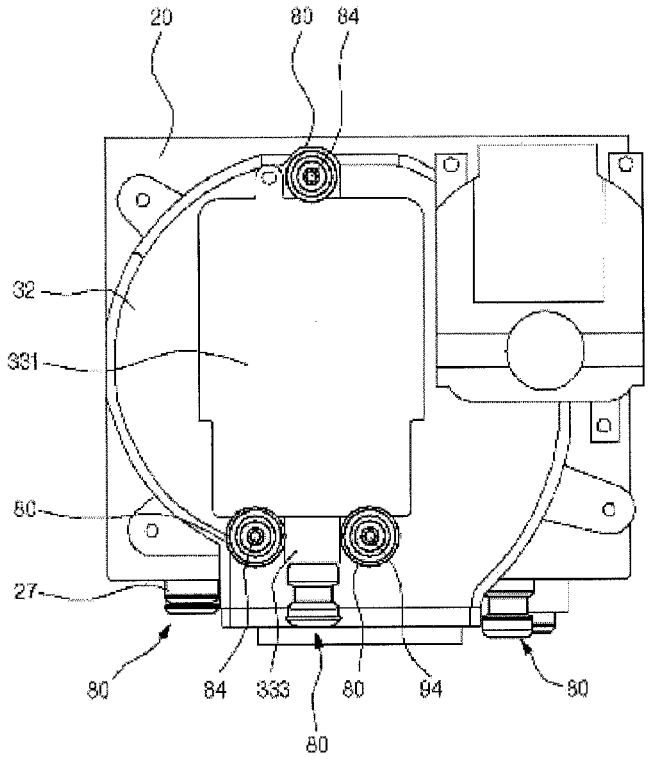
FIG. 11 is a rear view illustrating the chilling device.

FIG. 10 illustrates a lower portion of an example chilling device. FIG. 11 is a rear view illustrating the example chilling device.

Referring to FIGS. 10 and 11, since the chilling device 10 includes rotating and swinging parts, a vibration may occur. To reduce a vibration, the chilling device 10 may include vibration reduction members 80.

The vibration reduction members 80 reduce vibrations generated by the fan motor 33 and the suction fan 31 rotating at high speed while the chilling device 10 is driven. The vibration reduction members 80 are provided to the case 20 and the fan motor housing 331. The vibration reduction members 80 may have a shape to apply in common to various positions.

In detail, the vibration reduction members 80 may be formed of an elastic material, such as silicon and rubber. The vibration reduction members 80 have a cylindrical shape having a predetermined height, and may include a coupling part 81 passing through the center thereof and a recess part 82 along the edge thereof.

The coupling part 81 is used to fix the vibration reduction members 80, and has a size to be coupled to a screw 83, and vertically passes through the center of the vibration reduction member 80. Thus, a screw is inserted into the coupling part 81 to fix the vibration reduction members 80. Since the coupling part 81 has an inner stepped portion, a head of the screw 83 is coupled to the inner stepped portion to fix the vibration reduction member 80.

The recess part 82 extends around the middle of the height of the vibration reduction member 80, and is inserted in a second installation part 332 to be described later. That is, when the vibration reduction member 80 is pressed into the second installation part 332, the second installation part 332 is inserted into the recess part 82, and the upper and lower portions of the recess part 82 interfere with the second installation part 332 to fix the vibration reduction member 80.

The vibration reduction members 80 are provided to eight portions including the bottom of the case 20 and the fan motor housing 331 to reduce a vibration.

In detail, first installation parts 27 on which the vibration reduction members 80 are installed are disposed at the four corners of the bottom of the case 20. The first installation part 27 is recessed in a shape corresponding to the shape of the vibration reduction member 80 to receive the vibration reduction member 80. In this case, the depth of the first installation part 27 may be smaller than the height of the vibration reduction member 80.

Thus, when the vibration reduction member 80 is inserted into the first installation part 27, the vibration reduction member 80 protrudes out of the first installation part 27. Accordingly, when the case 20 is installed, the vibration reduction members 80 contact the partition 105 or other structures provided to the partition 105 to reduce a vibration of the case 20.

The screw 83 may be inserted in the coupling part 81 to fix the vibration reduction member 80. The screw 83 may be coupled to the bottom of the first installation part 27 to fix the vibration reduction member 80.

Three of the second installation parts 332 and a third installation part 333 may be provided to the fan motor housing 331.

In detail, the three second installation parts 332 may be disposed on the upper and lower ends of an open front portion of the fan motor housing 331, and have the same shape in different positions.

The second installation part 332 has a ring shape to receive the vibration reduction member 80. An inner diameter of the second installation part 332 corresponds to an outer diameter of the recess part 82, and a width of the second installation part 332 corresponds to a width of the recess part 82.

Thus, when the vibration reduction member 80 is installed, the vibration reduction member 80 can be inserted in the second installation part 332. In this state, the second installation part 332 may be disposed in the recess part 82, and the vibration reduction member 80 may protrude to both sides of the second installation part 332. In this state, a screw 84 may be coupled to the coupling part 81 of the vibration reduction member 80 to fix the fan motor housing 331 as well as the vibration reduction member 80 to the fan housing 32 or the case 20. One of the second installation parts 332 is disposed at the center of the upper end of the fan motor housing 331, and two of the second installation parts 332 are disposed at the left and right sides of the lower end of the fan motor housing 331, to stably fix the fan motor housing 331.

When the fan motor housing 331 is installed, the vibration reduction members 80 contact the fan housing 32 or the case 20 to reduce a vibration occurring while the fan motor 33 is driven.

The third installation part 333, which protrudes downward, may be disposed at the lower end of the fan motor housing 331, and the vibration reduction member 80 is installed on the third installation part 333. The third installation part 333 has a protrusion shape protruding downward, and is pressed into the coupling part 81. When being installed, the vibration reduction member 80 is configured to contact the partition 105 or a structure for installing the chilling device 10. Thus, when the chilling device 10 is installed, the vibration reduction member 80 supports the fan motor 33 from the lower side, and reduces a vibration occurring while the fan motor 33 is driven.

Figure 12:
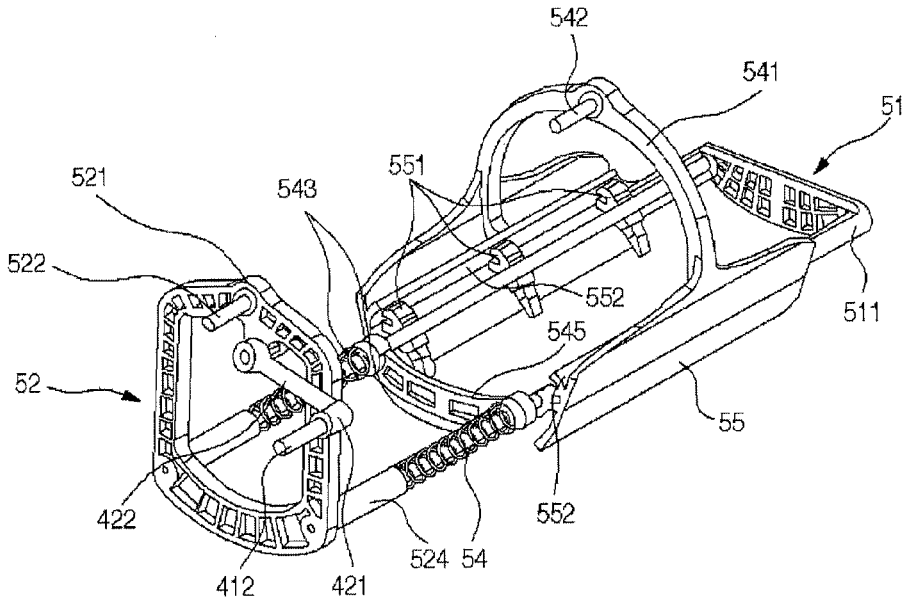
FIG. 12 is a perspective view illustrating an agitating member.
Figure 13:
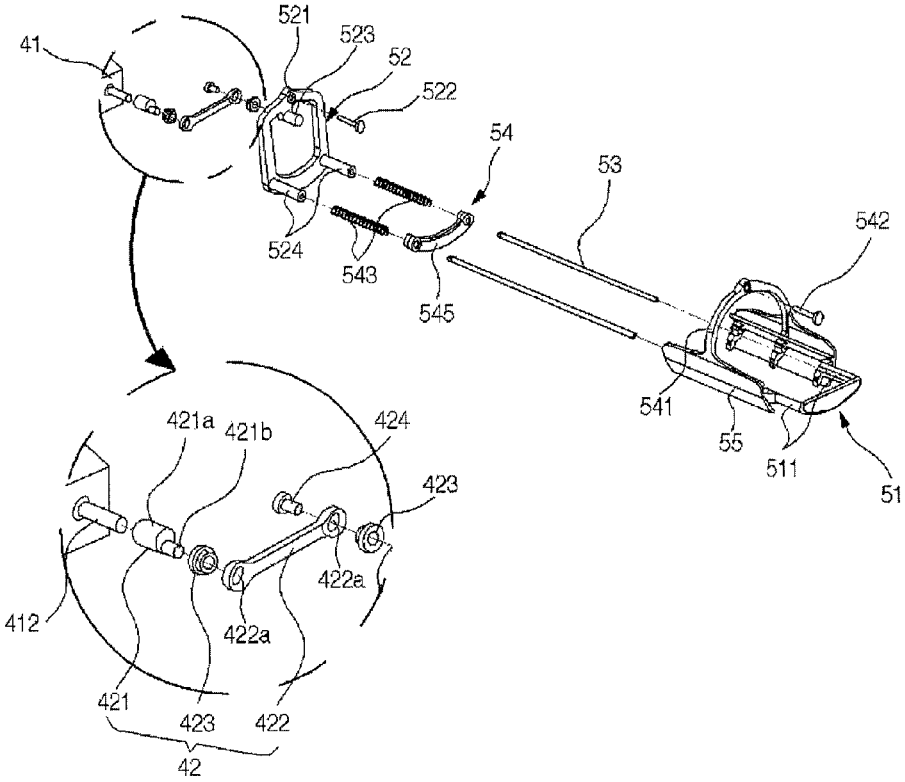
FIG. 13 is an exploded perspective view illustrating the agitating member of FIG. 12.
Figure 14:
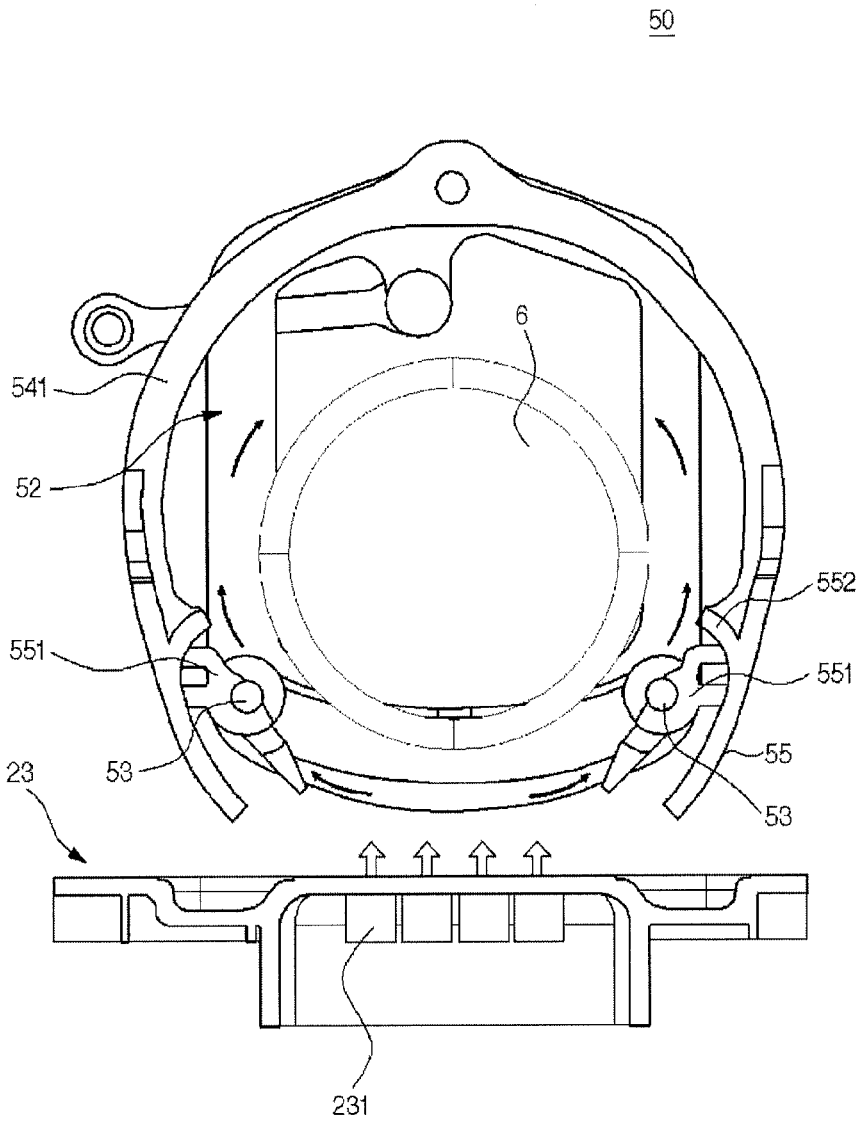
FIG. 14 is a schematic view illustrating a flow of cool air in a state where a beverage container is placed on the agitating member of FIG. 12.

FIG. 12 illustrates an example agitating member. FIG. 13 is an exploded perspective view illustrating the agitating member of FIG. 12. FIG. 14 illustrates an example flow of cool air in a state where a beverage container is placed on the agitating member of FIG. 12.

Referring to FIGS. 12 to 14, the agitating member 50 accommodates the beverage container 6 to shake the beverage container 6. In detail, the agitating member 50 may include a front support 51 defining a front surface of the agitating member 50, a rear support 52 defining a rear surface of the agitating member 50, and a pair of holder shafts 53 connecting the front support 51 to the rear support 52. The beverage container 6 is placed on the holder shafts 53. A guide support 54 (e.g., a neck holder) may be disposed between the front support 51 and the rear support 52.

The front support 51 and the rear support 52 constitute the front and rear ends of the agitating member 50, and the holder shafts 53 are disposed therebetween.

The front ends of the holder shafts 53 disposed at the left and right sides may be connected to each other by the front support 51. A front surface of the front support 51 may be provided with a front support extension part 511 that extends rearward to receive the front ends of the holder shafts 53. The front support extension part 511 may be connected to the guide support 54 to integrate the guide support 54 and the front support 51. The front support 51 may be formed of a different material from a material used to form the guide support 54, and may be spaced forward from the guide support 54.

The rest of the rear support 52, except for the edge thereof, is a through hole to form a ring shape or a shape similar to a ring, thereby efficiently passing cool air. The upper end of the rear support 52 is provided with an agitating member support 521 such that the agitating member 50 is rotatably installed on the rear surface of the case 20. A rotation shaft 522 passing through the agitating member support 521 is coupled to the rear portion of the case 20, so that the agitating member 50 is rotatably installed on the rear surface of the case 20. The rotation shaft 522 may pass through the agitating member 50, and be coupled to a rear wall of the case 20 or the fan housing 32.

A driving connection 523 protrudes downward under the agitating member support 521. The driving connection 523 is coupled to the transmission unit 42 to swing the agitating member 50, and may extend toward the center of the rear support 52. Accordingly, the driving connection 523 is moved left and right to swing the agitating member 50.

Shaft insertion parts 524 protrude forward at the left and right sides of the lower end of the rear support 52. The shaft insertion parts 524 have a pipe shape to receive the installation member 545, and protrude a predetermined length to stably install the holder shafts 53.

The guide support 54 may be disposed between the front support 51 and the rear support 52. The guide support 54 is configured to swing the agitating member 50 in the case 20, and guides cool air discharged from the air holes 231 to flow along the beverage container 6. The guide support 54 may include a support 541 for installing the guide support 54, and air guides 55 for guiding cool air.

In detail, the support 541 may have a ring shape or a circular band shape with an absent lower part. The upper end of the support 541 is rotatably coupled to the support frame 26 through a rotation shaft 542. The support 541 may extend downward with a predetermined curvature at the left and right sides of the upper end of the support 541.

The air guide 55 guides cool air discharged from the air holes 231 of the suction grill 23 to reduce (e.g., prevent) dispersion of the cool air after colliding with the beverage container 6, so that the cool air flows along the beverage container 6 to chill the beverage container 6 again.

The air guides 55 extend downward from the left and right sides of the support 541. The air guide 55 may have a length corresponding to or greater than the length of the suction grill 23, and have a predetermined vertical width. Thus, when the guide support 54 is installed, the air guides 55 are disposed over the suction grill 23, and the beverage container 6 placed on the agitating member 50 is surrounded by the air guides 55 at the left and right sides.

In detail, the air guides 55 are rounded to surround the outer surface of the beverage container 6. The air guides 55 are disposed at the left and right sides to correspond to the suction grill 23, thereby guiding cool air discharged from the suction grill 23. The lower ends of the air guides 55 extend out of the left and right ends of the suction grill 23 to guide all cool air discharged from the suction grill 23 into the space between the air guides 55.

Air guide installation parts 551 are disposed on the inner surfaces of the air guides 55 such that the holder shafts 53 fix the air guides 55. The air guide installation parts 551 are disposed outside the holder shafts 53 and are spaced a constant distance from one another. The holder shafts 53 are press coupled to the air guide installation parts 551. Thus, even when cool air quickly flows in the case 20, a vibration of the air guides 55 is reduced (e.g., prevented).

The inner upper portions of the air guides 55 may be provided with guide plates 552. The guide plate 552 protrudes with a predetermined curvature inward from the inner upper portion of the air guide 55. The guide plate 552 may extend a predetermined length from the front end of the air guide 55 to the rear end thereof. Thus, even at the upper portions of the air guides 55, cool air can be guided without dispersion along the beverage container 6 by the guide plate 552.

The front end of the air guide 55 may contact the front support extension part 511, and may be connected to the front support extension part 511 or be integrally formed with the front support extension part 511 to more stably assemble the agitating member 50.

Referring to FIG. 14, when the chilling device 10 is driven, cool air sucked from the evaporator 108 is moved upward through the air holes 231 of the suction grill 23. The speed of cool air passing through the air holes 231 is increased, and then, the cool air perpendicularly collides with the beverage container 6 in the case 20.

Cool air contacting the lower end of the beverage container 6 is divided to both sides along the surface of the beverage container 6, and flows of the divided cool air are guided along the surface of the beverage container 6 by the air guides 55. The cool air flowing along the air guide 55 having a predetermined curvature is also guided along the beverage container 6 by the guide plates 552 at the upper side, and thus, can flow along the surface of the beverage container 6 until arriving at the upper portion of the beverage container 6.

The cool air on the surface of the beverage container 6 continually exchanges heat with the beverage container 6 and the beverage therein, and is moved to the rear side of the case 20 and is discharged out of the case 20 by a rotation of the suction fan 31.

The holder shaft 53 horizontally extends as a shaft or a bar, and is connected to the front support 51 and the rear support 52. The holder shafts 53 are disposed at the left and right sides, and are spaced a predetermined distance from each other, so that the beverage container 6 having an arbitrary size can be accommodated in a space defined by the holder shafts 53. Cool air may efficiently flow into the space defined by the holder shafts 53.

A neck holder 54 may be installed on the holder shafts 53 to support the neck of a beverage container, such as a wine bottle. The neck holder 54 can move along the holder shafts 53 according to the size of a bottle.

The neck holder 54 is installed on the holder shafts 53 at the lower side, and the holder shafts 53 pass through the left and right portions of the neck holder 54 to move the neck holder 54 back and forth along the holder shafts 53. The upper end of the neck holder 54 is provided with a rounded seat 545 with a central portion below left and right portions. Thus, when a beverage container such as a bottle is placed, the neck of the beverage container is seated on the seat 545.

Elastic members 543 are disposed between the neck holder 54 and the rear support 52. When the neck holder 54 moves rearward, the elastic members 543 are compressed to provide elastic force to the neck holder 54, so that the neck holder 54 can return to its original position.

In detail, the front and rear ends of the elastic member 543 contact the neck holder 54 and the shaft insertion part 524 of the rear support 52. The holder shafts 53 pass through the elastic members 543, so that the elastic members 543 can be compressed in the longitudinal direction of the holder shafts 53. When the elastic members 543 are not compressed, the elastic members 543 may contact the air guide 55. In this state, a space defined by the neck holder 54, the air guides 55, and the front support 51 may have a size to accommodate a can as the beverage container 6. When the beverage container 6 is provided in plurality, or the beverage container 6 is long, the neck holder 54 moves rearward to compress the elastic members 543.

When the elastic members 543 are not compressed, the neck holder 54 is disposed at the rear end of the suction grill 23. Thus, when the beverage container 6 is placed, and an end of the beverage container 6 contacts the neck holder 54, cool air from the suction grill 23 contacts the surface of the beverage container 6 over a large (e.g., maximum) surface area.

Hereinafter, the driving assembly is described in more detail.

The driving assembly 40 may include the driving motor 41 generating torque, and the transmission unit 42 transmitting the torque from the driving motor 41 to rotate the agitating member 50

The driving motor 41 is used to drive the agitating member 50, and may be disposed on a side of the fan motor 33, separately from the fan motor 33. The driving motor 41 is disposed behind the case 20, and is fixedly accommodated in the driving motor housing 411 coupled to the case 20.

The driving motor 41 has the same structure as that of a typical electric motor, and may be disposed on the outside of the case 20. A rotation shaft 412 of the driving motor 41 may extend into the case 20, and be coupled to the transmission unit 42 in the case 20. Although the driving motor 41 may be disposed in the case 20, the driving motor 41 also may be disposed out of the case 20 to reduce (e.g., prevent) degradation of chilling efficiency of the chilling device 10 due to heat from the driving motor 41.

The driving motor 41 may be a typical DC motor. Torque from the driving motor 41 is converted by the transmission unit 42 to swing the agitating member 50. The driving motor 41 may be a stepping motor that can rotate forward and reverse by a constant angle. Thus, the driving motor 41 can repeatedly rotate forward and reverse by a constant angle, so that the agitating member 50 can swing.

The transmission unit 42 is installed on the driving motor 41. The transmission unit 42 includes a rotation member 421 connected to the rotation shaft 412 of the driving motor 41, and a connecting rod 422 connecting the rotation member 421 to the driving connection 523. The rotation shaft 412 of the driving motor 41 is parallel to an extension line of the holder shafts 53.

In detail, the rotation member 421 is coupled to the rotation shaft 412 of the driving motor 41, and rotates together with the rotation shaft 412 when the rotation shaft 412 rotates. The rotation member 421 and the rotation shaft 412 extend in the same direction. The rotation member 421 may include a shaft coupler 421*a* coupled to the rotation shaft 412, and an extension 421*b* extending from a portion eccentric from a rotation center of the shaft coupler 421*a*.

The shaft coupler 421*a* has a recess having a shape corresponding to the rotation shaft 412 to receive the rotation shaft 412 and power from the rotation shaft 412. Thus, when the rotation shaft 412 rotates, the rotation member 421 also rotates.

The extension 421*b* extends from the front end of the shaft coupler 421*a* and is eccentric from the rotation center of the shaft coupler 421*a*. The extension 421*b* is rotatably coupled to the connecting rod 422. Thus, when the shaft coupler 421*a* rotates, the extension 421*b* rotates along a predetermined trajectory about the rotation center of the shaft coupler 421*a* as an axis, and the connecting rod 422 reciprocates with a constant displacement.

The connecting rod 422 crosses extension directions of the rotation shaft 412 and the holder shafts 53, and may have a rod shape with a predetermined length. Coupling holes 422*a* are disposed at both ends of the connecting rod 422 to receive shafts. Thus, one of the coupling holes 422*a* disposed at an end of the connecting rod 422 is rotatably coupled to the extension 421*b*, and the other of the coupling holes 422*a* is rotatably coupled to the driving connection 523 through a rotation shaft 424.

The coupling holes 422*a* of the connecting rod 422 may be provided with bushes 423 that are coupled to the extension 421*b* and the driving connection 523 as shafts. The bushes 423 may be formed of a plastic material to reduce (e.g., prevent) wear and noise due to friction generated during a rotation of the connecting rod 422.

The connecting rod 422 is adjacent to the rear support 52, and may be disposed at a position to minimize the length of the rotation shaft 412 of the driving motor 41.

Figure 15:
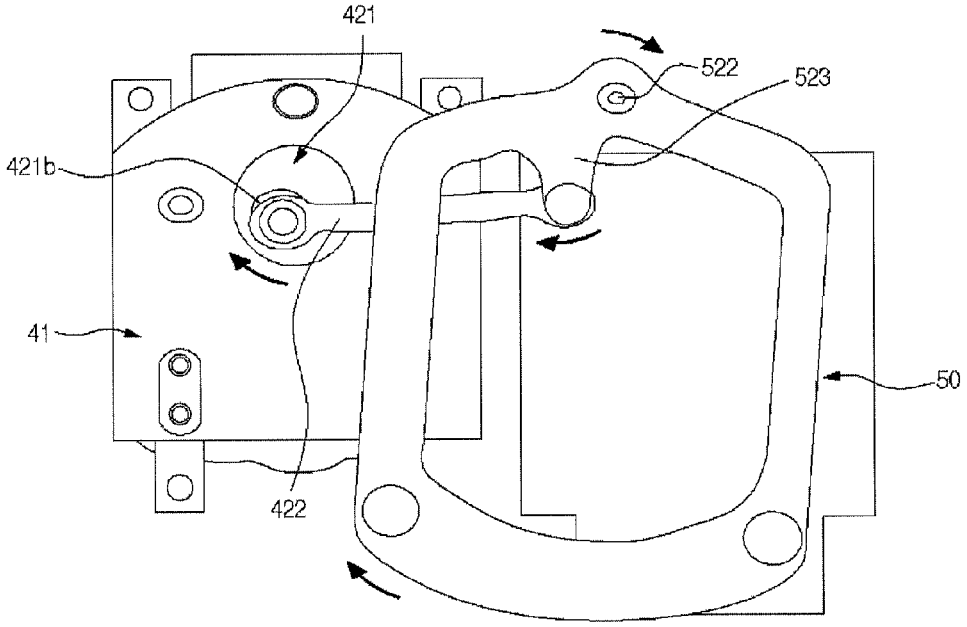
FIGS. 15 and 16 are schematic views illustrating a swing of the agitating member.
Figure 16:
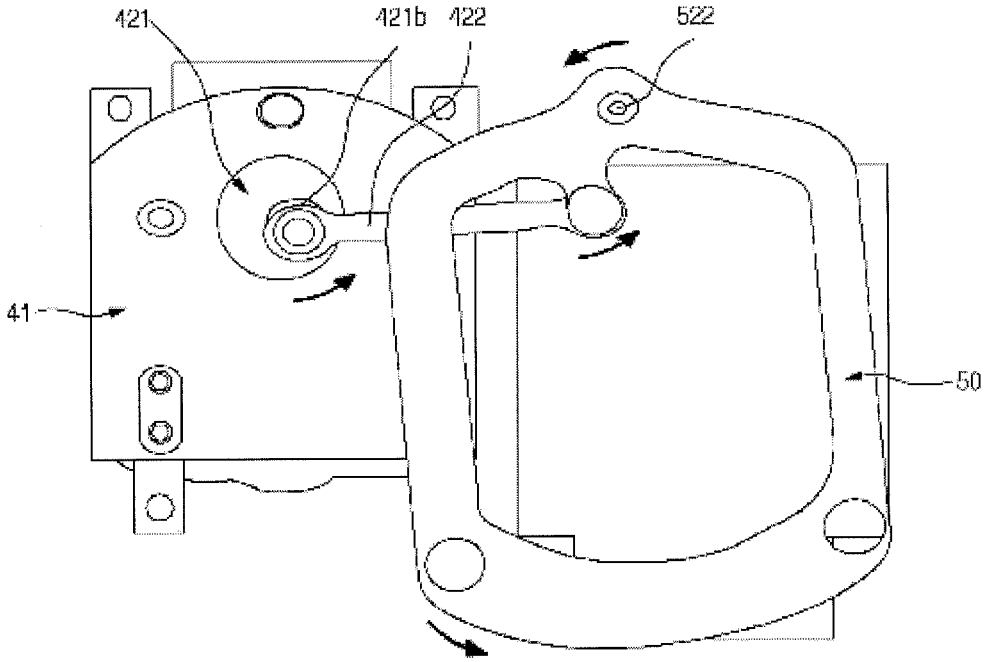

FIGS. 15 and 16 illustrate an example swing of an example agitating member.

Referring to FIGS. 15 and 16, a swing of the agitating member is described. When the driving motor 41 rotates, the rotation member 421 also rotates, and the connecting rod 422 reciprocates. While the connecting rod 422 reciprocates, the agitating member 50 repeatedly rotates, that is, swings through a predetermined angle.

In detail, when the driving motor 41 rotates, the rotation member 421 rotates together with the rotation shaft 412 of the driving motor 41. As illustrated in FIG. 15, when the extension 421*b* of the rotation member 421 is disposed at the left side, the connecting rod 422 pulls the driving connection 523 to the left side. Since the driving connection 523 is disposed under the rotation shaft 522 of the rear support 52, when the connecting rod 422 pulls the driving connection 523 to the left side, the agitating member 50 rotates clockwise about the rotation shaft 522 and moves toward the right side.

As illustrated in FIG. 16, when the extension 421*b* of the rotation member 421 is disposed at the right side, the connecting rod 422 pushes the driving connection 523 to the right side. Thus, the agitating member 50 rotates counterclockwise about the rotation shaft 522 and moves toward the left side.

As such, torque from the driving motor 41 is transmitted to the agitating member 50 by the transmission unit 42. Thus, when the driving motor 41 continually rotates, the agitating member 50 repeatedly rotates clockwise and counterclockwise in a set angle range, and thus, the agitating member 50 swings left and right. Accordingly, a beverage in the beverage container 6 placed on the agitating member 50 is agitated, so that chilling speed of the beverage increases.

Figure 17:
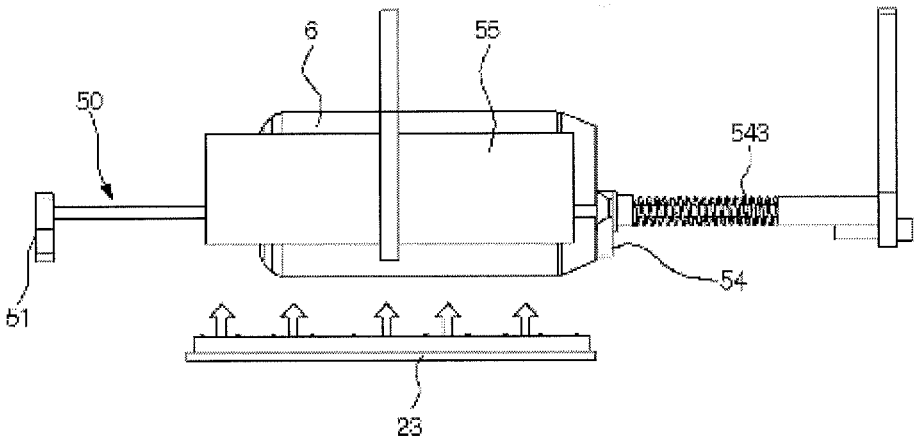
FIG. 17 is a schematic view illustrating a beverage container placed on the agitating member.
Figure 18:
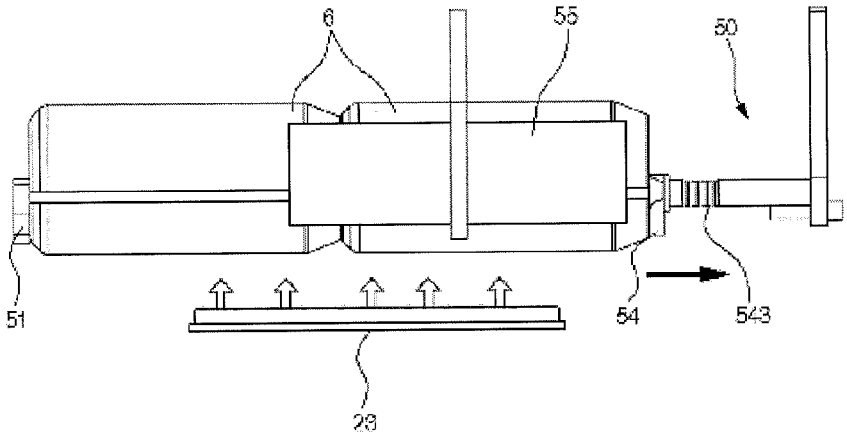
FIG. 18 is a schematic view illustrating two beverage containers placed on the agitating member.
Figure 19:
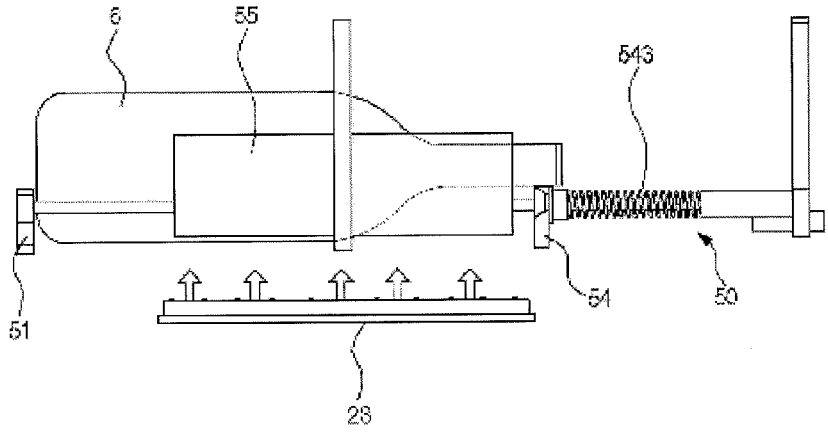
FIG. 19 is a schematic view illustrating a bottle placed on the agitating member.

FIG. 17 illustrates a beverage container placed on an example agitating member. FIG. 18 illustrates two beverage containers placed on an example agitating member. FIG. 19 illustrates a bottle placed on an example agitating member.

Hereinafter, placement states of beverage containers according to the shapes of the beverage containers is described with reference to FIGS. 17 to 19.

Referring to FIG. 17, a can as the beverage container 6 is disposed in the case 20. In detail, the cover 60 is opened, and the beverage container 6 is inserted through the inlet 21 of the case 20. At this point, the upper or lower end of the beverage container 6 contacts the neck holder 54, and the beverage container 6 is placed on the agitating member 50. In this state, the air guide 55 surrounds both sides of the beverage container 6.

At this point, the elastic members 543 disposed at the rear side of the neck holder 54 (e.g., the right side of FIG. 17) are not compressed. When the beverage container 6 is greater than a set size, the elastic members 543 may be compressed, and the neck holder 54 may be moved rearward.

When one beverage container 6 is placed on the agitating member 50, an end of the beverage container 6 corresponds to the rear end of the suction grill 23. Thus, the entire or most part of the beverage container 6 is disposed at the vertical upper side of the suction grill 23, and the beverage container 6 is maximally exposed to cool air discharged from the suction grill 23. Thus, the beverage container 6 can be quickly chilled.

Referring to FIG. 18, two cans as the beverage container 6 are disposed in the case 20. In detail, the cover 60 is opened, and the beverage container 6 is inserted through the inlet 21 of the case 20. One of the beverage containers 6 is placed on the agitating member 50, and then, the other is placed.

At this point, the beverage container 6 placed first can be moved rearward, and then, the neck holder 54 is moved rearward to expand a space for placing the beverage container 6.

After the two beverage containers 6 are placed, the beverage containers 6 contact the front support 51 and the neck holder 54. Since the beverage containers 6 closely contact the front support 51 and the neck holder 54 by the elasticity of the elastic members 542, the beverage containers 6 are stably placed during a swing of the agitating member 50.

At this point, the middle of the suction grill 23 is disposed between the beverage containers 6. Thus, cool air discharged through the suction grill 23 can be uniformly supplied to the beverage containers 6, and a contact area between the cool air and the beverage containers 6 can be maximized.

In this state, when one of the beverage containers 6 is taken out, the neck holder 54 is moved forward to return to its original position by the elasticity of the elastic members 543. Since the neck holder 54 returns to its original positions, the beverage container 6 returns to the state illustrated in FIG. 17.

Referring to FIG. 19, the beverage container 6 put in the case 20 has a bottle shape. In detail, the cover 60 is opened, and the beverage container 6 is inserted through the inlet 21 of the case 20.

At this point, the neck of the beverage container 6 is directed rearward, and is placed on the neck holder 54. While the beverage container 6 is placed on the agitating member 50, the seat 541 is disposed between the neck and the body of the beverage container 6 to stably support and fix the beverage container 6.

Figure 20:
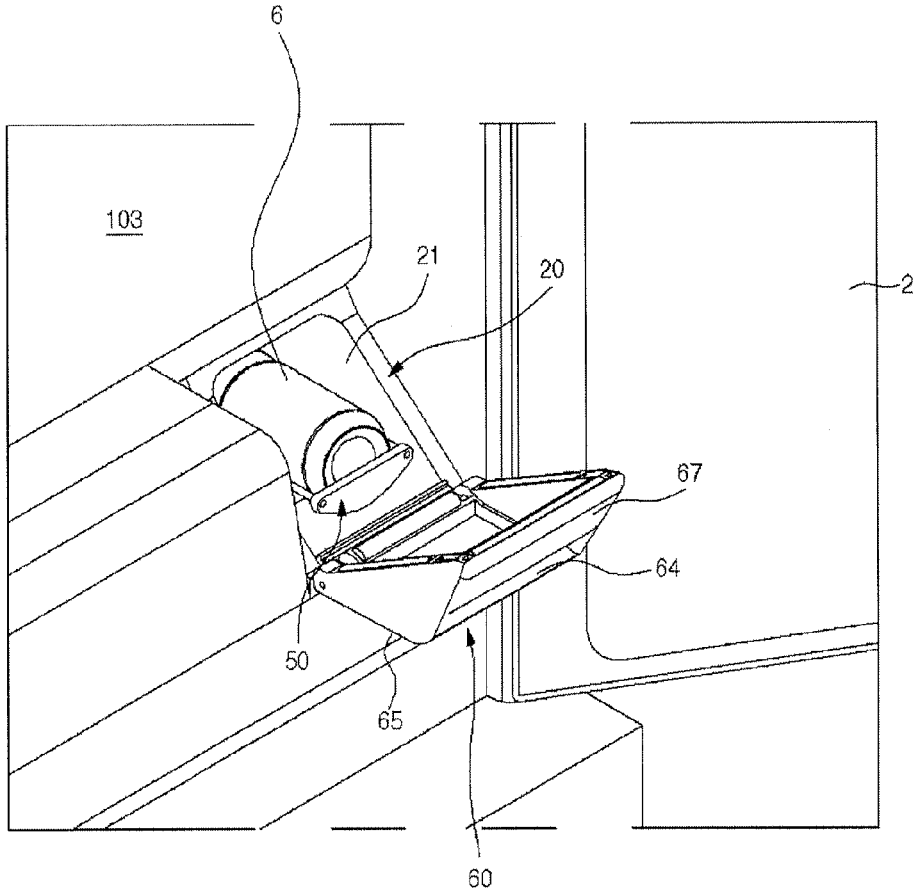
FIG. 20 is perspective view illustrating a state in which a cover of the chilling device is opened.
Figure 21:
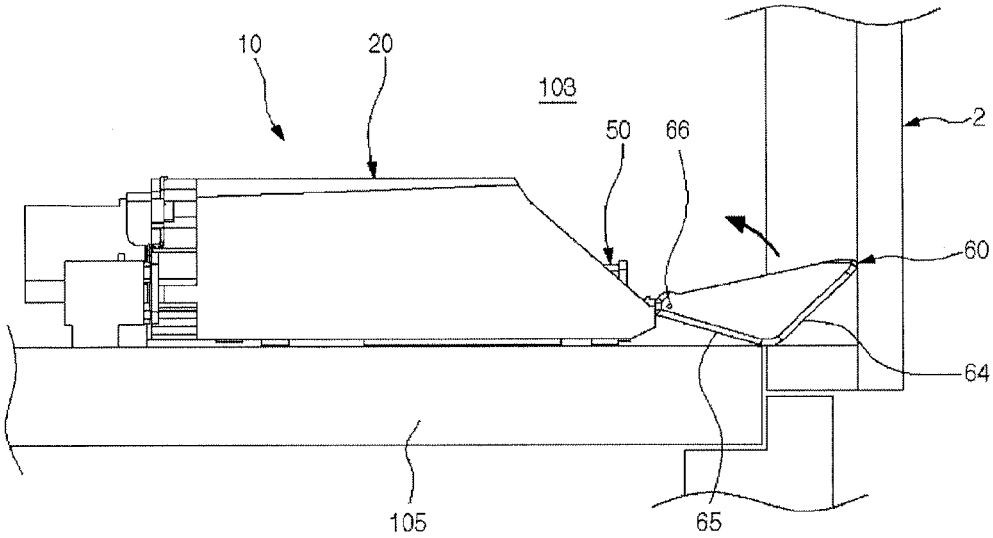
FIGS. 21 and 22 are side views illustrating a process in which the cover and a door of a refrigerator are closed.
Figure 22:
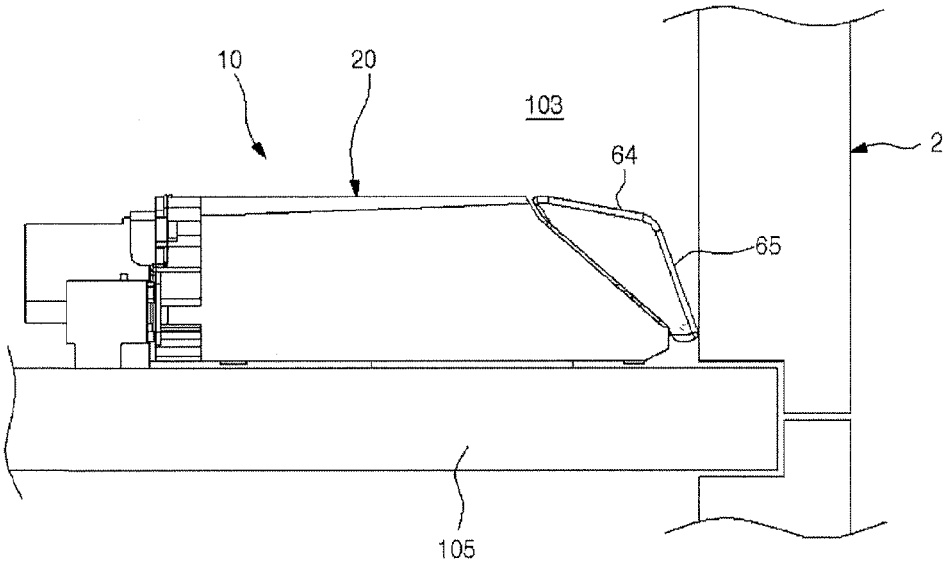

FIG. 20 illustrates a state in which an example cover of an example chilling device is opened. FIGS. 21 and 22 illustrate an example process in which the cover and a door of a refrigerator are closed.

Referring to FIGS. 20 to 22, the cover 60 is manipulated to open the inlet 21 of the case 20, so that the beverage container 6 can be accommodated in the case 20. When the cover 60 is manipulated to close the case 20, leakage of cool air from the case 20 is reduced (e.g., prevented).

The lower end of the inlet 21 of the case 20 further protrudes than the upper end thereof. A protrusion length of the inlet 21 increases from the upper side to the lower side, and thus, the inlet 21 is inclined downward. Thus, when the cover 60 is opened, the agitating member 50 and the beverage container 6 are exposed from the case 20 through the inlet 21, and thus, can be easily perceived and manipulated.

The cover 60 has a shape to open and close the inlet 21. Thus, when the cover 60 is closed, the rear edge of the cover 60 contacting the inlet 21 has an inclination corresponding to an inclination of the inlet 21, and the rear surface of the cover 60 is recessed inward to define a predetermined space with the case 20.

The cover 60 includes a first surface 64 constituting the top surface of the cover 60 and inclined forward and downward, and a second surface 65 constituting the front surface of the cover 60 and inclined forward and downward from the front end of the first surface 64.

In detail, the first surface 64 extends from the rear end of the top surface of the cover 60 to the rear end of the second surface 65. The level of the rear end of the first surface 64 is equal to or less than the level of the upper end of the case 20. The first surface 64 extends downward and forward.

The second surface 65 extends from the front end of the first surface 64 to the front lower end of the cover 60. The rear end of the second surface 65 is disposed behind a cover rotation shaft 66, and the front end thereof constitutes the front end of the chilling device 10. The second surface 65 extends in a direction crossing the first surface 64 to constitute the front surface of the cover 60.

A contact portion between the first surface 64 and the second surface 65 is disposed behind a rotation center of the cover 60. The contact portion between the first surface 64 and the second surface 65 may be rounded. Thus, when a door 2 of a refrigerator is closed, a contact point between the cover 60 and the rear surface of the door 2 can smoothly move from the first surface 64 to the second surface 65.

The first surface 64 is provided with a handle 67 for a user to hold. Thus, a user can hold the handle 67 to open and close the cover 60.

When the cover 60 and the door 2 are completely opened as illustrated in FIG. 21, the upper end of the first surface 64 becomes the front end of the chilling device 10. The upper end of the first surface 64 is disposed out of the refrigerator, and contacts the door 2 when the door 2 is closed. At this point, the upper end of the first surface 64 is disposed at the upper and front sides of the cover rotation shaft 66. In this state, the beverage container 6 can be taken out or put in the chilling device 10.

In this state, the door 2 can be closed without manipulating the cover 60. In this state, when the door 2 is closed, the rear surface of the door 2 contacts the upper end of the first surface 64. Then, when the door 3 is further closed to push the upper end of the first surface 64, the cover 60 rotates counterclockwise about the cover rotation shaft 66. Accordingly, the cover 60 is naturally closed.

While the cover 60 is closed, the rear surface of the door 2 sequentially contacts the upper end of the first surface 64 and the lower end of the second surface 65. When the door 2 is completely closed, the rear surface of the door 2 contacts the lower end of the second surface 65 as illustrated in FIG. 22. Accordingly, the cover 60 completely closes the inlet 21 of the case 20.

That is, since the cover 60 can be closed just by closing the door 2 without a separate process for closing the cover 60, breakage of the cover 60 due to carelessness may be reduced (e.g., prevented). In addition, the refrigerator may be conveniently used.

The rear surface of the door 2 may be formed by a door liner, a door dike, a separate accommodation member installed on the door 2, or an arbitrary structure disposed on the door 2.

When the cover 60 is closed, a gasket 61 installed on the cover 60 contacts the edge of the inlet 21 of the case 20 to reduce (e.g., prevent) leakage of cool air. In this state, when the chilling device 10 is driven, the suction fan 31 causes a negative pressure state in the case 20, and the cover 60 more closely contacts the case 20. In addition, leakage of cool air is reduced (e.g., prevented) while the chilling device 10 operates.

Hereinafter, operations of the refrigerator configured as described above are described with reference to the accompanying drawings.

Figure 23:
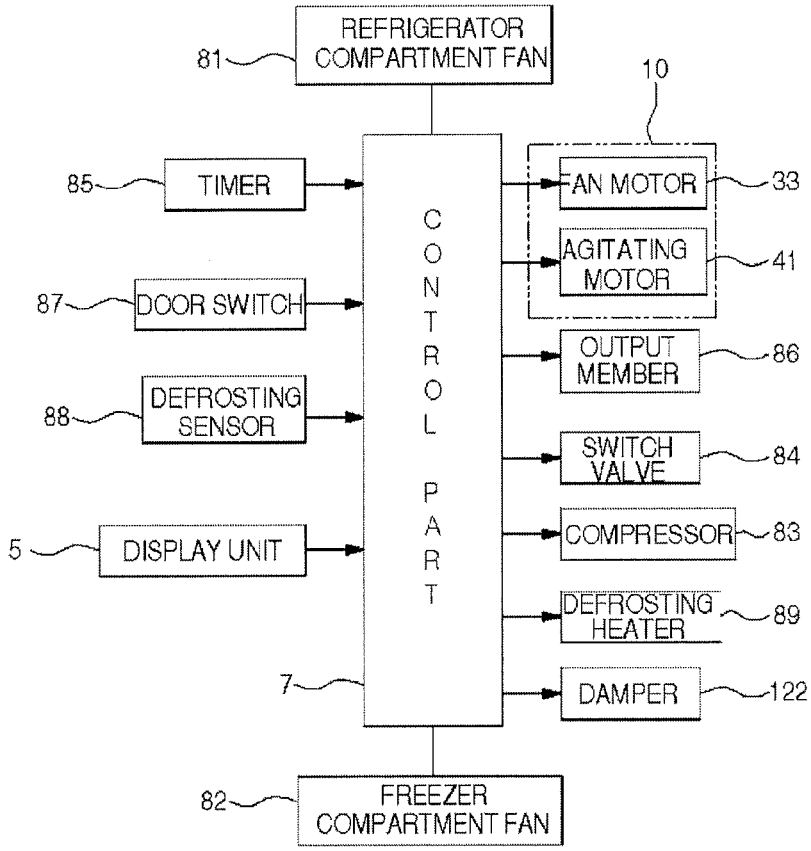
FIG. 23 is a block diagram illustrating a control process of the refrigerator.
Figure 24:
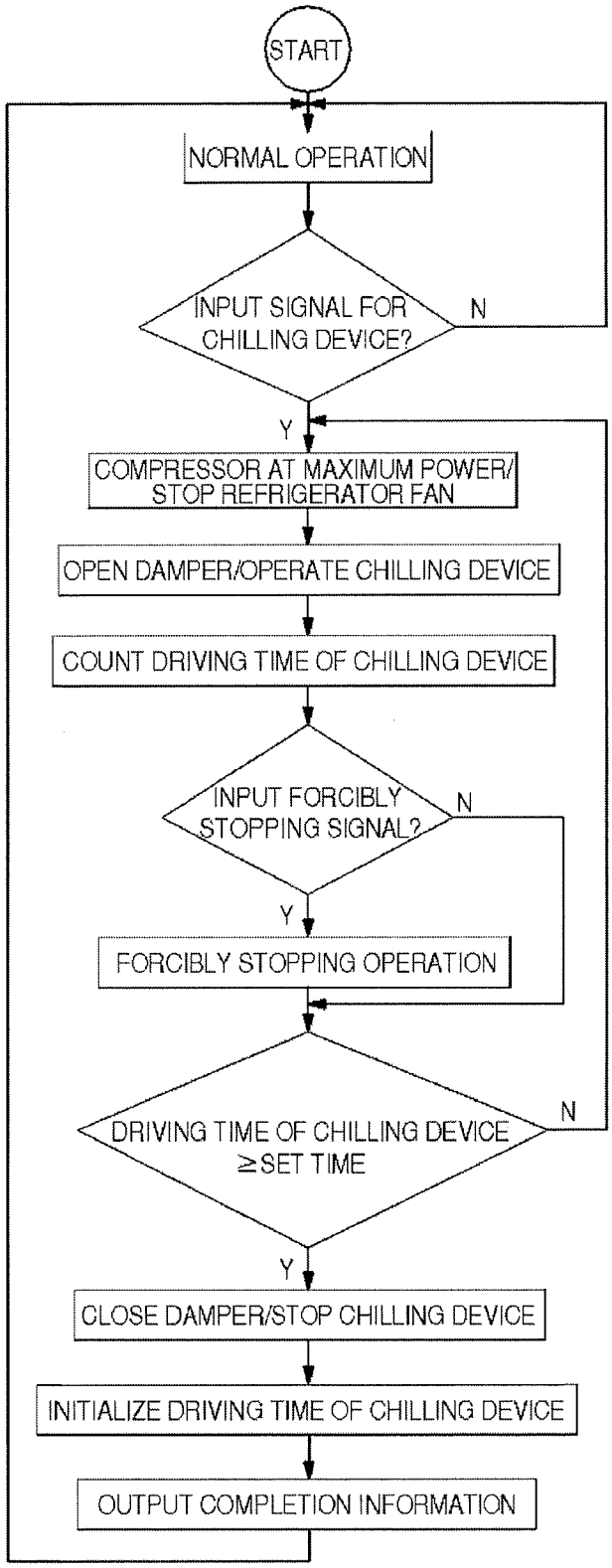
FIG. 24 is a flowchart illustrating a method of controlling the refrigerator.

FIG. 23 illustrates an example control process of the refrigerator. FIG. 24 illustrates an example method of controlling the refrigerator.

Referring to FIGS. 23 and 24, the refrigerator performs a refrigerating cycle to generate cool air in the evaporator 108. Then, a refrigerator compartment fan 81 and a freezer compartment fan 82 supply the cool air to the refrigerator compartment 103 and the freezer compartment 104, respectively, and the cool air chills the refrigerator compartment 103 and the freezer compartment 104 to maintain set temperatures.

In this state, to quickly chill the beverage container 6 and the beverage in the beverage container 6, the refrigerator compartment door 2 is opened, then, the cover 60 is opened, and then, the beverage container 6 is put in. At this point, the beverage container 6 is placed on the agitating member 50, and the positions of beverage containers may be varied according to the number thereof.

In this state, the cover 60 and the refrigerator compartment door 2 are sequentially closed. Alternatively, the cover 60 may move in conjunction with the refrigerator compartment door 2. Accordingly, when the refrigerator compartment door 2 is closed, the cover 60 is automatically closed. When the cover 60 is closed, the inner space of the chilling device 10 may be sealed to thereby block cool air from leaking out of the chilling device 10 during an operation of the chilling device 10. In this state, the chilling device 10 is ready to operate, and starts to operate according to manipulation of a user.

The display unit 5 is manipulated to drive the chilling device 10. The display unit 5 displays an operation state of the chilling device 10, and operation information for the chilling device 10 may be input to the display unit 5.

At this point, an operation time of the chilling device 10 may be set according to the types and number of beverage containers accommodated in the chilling device 10. That is, the chilling device 10 may operate in at least two operation modes that may be selected through the display unit 5. For example, the chilling device 10 may operate for four or eight minutes, and an operation time may be set through the display unit 5 according to the type of a beverage to be chilled, to chill the beverage container 6.

When a sensor or a device for measuring the temperature of the beverage container is disposed in the chilling device 10, the chilling device 10 may be set to be driven until the beverage container 6 reaches a target temperature.

When an operation of the chilling device 10 is set through the display unit 5, and an operation signal is input, a control part 7 controls the chilling device 10 to operate to quickly chill the beverage container 6 disposed in the chilling device 10.

While the chilling device 10 starts to operate, a compressor 83 used to perform the refrigerating cycle rotates at maximum power, and the refrigerator compartment fan 81 for supplying cool air to the refrigerator compartment 103 is stopped. Accordingly, the chilling device 10 more effectively performs a chilling operation. The freezer compartment fan 82 for supplying cool air to the freezer compartment 104 may be stopped or rotate at low speed. In this state, all cool air generated from the evaporator 108 can be supplied to the chilling device 10 to maximize chilling performance of the chilling device 10.

When the evaporator 108 is provided in plurality, one of the evaporators 108 may chill the freezer compartment 104, and the other may chill the refrigerator compartment 103. In this case, when the chilling device 10 is driven, a valve 84 branched to the evaporators 108 may be switched to block supply of the refrigerant to the evaporator 108 for chilling the refrigerator compartment 103, and to increase supply of the refrigerant to the evaporator 108 for chilling the freezer compartment 104, so that the chilling device 10 can effectively perform a chilling operation.

When an operation signal of the chilling device 10 is input, the damper 122 is opened. Then, the fan motor 33 and the driving motor 41 are driven at the same time. The fan motor 33 is driven to rotate the suction fan 31 connected to the fan motor 33, and thus, cool air from the evaporator 108 is guided along the suction duct 11 to the suction grill 23, and is introduced into the case 20.

In detail, the discharge end of the suction duct 11 is connected to the bottom of the case 20. The suction grill 23 is disposed on the bottom of the case 20 connected to the discharge end of the suction duct 11, and the speed of air sucked through the suction duct 11 increases while passing through the suction grill 23. As described above, this is because the air holes 231 are disposed in the suction grill 23.

The cool air passing through the suction grill 23 at high speed is discharged in a direction perpendicular to the outer surface of the beverage container 6. Since the beverage container 6 has a cylindrical shape, when the cool air passing through the suction grill 23 perpendicularly collides with the outer surface of the beverage container 6, heat exchange efficiency is increased (e.g., maximized). When a flow direction of cool air passing through the suction grill 23 is not perpendicular to the outer surface of the beverage container 6, a portion of the cool air may be discharged out of the case 20, without colliding with the beverage container 6. That is, cool air sucked through the suction grill 23 may perpendicularly collide with the outer surface of the beverage container 6 to reduce (e.g., minimize) the amount of cool air discharged without heat exchange.

The cool air sucked through the suction grill 23 is guided along the outer surface of the beverage container 6 by the air guide 55 to increase (e.g., maximize) the amount of cool air contacting the beverage container 6, thereby more quickly chilling the beverage container 6.

The suction fan 31 axially sucks the cool air to radially discharge the cool air, and the fan housing 32 guides the cool air to the freezer compartment 104 through the return duct 12. At this point, the damper 122 is opened to allow the cool air to return to the freezer compartment 104 through the return duct 12.

While the suction fan 31 rotates, the agitating member 50 swings. To this end, the driving motor 41 is driven. The driving motor 41 may be continuously rotated, or be rotated forward and reverse by a constant angle. The agitating member 50 repeatedly swings according to an operation of the transmission unit 42 connected to the rotation shaft 412 of the driving motor 41.

When the suction fan 31 sucks the cool air, the agitating member 50 swings to agitate the beverage in the beverage container 6, thereby quickly chilling the beverage. Due to the air guides 55, the cool air discharged from the suction grill 23 effectively chills the outer surface of the beverage container 6, thereby more quickly and effectively chilling the beverage in the beverage container 6.

A timer 85 may count an operation time of the chilling device 10. The chilling device 10 operates for a set time T1, and then, stops. When a stop signal for the chilling device 10 is transmitted, the damper 122 is closed to seal the return duct 12, and the fan motor 33 and the driving motor 41 are stopped. Thus, circulation of cool air among the evaporating compartment 107, the chilling device 10, and the freezer compartment 104 is stopped.

When the fan motor 33 and the driving motor 41 are stopped, and the chilling of the chilling device 10 is completed, the timer 85 is initialized to drive the chilling device 10 again. When the chilling device 10 is driven again, the timer 85 restarts and monitors an operation time of the chilling device 10.

When the driving of the chilling device 10 is completed, information that the driving is completed is displayed through the display unit 5. A separate output member 86, such as a speaker, may use a signal such as a voice to inform a user that the driving of the chilling device 10 is completed.

After the driving of the chilling device 10 is completed, the refrigerator compartment fan 81 and the freezer compartment fan chill the refrigerator compartment 103 and the freezer compartment 104 at set temperatures in a normal operation, and the valve 84 is closed or opened to maintain the freezer compartment 104 and the refrigerator compartment 103 at the set temperatures.

Although the chilling device 10 operates as described above in the normal operation, an operation of the chilling device 10 may be forcibly stopped under conditions, such as a defrosting operation, an overload state, an initial operation after installing of the refrigerator or a power cut, and a case in which the refrigerator compartment door 2 is opened.

To determine whether to forcibly stop the chilling device 10, the control part 7 may be connected to a door switch 87 for sensing opening and closing of the refrigerator compartment door 2, a defrosting sensor 88 for sensing a defrosting operation, a defrosting heater 89, and the timer 85 or a counter for sensing an overload of the chilling device 10.

Hereinafter, a process of forcibly stopping the chilling device 10 is described in more detail with reference to the accompanying drawings.

Figure 25:
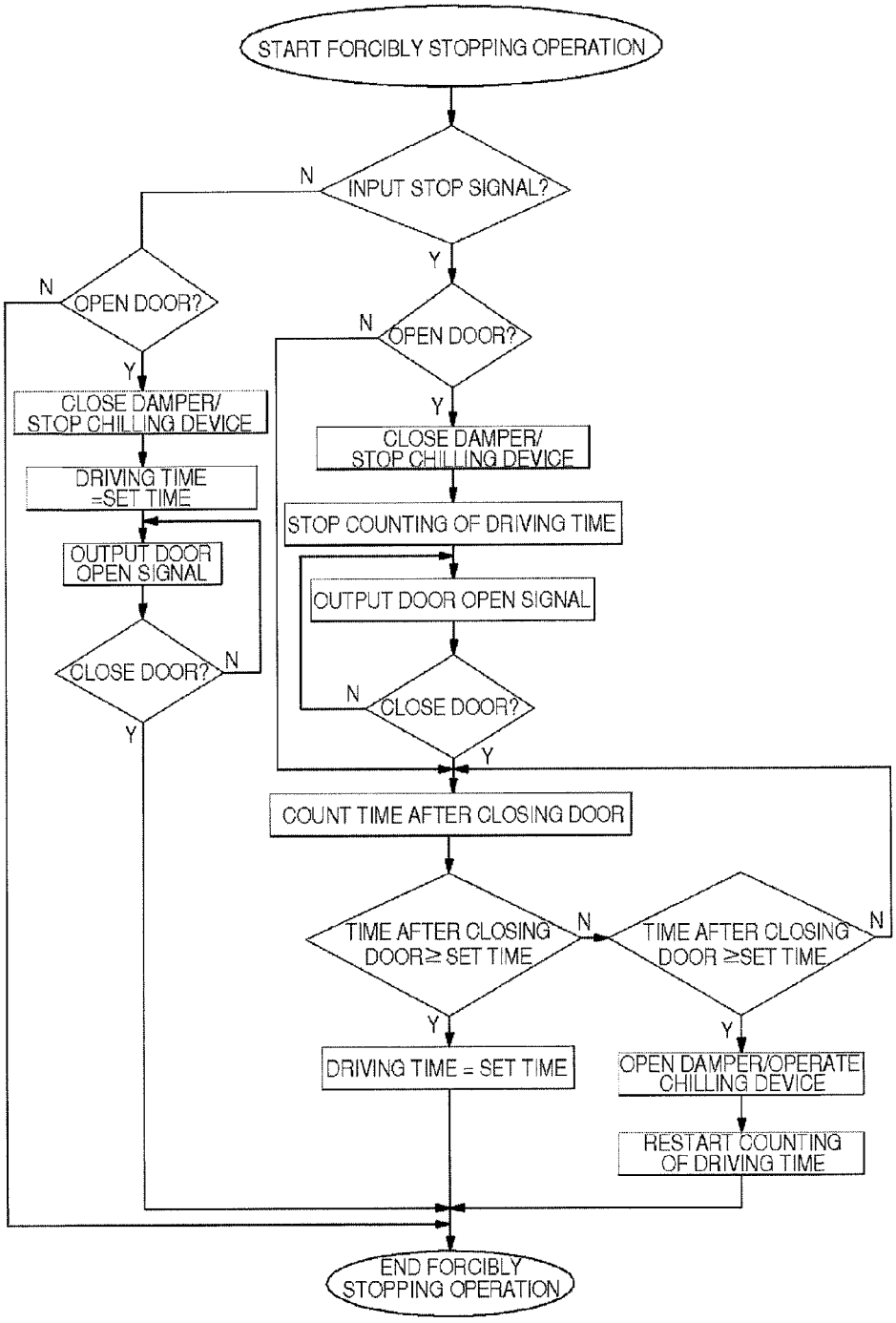
FIG. 25 is a flowchart illustrating a process of forcibly stopping the chilling device when a refrigerator compartment door is opened.

FIG. 25 illustrates an example process of forcibly stopping the chilling device when the refrigerator compartment door is opened.

Referring to FIG. 25, to stop the chilling device 10, a stop signal may be input to the display unit 5, or the refrigerator compartment door 2 is opened.

In detail, the display unit 5 is manipulated to stop the chilling device 10. After that, just when the refrigerator compartment door 2 is opened, the door switch 87 senses the opening of the refrigerator compartment door 2, the damper 122 is closed, and the chilling device 10 is stopped. When the chilling device 10 stops, the timer 85 stops counting of an operation time of the chilling device 10. Information that the refrigerator compartment door 2 is opened is output through the display unit 5 or the output member 86.

In this state, the chilling device 10 is stopped, and the beverage container 6 may be taken out of the chilling device 10, or a food may be put in the refrigerator.

When the refrigerator compartment door 2 is closed, the door switch 87 senses the closing of the refrigerator compartment door to transmit a signal to the control part 7. When the refrigerator compartment door 2 is closed, the timer 85 counts a time after the refrigerator compartment door 2 is closed. When the time is equal to or greater than a set time T2, it is determined that an operation time of the chilling device 10 is equal to a set time T1, and the chilling device 10 is stopped. When the time after the refrigerator compartment door 2 is closed is less than the set time T2, the display unit 5 is manipulated to restart the chilling device 10, and the damper 122 is opened, and the chilling device 10 restarts. At this point, the timer 85 counts an operation time of the chilling device 10 again, and the chilling device 10 is driven for the rest of the time.

When the refrigerator compartment door 2 is opened without manipulating the display unit 5, the damper 122 is closed, and the chilling device 10 is immediately stopped. At this point, it is considered that an operation time of the chilling device 10 counted by the timer 85 reaches the set time T1, and the chilling device 10 is stopped.

That is, when the refrigerator compartment door 2 is opened and then closed without performing a manipulation process for stopping the chilling device 10, the chilling device 10 immediately stops and then returns to the normal operation. When a manipulation process for stopping the chilling device 10 is performed, then, the refrigerator compartment door 2 is opened and closed, and then, a manipulation process for starting the chilling device 10 is performed, the chilling device 10 is driven for the rest of the set time T1.

Figure 26:
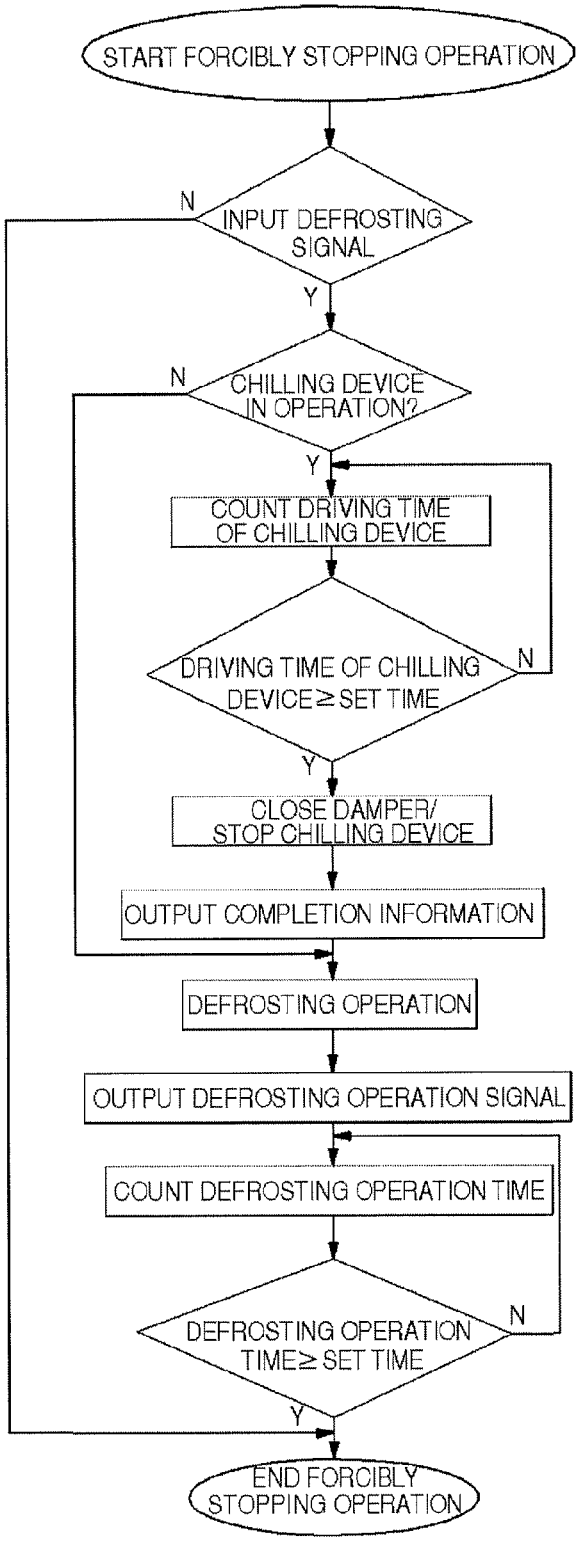
FIG. 26 is a flowchart illustrating a process of forcibly stopping the chilling device when the refrigerator is in a defrosting operation.

FIG. 26 illustrates an example process of forcibly stopping the chilling device when the refrigerator is in a defrosting operation.

Referring to FIG. 26, while the chilling device 10 is driven, if the defrosting heater 89 operates, or if a defrosting signal is input according to sensing of the defrosting sensor 88, the defrosting operation is performed after the chilling device 10 is driven.

In detail, if the defrosting signal is input while the chilling device 10 is driven, the defrosting operation is postponed, and the chilling device 10 is still driven with the timer 85 continually counting an operation time of the chilling device 10. Then, when the operation time of the chilling device 10 is equal to the set time T1, the damper 122 is closed, and the chilling device 10 is stopped. Then, information that the chilling device 10 is stopped is output through the display unit 5.

As such, when the chilling device 10 is stopped, the defrosting operation is performed. The timer 85 counts a defrosting operation time during the defrosting operation. The counted defrosting operation time or a set time T3 after the defrosting operation is equal to, for example, 30 minutes, the stopping of the chilling device 10 is ended.

That is, if a defrosting signal is input during an operation of the chilling device 10, a defrosting operation is delayed until the operation of the chilling device 10 is completed. After the defrosting operation time or the set time T3, the chilling device 10 operates again.

Figure 27:
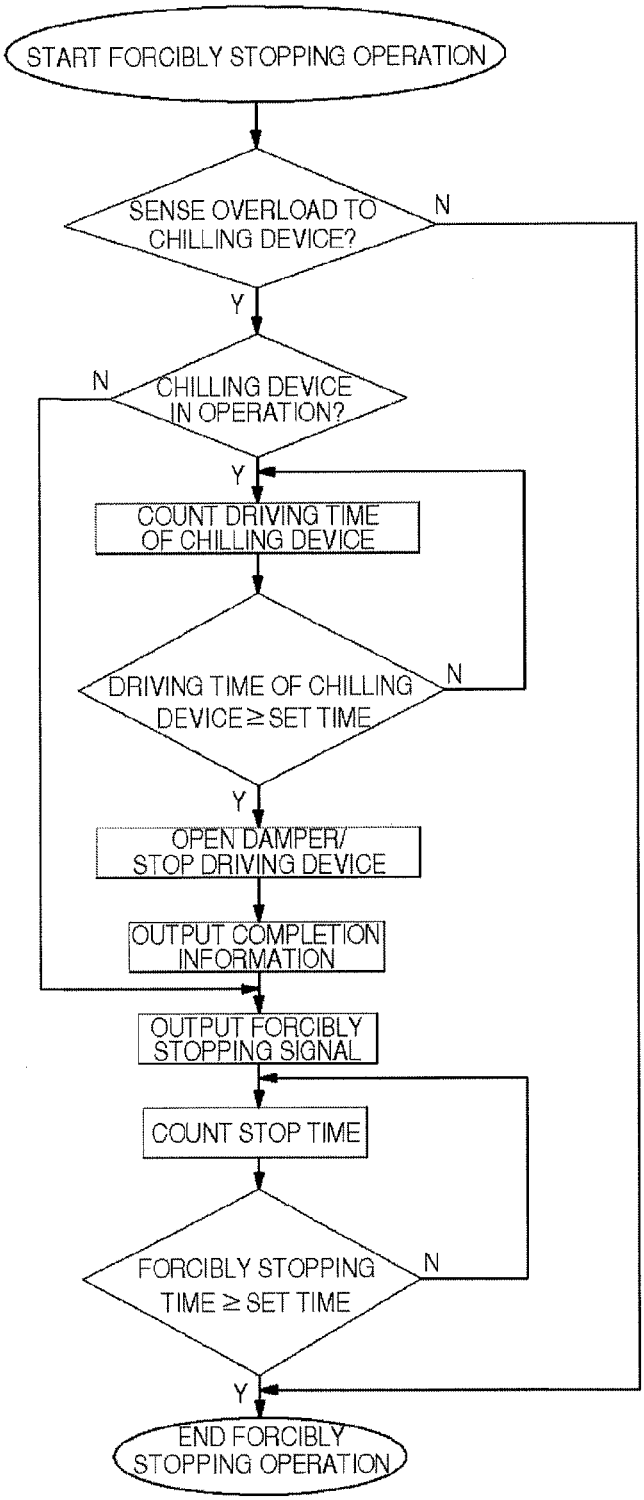
FIG. 27 is a flowchart illustrating a process of forcibly stopping the chilling device in an overload state.

FIG. 27 illustrates an example process of forcibly stopping the chilling device in an overload state.

Referring to FIG. 27, when the chilling device 10 is continuously operated, a fan motor of the chilling device 10 may be overloaded. Whether the chilling device 10 is overloaded may be determined based on an operation time, the number of operations of the chilling device 10 in a predetermined time period, or a temperature of the refrigerator (e.g., a temperature of a refrigerating compartment, a temperature of a freezing compartment, etc.). For example, if an operation time of the chilling device 10 is equal to or greater than twenty-five minutes in a time period of thirty minutes, or if the number of operations of the chilling device 10 is equal to or greater than five in a time period of thirty minutes, the control part 7 may consider the chilling device 10 to be overloaded.

If overloading of the chilling device 10 is sensed while the chilling device 10 is driven, the driving of the chilling device is maintained until a driving time counted by the timer 85 reaches a set time T1. After the driving time counted by the timer 85 reaches the set time T1, the damper 122 is closed, and the chilling device 10 is stopped. Information that the chilling device 10 is stopped is output through the output member 86.

If the overloading of the chilling device 10 is sensed, the chilling device 10 is forcibly stopped for a set time T4, for example, for thirty minutes. After the set time T4, the chilling device 10 operates again.

Figure 28:
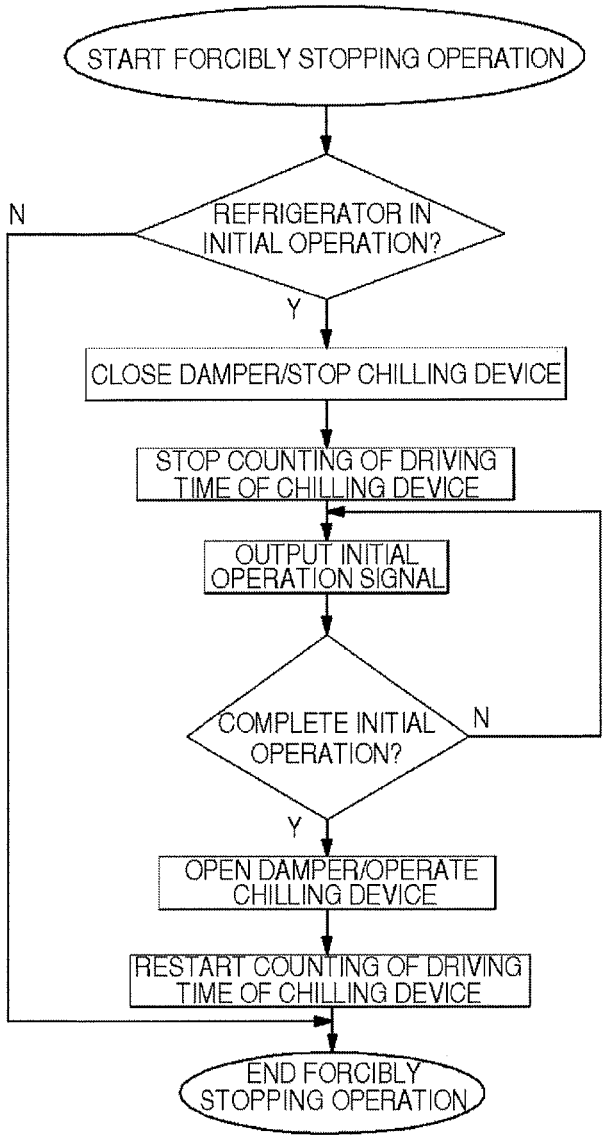
FIG. 28 is a flowchart illustrating a process of forcibly stopping the chilling device when the refrigerator is in an initial operation.

FIG. 28 illustrates an example process of forcibly stopping the chilling device when the refrigerator is in an initial operation.

Referring to FIG. 28, the chilling device 10 is not operated until the initial operation of the refrigerator is ended.

In detail, when the refrigerator is installed or connected to a power source, the damper 122 is closed, and the chilling device 10 is stopped. During the initial operation, information of the initial operation is output through the output member 86.

When the initial operation is ended, for example, after refrigerant circulates through a refrigerating cycle, the damper 122 is opened, and driving of the chilling device 10 is started. When driving of the chilling device 10 is temporarily stopped by the initial operation, the driving of the chilling device 10 can be restarted after the initial operation.

When the process of forcibly stopping the chilling device 10 is ended, the refrigerator returns to its normal operation, and driving of the chilling device 10 may be restarted according to user's operation.

A refrigerator including a chilling device according to various other examples may be used.

Hereinafter, a chilling device according to another example is described in detail with reference to the accompanying drawings.

Figure 29:
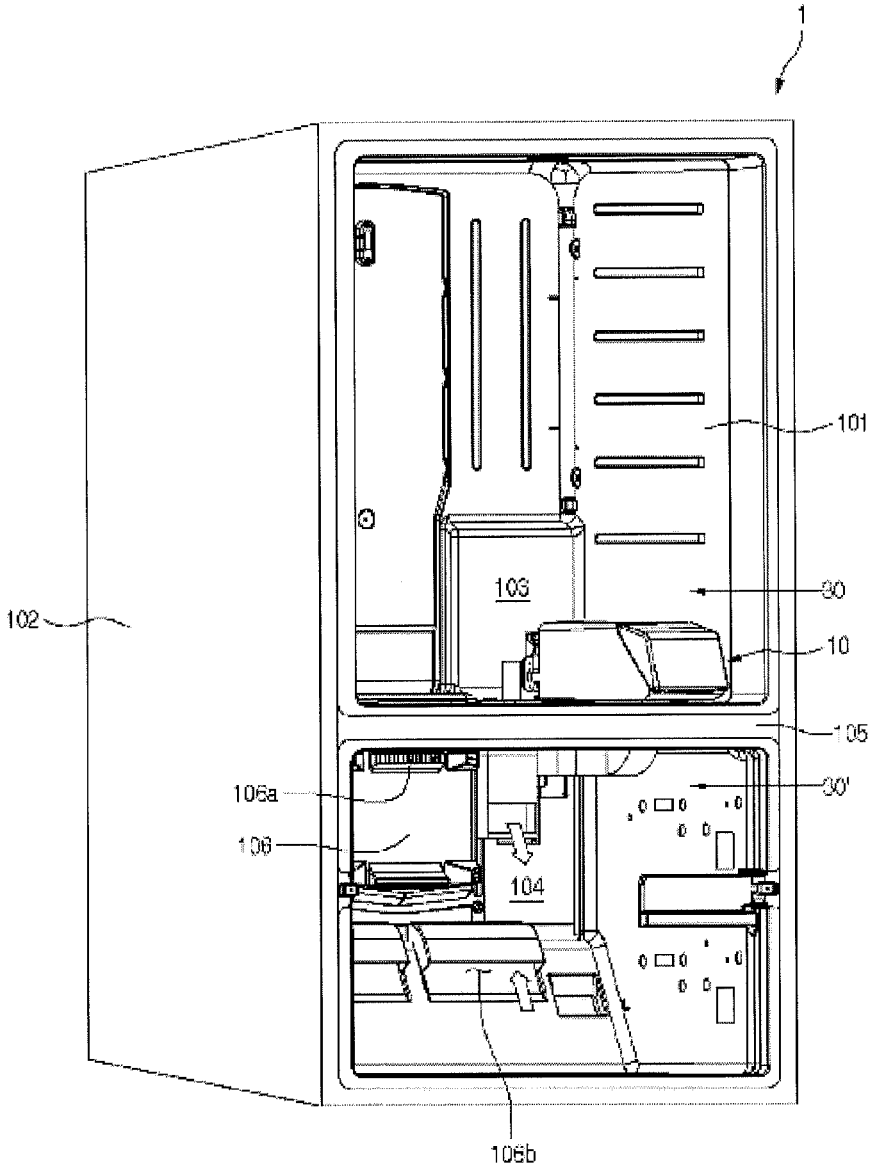
FIG. 29 is a perspective view illustrating an inner structure of a refrigerator including a chilling device.
Figure 30:
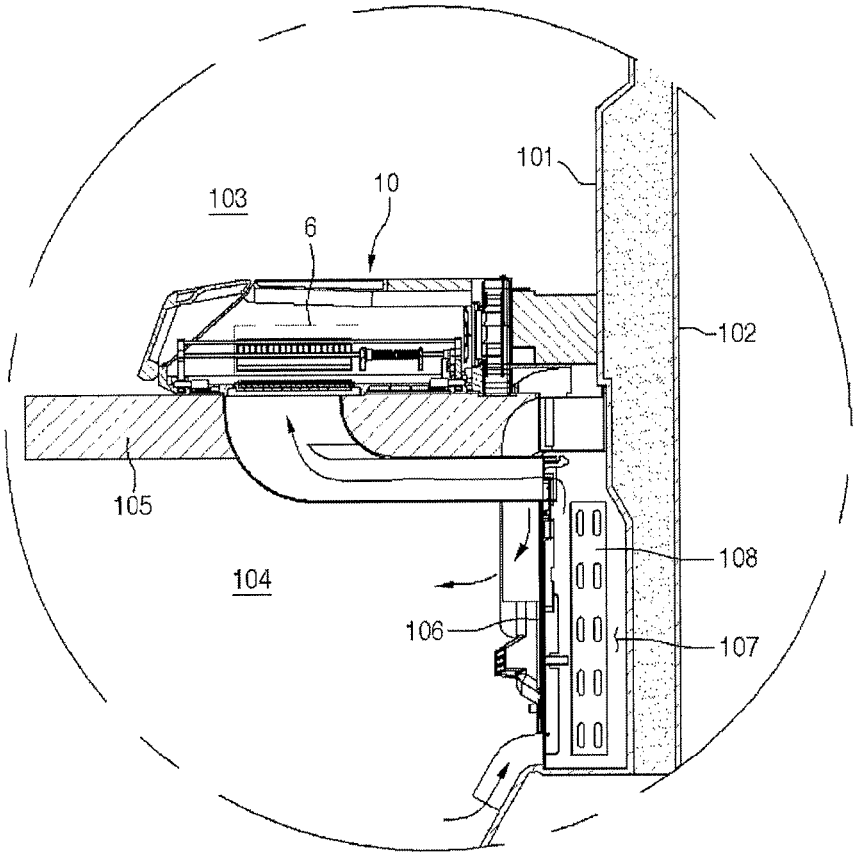
FIG. 30 is a cross-sectional view taken along line 30-30' of FIG. 29.

FIG. 29 illustrates an example inner structure of an example refrigerator including an example chilling device. FIG. 30 is a cross-sectional view taken along line 30-30' of FIG. 29.

A cabinet 1 of the refrigerator includes an outer case 102 constituting an external appearance of the refrigerator, an inner case 101 installed on the inner portion of the outer case 102 and defining an inner storing space, and an insulating member filling a space between the inner case 101 and the outer case 102.

The inner storing space is divided into upper and lower parts by a partition 105, and may include a refrigerator compartment 103 for refrigerating a food, and a freezer compartment 104 for freezing a food.

In detail, an evaporating compartment 107 is positioned at the rear surface of the freezer compartment 104 by an evaporating compartment wall 106, and the evaporating compartment 107 accommodates an evaporator 108. The evaporating compartment wall 106 may be provided with a cool air discharging opening **106*a* for discharging cool air into the freezer compartment 104, and a rear bottom of the freezer compartment 104 is provided with a cool air suction opening 106*b* for returning cool air from the freezer compartment 104 to the evaporating compartment 107**.

A refrigerator compartment duct vertically extends on the rear surface of the refrigerator compartment 103, and the lower end of the refrigerator compartment duct communicates with the evaporating compartment 107. The front surface of the refrigerator compartment duct may be provided with a cool air discharge opening to supply cool air generated from the evaporating compartment 107 to the refrigerator compartment 103. A cool air suction opening is disposed at a side on the top surface of the partition 105 to return cool air from the refrigerator compartment 103 to the evaporating compartment 107.

A chilling device 10 may be disposed at a side on the top surface of the partition 105. The chilling device 10 may include a passage connecting to the evaporating compartment 107 and/or the freezer compartment 104 to fluidly communicate with the evaporating compartment 107 and/or the freezer compartment 104. For example, cool air from the evaporating compartment 107 may be supplied to the chilling device 10, and the cool air supplied to the chilling device 10 may chill a beverage container 6 in the chilling device 10. Cool air heated by heat exchange with the beverage container 6 in the chilling device 10 may return to the evaporating compartment 107.

Figure 31:
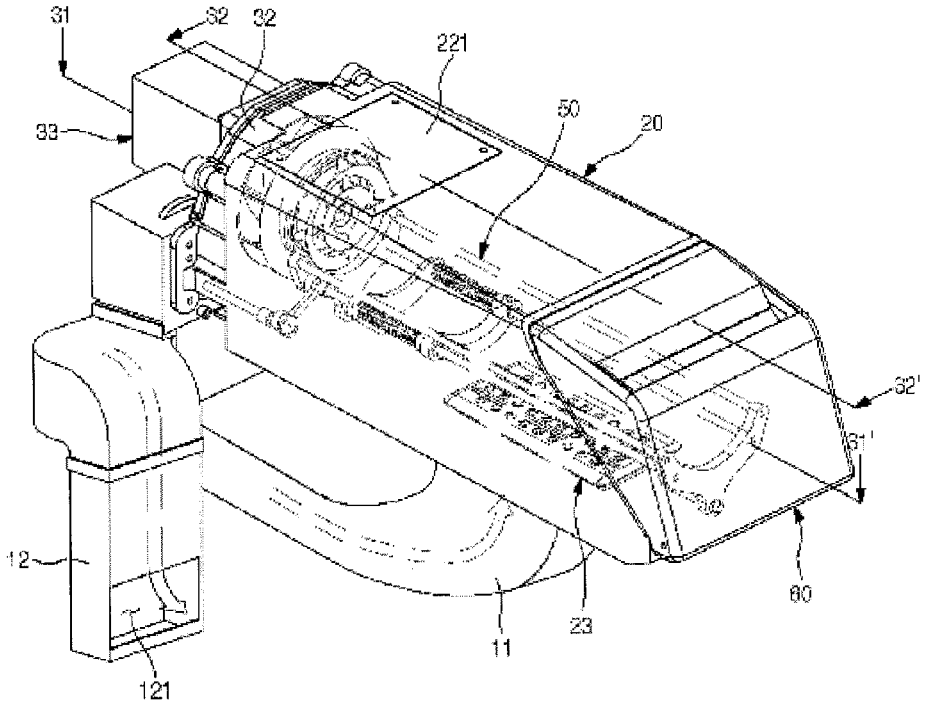
FIG. 31 is a perspective view illustrating the chilling device.
Figure 32:
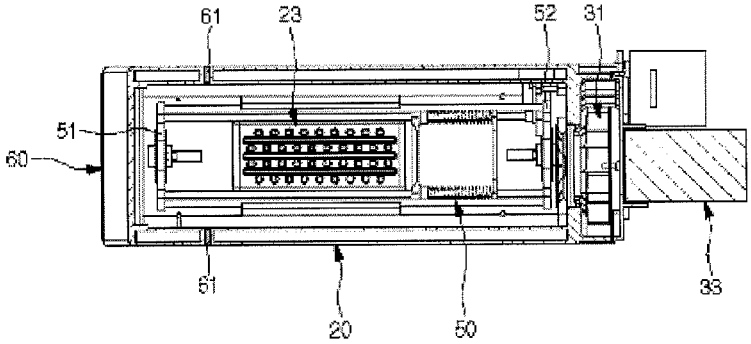
FIG. 32 is a cross-sectional view taken line 32-32' of FIG. 31.
Figure 33:
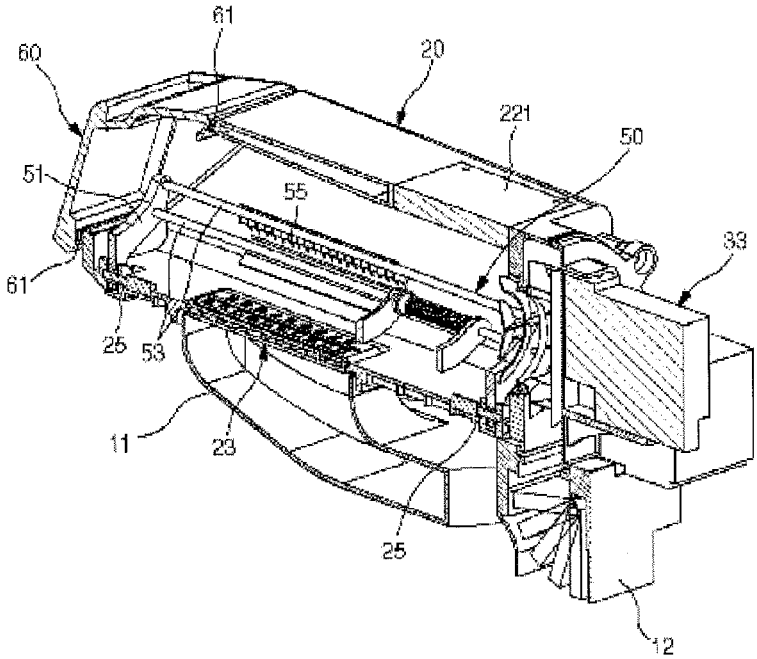
FIG. 33 is a cut-away perspective view taken along line 33-33' of FIG. 31.
Figure 34:
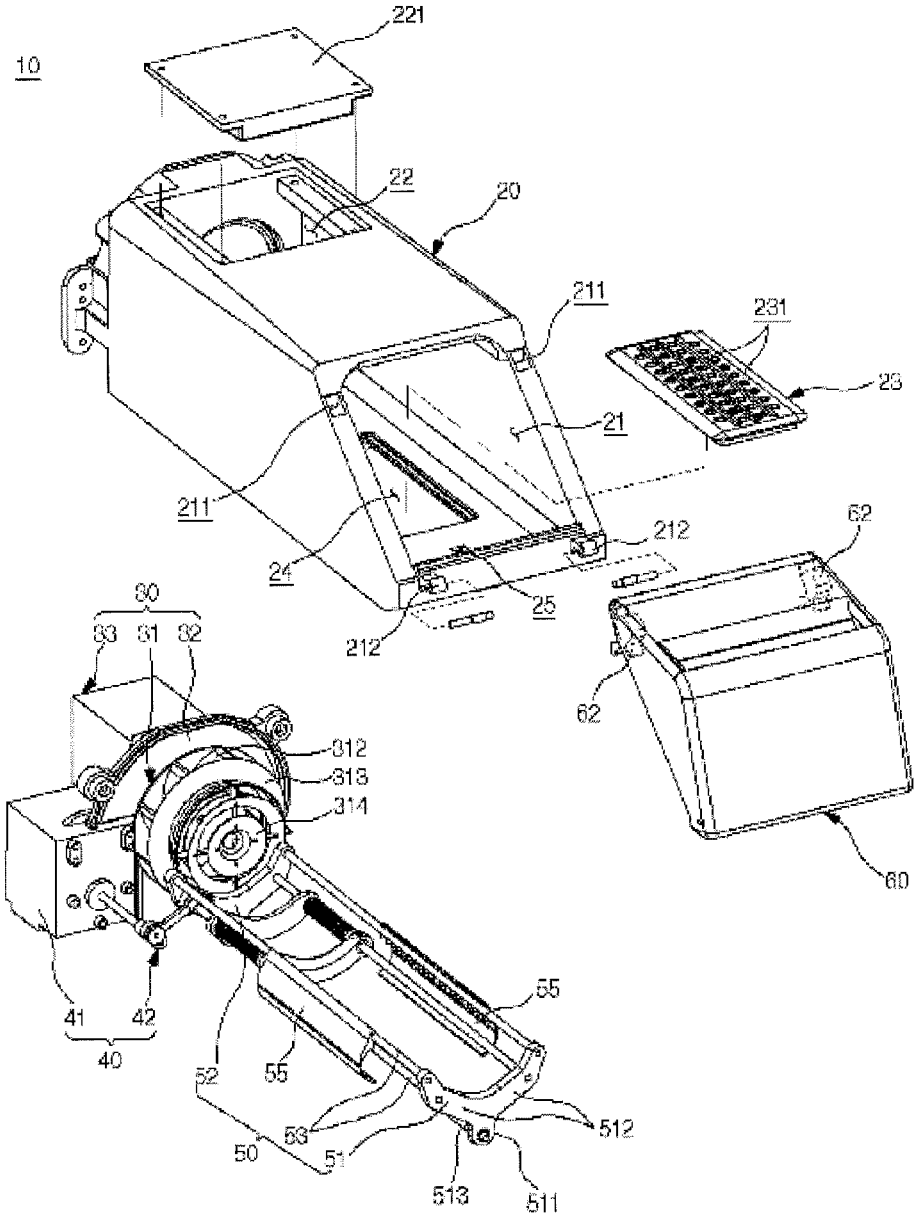
FIG. 34 is an exploded perspective view illustrating the front part of the chilling device.

FIG. 31 illustrates an example chilling device. FIG. 32 is a cross-sectional view taken line 32-32' of FIG. 31. FIG. 33 is a cut-away perspective view taken along line 33-33' of FIG. 31. FIG. 34 illustrates the front part of the example chilling device.

Referring to FIGS. 31 to 34, the chilling device 10 may include a chilling compartment and a cool air passage connected to the chilling compartment.

In detail, the chilling compartment may include a case 20 defining a storing space for the beverage container 6, a cover 60 opening and closing an inlet of the case 20, and an agitating member 50 selectively accommodated in the case 20. The beverage container 6 is placed on the agitating member 50. A fan motor assembly 30 is installed on the case 20 to forcibly move cool air, and a driving assembly 40 is coupled to the case 20 to drive the agitating member 50.

In more detail, the case 20 has front and rear openings, and has a space accommodating the agitating member 50 and the beverage container 6. The rear opening of the case 20 may be provided with the driving assembly 40, and the driving assembly 40 may close the rear opening of the case 20.

The front surface of the case 20 is provided with an inlet 21 for receiving the beverage container 6. The inlet 21 increases in length downward, and thus, is inclined downward, thereby facilitating access to the beverage container 6. The inlet 21 is opened and closed by the cover 60 having a corresponding shape to the inlet 21. A gasket 61 may be disposed at the edge of the cover 60 or the front end of the case 20. When the cover 60 is closed, the gasket 61 reduces (e.g., prevents) leakage of cool air from the case 20.

Cover fixing parts 211 are disposed at the front end of the case 20 provided with the inlet 21. Fixing members 62 provided to the cover 60 are inserted in and fixed to the cover fixing parts 211 to maintain closing of the cover 60. The cover fixing parts 211 and the fixing members 62 are disposed at the left and right sides of the chilling device 10 to stably maintain closing of the cover 60.

The lower end of the inlet 21 is provided with cover coupling parts 212. The cover coupling part 212 is coupled to the lower end of the cover 60 through a shaft. Thus, the cover 60 may rotate about the cover coupling part 212 as an axis, to open and close the inlet 21.

An opening 22 is disposed in the top surface of the case 20 to check the inside of the case 20 and assemble and repair inner parts. The opening 22 may be covered by an opening cover 221. The position of the opening 22 may be varied on the case 20.

A suction grill 23 may be removably attached to the bottom surface of the case 20, and may be disposed at the outlet of the suction duct 11. The suction grill 23 is installed on a cool air introduction opening 24 in the bottom surface of the case 20.

The cool air introduction opening 24 is disposed at a set position of the case 20. In this case, the set position of the cool air introduction opening 24 may be a position corresponding to the position of one beverage container 6 placed on the agitating member 50. Accordingly, cool air passing through the suction grill 23 is entirely directed to the outer surface of the beverage container 6 to chill the beverage container 6.

The bottom surface of the suction grill 23 may be provided with a plurality of air holes 231. In detail, since the air holes 231 have a small diameter, a flow rate of cool air quickly increases, passing through the outlet of the suction duct 11, that is, the suction grill 23. Thus, since cool air passing through the air holes 231 forms a jet stream, the air holes 231 may be called jet holes. The air holes 231 are spaced a constant distance from one another, and uniformly distributed in a surface of the suction grill 23.

The upper end of the suction grill 23 is bent outward and extends to rest on the bottom of the case 20, so that the suction grill 23 can be removably installed on the bottom of the case 20. In this case, a locking structure may be provided to stop a removal of the suction grill 23 from the bottom of the case 20 due to sucked air.

Cool air is vertically discharged from the air holes 231 of the suction grill 23 to a large area of the beverage container 6 placed on the agitating member 50, that is, to a side surface thereof. When cool air discharged from the air holes 231 perpendicularly contacts the beverage container 6, chilling efficiency for the beverage container 6 is maximized.

The agitating member 50 is disposed in the case 20, and is installed on an agitating member support 25 disposed in the bottom of the case 20. The agitating member 50 can swing left and right about the agitating member support 25 as an axis in the case 20, and is connected to the driving assembly 40 to repeatedly and continuously swing a predetermined angle, thereby agitating a beverage in the beverage container 6. A detailed configuration of the agitating member 50 is described later.

The chilling compartment may include the driving assembly 40 to provide driving force to the agitating member 50 that repeatedly rotates left and right in the case 20.

The fan motor assembly 30 may include a suction fan 31 for forcibly moving air, a fan housing 32 accommodating the suction fan 31 and installed on the rear surface of the case 20, and a fan motor 33 disposed behind the fan housing 32 and providing torque to the suction fan 31.

In detail, cool air generated from the evaporating compartment 107 is sucked with great suction force by the suction fan 31. Air introduced along the cool air passage into the case is moved at high speed to the rear side of the case 20 by great suction force of the suction fan 31. At this point, the air contacts the outer surface of the beverage container 6 disposed in the case 20, to exchange heat.

In detail, the suction fan 31 includes a back plate 311 having a circular plate shape, blades 312 disposed on the front surface of the back plate 311, and a suction guide 313 disposed on the front end of the blades 312. The blades 312 have a predetermined width and protrude forward from the front surface of the back plate 311, and are rounded with a predetermined curvature in a radial direction from the center of the back plate 311. The suction guide 313 functions as a combination of a typical bell mouth and a typical orifice. That is, the suction guide 313 smoothly guides an air flow from the front side of the fan housing 32 into the suction fan 31, and reduces (e.g., prevents) a backflow of air discharged in the radial direction along the surfaces of the blades 312. A grill 314 may be disposed at the front side of the suction guide 313 to block introduction of a foreign substance.

The cool air passage may include the suction duct 11 for supplying cool air from the evaporating compartment 107 to the case 20, and a return duct 12 for discharging cool air from the case 20 to the freezer compartment 104. In detail, the inlet (or suction opening) of the suction duct 11 may communicate with the evaporating compartment 107, and the outlet (or discharge opening) thereof may communicate with the bottom of the case 20. The inlet of the return duct 12 may be connected to the bottom of the fan housing 32, the outlet (or discharge opening) thereof may be connected to the freezer compartment 104. Referring to FIG. 31, a discharge opening 121 of the return duct 12 may be disposed on the rear surface of the freezer compartment 104.

The driving assembly 40 may include a driving motor 41 generating torque, and a transmission unit 42 connecting the driving motor 41 to the agitating member 50 to rotate the agitating member 50, which will be described later.

Figure 35:
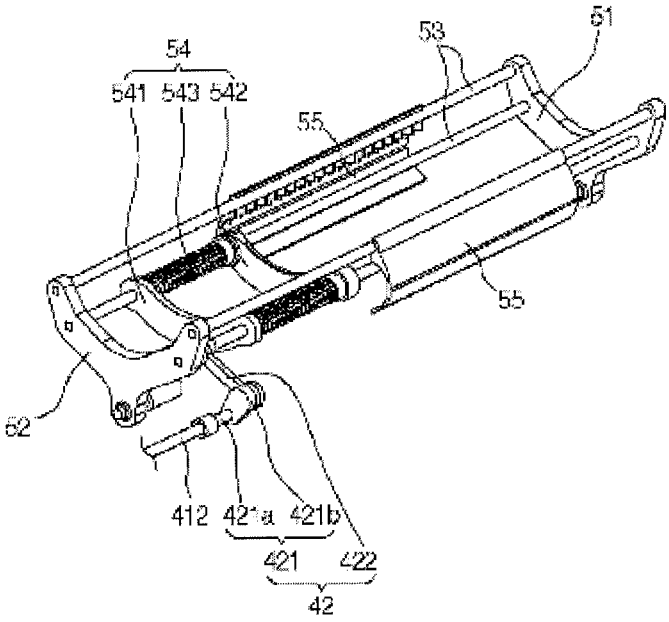
FIG. 35 is a perspective view illustrating an agitating member.
Figure 36:
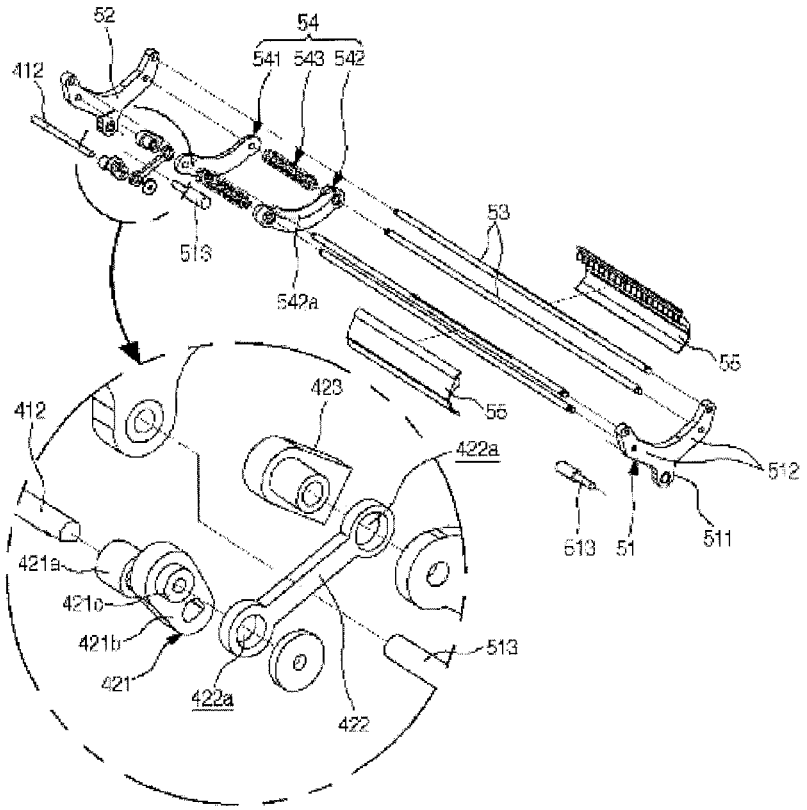
FIG. 36 is an exploded perspective view illustrating the agitating member.
Figure 37:
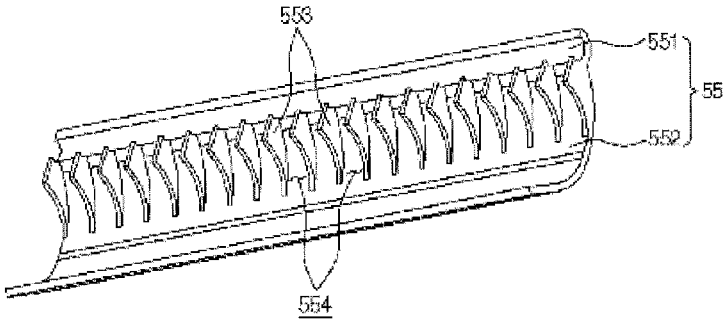
FIG. 37 is a perspective view illustrating an air guide.

FIG. 35 illustrates an example agitating member. FIG. 36 is an exploded perspective view illustrating the example agitating member. FIG. 37 illustrates an example air guide.

Referring to FIGS. 35 to 37, the driving assembly 40 may include the driving motor 41 generating torque, and the transmission unit 42 transmitting the torque from the driving motor 41 to rotate the agitating member 50

In detail, the driving motor 41 has the same structure as that of a typical electric motor, and may be disposed on the outside of the case 20. A rotation shaft 412 of the driving motor 41 may extend into the case 20, and be coupled to the transmission unit 42 in the case 20. Although the driving motor 41 may be disposed in the case 20, the driving motor 41 is disposed out of the case 20 to reduce (e.g., prevent) degradation of chilling efficiency of the chilling device 10 due to heat from the driving motor 41.

The driving motor 41 may be a typical DC motor. Torque from the driving motor 41 is converted by the transmission unit 42 to swing the agitating member 50. The driving motor 41 may be a stepping motor that can rotate forward and reverse by a constant angle. Thus, the driving motor 41 can repeatedly rotate forward and reverse by a constant angle, so that the agitating member 50 can swing.

The transmission unit 42 is installed on the driving motor 41. The transmission unit 42 includes a rotation member 421 connected to the rotation shaft 412 of the driving motor 41, and a connecting rod 422 connecting the rotation member 421 to holder shafts 53. The rotation shaft 412 of the driving motor 41 is parallel to an extension line of the holder shafts 53.

In detail, the rotation member 421 is coupled to the rotation shaft 412 of the driving motor 41, and rotates together with the rotation shaft 412 when the rotation shaft 412 rotates. The rotation member 421 and the rotation shaft 412 extend in the same direction. The rotation member 421 may include a shaft coupler 421*a* coupled to the rotation shaft 412, and an extension 421*b* extending in a direction crossing the shaft coupler 421*a* from an end of the shaft coupler 421*a*.

The inner portion of the shaft coupler 421*a* has a shape corresponding to the rotation shaft 412 to receive the rotation shaft 412 and power from the rotation shaft 412. Thus, when the rotation shaft 412 rotates, the rotation member 421 also rotates. The extension 421*b* extends from a side of the shaft coupler 421*a*. A connecting rod coupler 421*c* to which the connecting rod 422 is rotatably coupled is disposed at a side of the extension 421*b* spaced apart from the shaft coupler 421*a*. Thus, when the shaft coupler 421*a* rotates, the connecting rod coupler 421*c* rotates along a predetermined trajectory about the shaft coupler 421*a*, and thus, the connecting rod 422 reciprocates with a constant displacement.

The connecting rod 422 crosses extension directions of the rotation shaft 412 and the holder shafts 53, and may have a rod shape with a predetermined length. Coupling holes 422*a* are disposed at both ends of the connecting rod 422 to receive shafts. Thus, the coupling hole 422*a*, disposed at an end of the connecting rod 422, is rotatably coupled to the connecting rod coupler 421*c*, and the other of the coupling holes 422*a* connected to the holder shaft 53.

The connecting rod 422 may be directly connected to the holder shaft 53, or be connected to a connection 423 provided to the holder shaft 53. The connection 423 through which the holder shaft 53 passes may be disposed on an end of the holder shaft 53. The connection 423 may be rotatably coupled to the coupling hole 422*a* of the connecting rod 422. The connection 423 may be formed of a plastic material to reduce wear and noise due to friction generated during a rotation of the connecting rod 422.

The connecting rod 422 is adjacent to the rear support 52, and is coupled to the holder shaft 53. Thus, the transmission unit 42 is disposed a position to minimize the length of the rotation shaft 412 passing through the transmission unit 42 from the rear side of the transmission unit 42.

Thus, when the driving motor 41 rotates, the rotation member 421 rotates, and the connecting rod 422 reciprocates. While the connecting rod 422 reciprocates, the agitating member 50 repeatedly rotates, that is, swings through a predetermined angle.

The agitating member 50 accommodates the beverage container 6 to shake the beverage container 6. In detail, the agitating member 50 may include a front support 51 defining a front surface of the agitating member 50, a rear support 52 defining a rear surface of the agitating member 50, and a pair of holder shafts 53 connecting the front support 51 to the rear support 52. The beverage container 6 is placed on the holder shafts 53.

The front support 51 and the rear support 52 have the same shape, and are coupled to the holder shafts 53. The front support 51 and the rear support 52 may be installed on the bottom of the case 20 to swing left and right. Since the front support 51 and the rear support 52 have the same shape, the front support 51 will be mainly described hereinafter.

The front support 51 may include a coupling portion 511 coupled to a coupling member 513, and extensions 512 extending upward from the left and right sides of the coupling portion 511 and coupled to the holder shafts 53.

The coupling portion 511 is disposed in the middle of the front support 51, and extends downward. The coupling member 513 has a shaft shape, and is coupled to the coupling portion 511 to cross the coupling portion 511. The coupling member 513 passes through the coupling portion 511 and the agitating member support 25 of the case 20, so that the front support 51 can rotate left and right about the coupling member 513 as an axis.

The extensions 512 are disposed at the upper end of the coupling portion 511. The extensions 512 are disposed at the left and right sides of the front support 51, and each of the extensions 512 is coupled to two of the holder shafts 53, so that the beverage container 6 can be placed on the holder shafts 53.

The holder shaft 53 horizontally extends as a shaft or a bar, and is connected to the front support 51 and the rear support 52. The holder shafts 53 are provided in a pair on the upper and lower portions of the extension 512, and are spaced a predetermined distance from each other, so that the beverage container 6 can be accommodated in a space defined by the holder shafts 53. Cool air can efficiently flow into the space defined by the holder shafts 53. Since a distance between the holder shafts 53 at the lower side is smaller than a distance between the holder shafts 53 at the upper side, the beverage container 6 can be more stably placed on the holder shafts 53. The holder shafts 53 may be disposed at edges of the front support 51 and the rear support 52.

A neck holder 54 may be installed on the holder shafts 53 to support the neck of a beverage container, such as a wine bottle. The neck holder 54 can move along the holder shafts 53 according to the size of a bottle.

The neck holder 54 is installed on the holder shafts 53 at the lower side, and includes a first member 541 and a second member 542 spaced apart from each other, and elastic members 543 disposed between the first and second members 541 and 542. Thus, when the second member 542 moves with the first member 541 fixed, the elastic members 543 are compressed.

In detail, the elastic members 543 are disposed between the first and second members 541 and 542, and are provided to the holder shafts 53 on which the first and second members 541 and 542 are installed. Thus, when the second member 542 is moved, the elastic members 543 may be compressed according to the size of the beverage container 6 placed on the agitating member 50. The holder shafts 53 pass through the elastic members 543, so that the elastic members 542 can be compressed in the longitudinal direction of the holder shafts 53.

The first member 541 has a plate shape, and the central portion thereof is lower than the left and right portions thereof having a rounded shape. Thus, when a bottle having a long neck as the beverage container 6 is placed on the agitating member 50, the neck can be placed on the first member 541. The first member 541 is behind the second member 542, and may be adjacent to the rear support 52 and may be fixed to the holder shafts 53.

The second member 542 is disposed before the first member 541, and is installed on the holder shafts 53 passing through the second member 542. When the elastic members 543 are not compressed, the second member 542 is disposed at a position corresponding to the rear end of the suction grill 23. Thus, when the beverage container 6 is placed on the agitating member 50, the beverage container 6 contacts the second member 542, and the suction grill 23 is disposed at a position corresponding to the beverage container 6, thereby effectively chilling the beverage container 6.

When a long bottle as the beverage container 6 is placed on the agitating member 50, or when two cans as the beverage container 6 are placed thereon, the second member 542 moves along the holder shafts 53 to dispose the beverage container 6 at an appropriate position. When the elastic members 543 are compressed, the second member 542 may press and fix the beverage container 6. Accordingly, the beverage container 6 can be stably fixed to the agitating member 50. When one of two cans placed on the agitating member 50 is removed, the second member 542 is moved forward by the elasticity of the elastic members 543, and the other can placed on the agitating member 50 is also moved forward, so that the other one can be easily taken out.

The central portion of the second member 542 may be lower than their left and right portions fixed by the holder shafts 53, so as to have a rounded shape. The second member 542 has a predetermined thickness, and a seat guide 542*a* is disposed on a rounded top of the second member 542. The front or rear side of the seat guide 542*a* with respect to the top center of the second member 542 may be rounded or inclined. That is, a cross-section of the second member 542 increases in height toward the center thereof. Thus, when a bottle as the beverage container 6 is put into the case 20 through the inlet 21, even when the beverage container 6 contacts the seat guide 542*a* of the second member 542, the beverage container 6 can smoothly slide over the seat guide 542*a*, and be placed on the neck holder 54. The upper end of the seat guide 542*a* may be disposed out of the center of the second member 542, and have a slope or a curved surface that decreases in height forward.

The agitating member 50 is provided with air guides 55. The air guide 55 guides cool air discharged from the air holes 231 of the suction grill 23 to reduce (e.g., prevent) dispersion of the cool air after colliding with the beverage container 6, so that the cool air flows along the beverage container 6 to chill the beverage container 6 again.

The air guides 55 are disposed at the left and right sides of the agitating member 50. The air guides 55 may have a length corresponding to or greater than the length of the suction grill 23, and have a predetermined vertical width. Thus, the air guides 55 are installed on the holder shafts 53 disposed at the upper side, so that the beverage container 6 placed on the agitating member 50 can be surrounded by the air guides 55 at the left and right sides.

The air guides 55 are rounded to surround the outer surface of the beverage container 6. The air guides 55 are disposed at the left and right sides to correspond to the suction grill 23, thereby guiding cool air discharged from the suction grill 23. The lower ends of the air guides 55 extend out of the left and right ends of the suction grill 23 to guide all cool air discharged from the suction grill 23 into the space between the air guides 55.

Air guide installation parts 551 are disposed on the upper ends of the air guides 55 to install the air guides 55. The air guide installation part 551 is recessed from the upper end of the air guide 55, and extends from an end of the air guide 55 to the other end. Thus, the air guide installation part 551 can be fixed to the holder shaft 53. The air guide installation part 551 may be coupled to the holder shaft 53 disposed at the upper side, and be press coupled to the holder shaft 53, or be fixed by a fixing member, such as adhesive.

A guide 552 is disposed under the air guide installation part 551. The guide 552 has a predetermined curvature to guide cool air along the outer surface of the beverage container 6.

The guide 552 is provided with guide plates 553 spaced a predetermined distance from one another. The guide plates 553 guide cool air to flow uniformly on the entire surface of the air guide 55, and thus, the cool air can flow uniformly on the entire surface of the beverage container 6.

In detail, the guide plates 553 may have a plate shape vertically extending, and be laterally arrayed with a predetermined gap therebetween. Thus, a passage 554 for passing cool air is disposed between neighboring ones of the guide plate 553. The guide plate 553 may extend from a side of the guide 552 to the air guide installation part 551, and have an inclined or rounded protrusion.

In some implementations, instead of the fixing members 62, a locking unit 68 may confine the cover 60.

Figure 38:
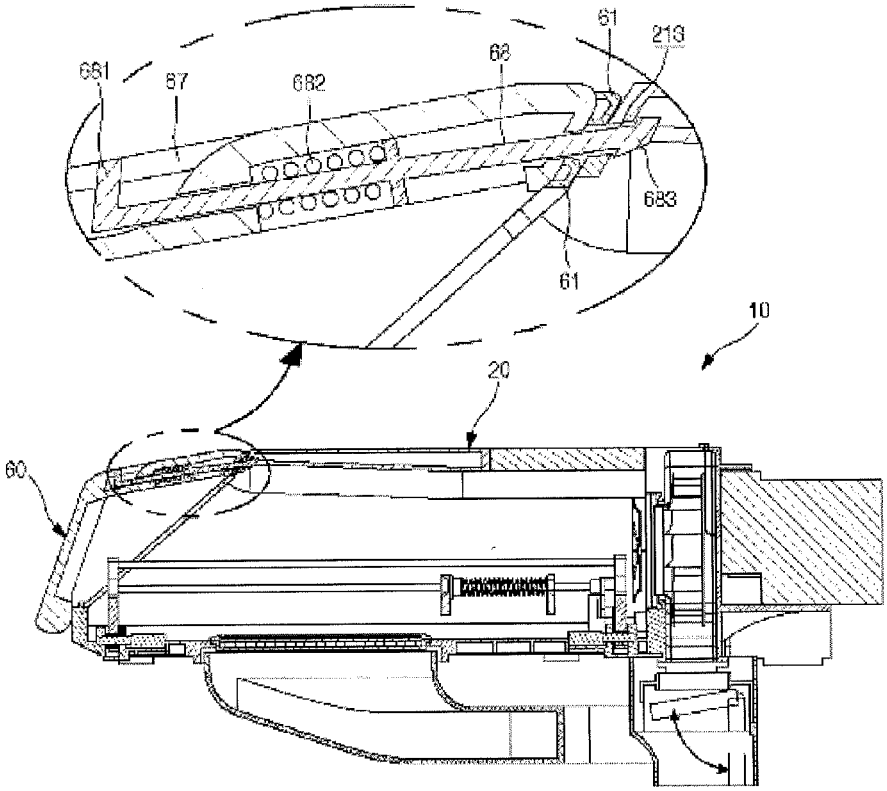
FIG. 38 is a cross-sectional view illustrating a locking unit.

FIG. 38 illustrates an example locking unit.

Referring to FIG. 38, the cover 60 of the chilling device 10 may be provided with the locking unit 68. The locking unit 68 is coupled to the case 20 to maintain closing of the cover 60. The locking unit 68 is disposed in the cover 60, and is exposed from a side of the handle 67 and the rear end of the cover 60 (the right side of FIG. 38).

In more detail, the locking unit 68 extends in the back-and-forth direction of the cover 60, and the front end of the locking unit 68 (the left side of FIG. 38) is provided with a manipulation part 681 that is manipulated by a user. The manipulation part 681 is exposed to the handle 67 that is recessed. Thus, a user can hold the handle 67 and the manipulation part 681 to rotate the cover 60.

The locking unit 68 is supported by an elastic member 682 in the cover 60. Thus, when the locking unit 68 is manipulated, the elastic member 682 can be compressed or stretched. When the manipulation of the locking unit 68 is completed, the locking unit 68 returns to its original position by the elasticity of the elastic member 682.

The rear end of the locking unit 68 protrudes through the rear surface of the cover 60. The rear end of the locking unit 68 is provided with a catching portion 683. The catching portion 683 has a hook shape. When the cover 60 is closed, the catching portion 683 is inserted and locked in a locking unit coupling hole 213 that is recessed in the front end of the case 20 or passes through the front end.

When the cover 60 is closed, a user holds the handle 67 to open the chilling device 10. At this point, when the user also holds and pulls the manipulation part 681 exposed to the handle 67, the locking unit 68 is moved forward, and thus, the catching portion 683 is released from the locking unit coupling hole 213.

When the catching portion 683 of the locking unit 68 is removed from the locking unit coupling hole 213, the cover 60 can freely rotate. Accordingly, the cover 60 can be rotated counterclockwise, and be completely opened. Then, the beverage container 6 can be put in or taken out of the case 20.

The cover 60 is rotated clockwise to close the cover 60. When the cover 60 is rotated by a set angle, the catching portion 683 of the locking unit 68 is inserted into the locking unit coupling hole 213. At this point, the catching portion 683 contacts the locking unit coupling hole 213, and the locking unit 68 can be smoothly inserted along slopes of the catching portion 683 when the cover 60 is further rotated. When the cover 60 is completely closed, stepped parts of the catching portion 683 are locked to the locking unit coupling hole 213 to maintain the closing of the cover 60.

Hereinafter, an example operation of a chilling device is described.

Figure 39:
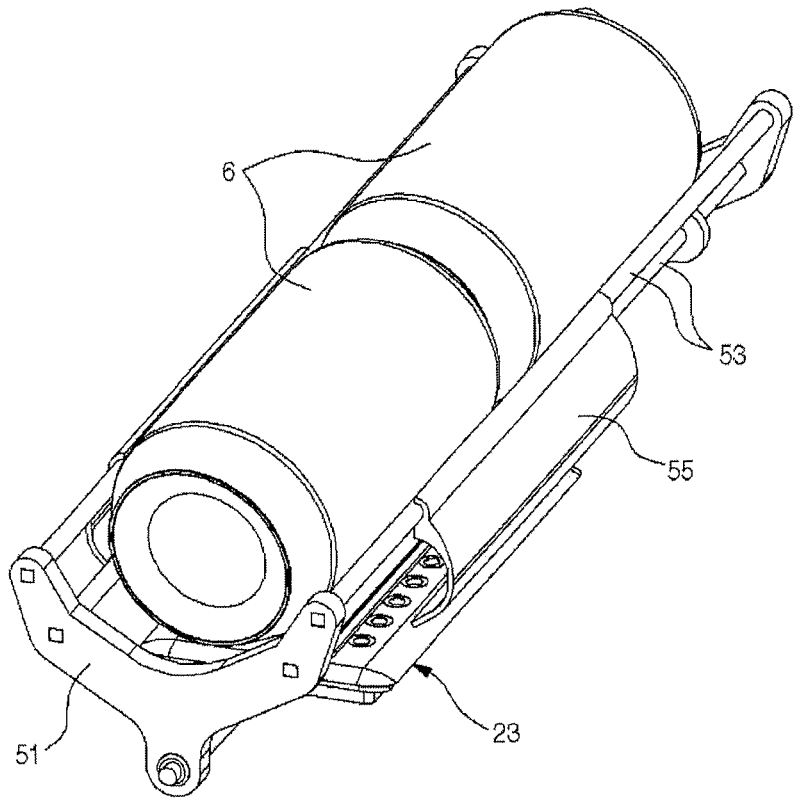
FIG. 39 is a perspective view illustrating a state in which beverage containers are placed on an agitating member.
Figure 40:
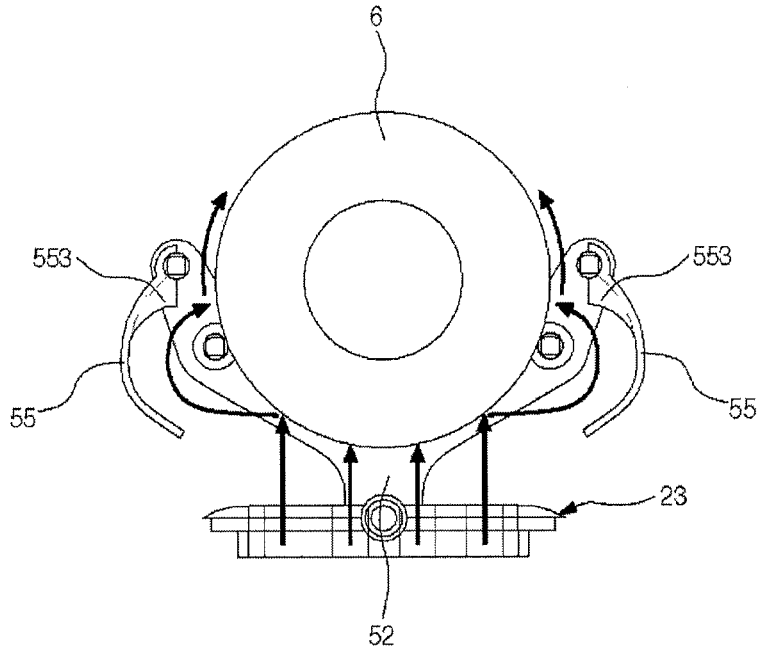
FIG. 40 is a schematic view illustrating flows of cool air in the state where the beverage containers are placed on the agitating member.
Figure 41:
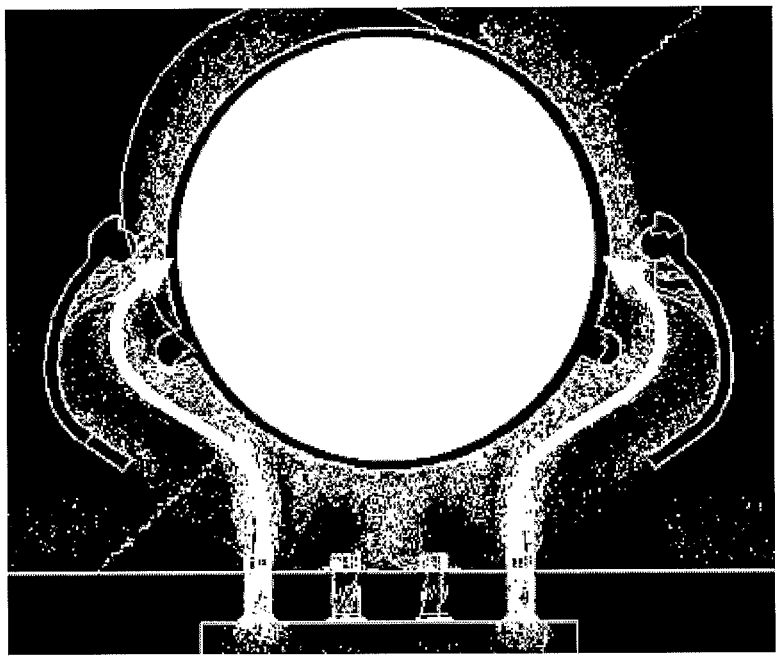
FIG. 41 is a computational fluid dynamics (CFD) image illustrating flows of cool air when the chilling device operates.

FIG. 39 illustrates a state in which beverage containers are placed on an example agitating member. FIG. 40 illustrates example flows of cool air in the state where the beverage containers are placed on the example agitating member. FIG. 41 is a computational fluid dynamics (CFD) image illustrating flows of cool air when the chilling device operates.

Referring to FIGS. 39 to 41, the bottom of the chilling compartment, particularly, the bottom of the case 20 is connected to the discharge end of the suction duct 11. The suction grill is disposed on the bottom of the case 20 connected to the discharge end of the suction duct 11, and the speed of air sucked through the suction duct 11 increases while passing through the suction grill 23. As described above, this occurs because the air holes 231 are disposed in the suction grill 23.

The cool air passing through the suction grill 23 at high speed may be discharged in a direction perpendicular to the outer surface of the beverage container 6. Since the beverage container 6 has a cylindrical shape, when the cool air passing through the suction grill 23 perpendicularly collides with the outer surface of the beverage container 6, heat exchange efficiency is increased (e.g., maximized). When a flow direction of cool air passing through the suction grill 23 is not perpendicular to the outer surface of the beverage container 6, a portion of the cool air may be discharged out of the case 20, without colliding with the beverage container 6. That is, cool air sucked through the suction grill 23 may perpendicularly collide with the outer surface of the beverage container 6 to reduce (e.g., minimize) the amount of cool air discharged without heat exchange.

Most of the cool air passing through the suction grill 23 collides with the outer surface of the beverage container 6 at a perpendicular direction. The cool air perpendicularly colliding with the outer surface of the beverage container 6, and the cool air flowing out of the beverage container 6 are guided by the air guides 55.

In detail, the cool air perpendicularly colliding with the outer surface of the beverage container 6 moves along the guides 552 of the air guides 55, and contacts again the outer surface of the beverage container 6. That is, the cool air contacting the outer surface of the beverage container 6 to primarily chill the beverage container 6 contacts again the outer surface of the beverage container 6 to secondarily chill the beverage container 6. The cool air passing through the suction grill 23 and flowing out of the beverage container 6 are guided to the outer surface of the beverage container 6 by the air guides 55 to chill the beverage container 6. The cool air guided by the air guides 55 is provided uniformly on the beverage container 6 by the guide plates 553, so that the beverage container 6 can be uniformly chilled.

The suction fan 31 axially sucks the cool air to radially discharge the cool air, and the fan housing 32 guides the cool air to the freezer compartment 104 through the return duct 12.

While the suction fan 31 rotates, the agitating member 50 swings. To this end, the driving motor 41 is rotated. The driving motor 41 may be continuously rotated, or be rotated forward and reverse by a constant angle. The agitating member 50 repeatedly swings according to an operation of the transmission unit 42 connected to the rotation shaft 412 of the driving motor 41.

In detail, when the rotation shaft 412 of the driving motor 41 rotates, the rotation member 421 coupled to the rotation shaft 412 also rotates, and the connecting rod 422 extending from a side of the rotation member 421 reciprocates to move the holder shaft 53 of the agitating member 50. Since the lower end of the agitating member 50 is shaft-coupled to the agitating member support 25, the agitating member 50 swings left and right through a predetermined angle about the agitating member support 25 as an axis.

When the suction fan 31 sucks the cool air, the agitating member 50 swings to agitate the beverage in the beverage container 6, thereby quickly chilling the beverage. Due to the air guide 55, the cool air discharged from the suction grill 23 effectively chills the outer surface of the beverage container 6, thereby more quickly and effectively chilling the beverage in the beverage container 6.

A refrigerator according to the present disclosure may be implemented in various example configurations. Hereinafter, a refrigerator is described according to another example.

In this example, holder shafts of an agitating member have indents to reduce (e.g., minimize) an interference between the holder shafts and cool air passing through a suction grill, thereby improving a flow of the cool air.

Thus, in this example, the parts are similar to those described above, except for the shape of the holder shafts. A description of previously described parts is not repeated, and like reference numerals denote like elements.

Figure 42:
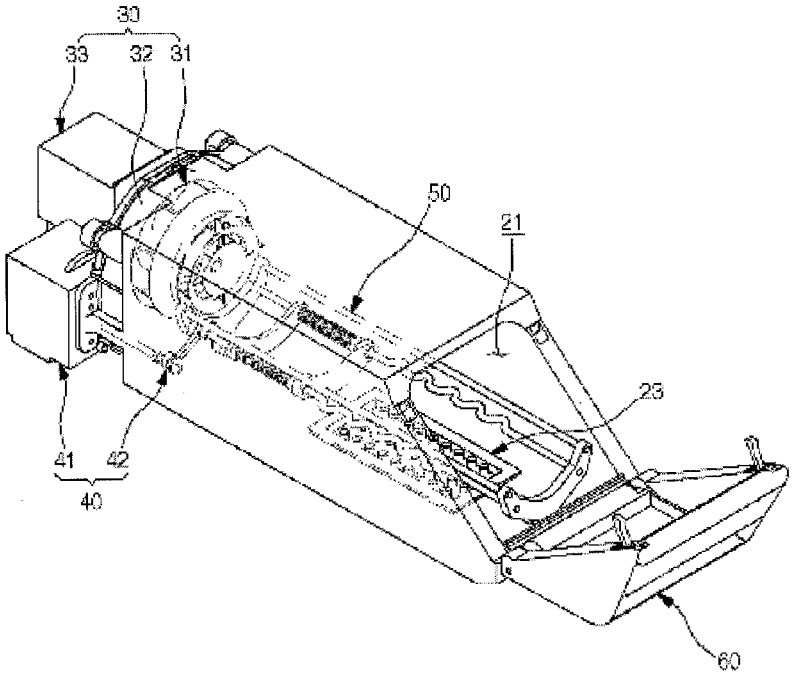
FIG. 42 is a perspective view illustrating a chilling device.
Figure 43:
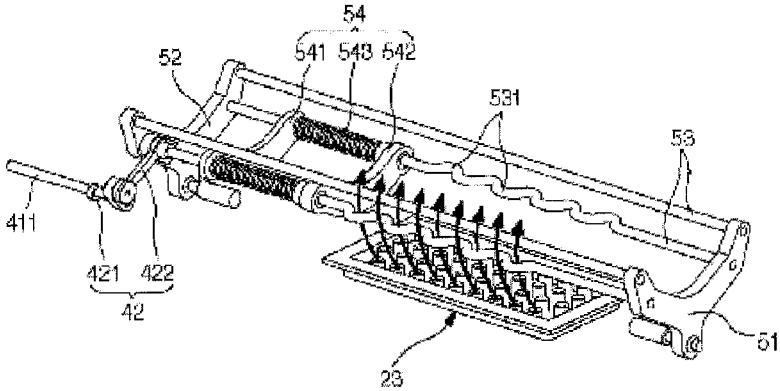
FIG. 43 is perspective view illustrating an agitating member of the chilling device.
Figure 44:
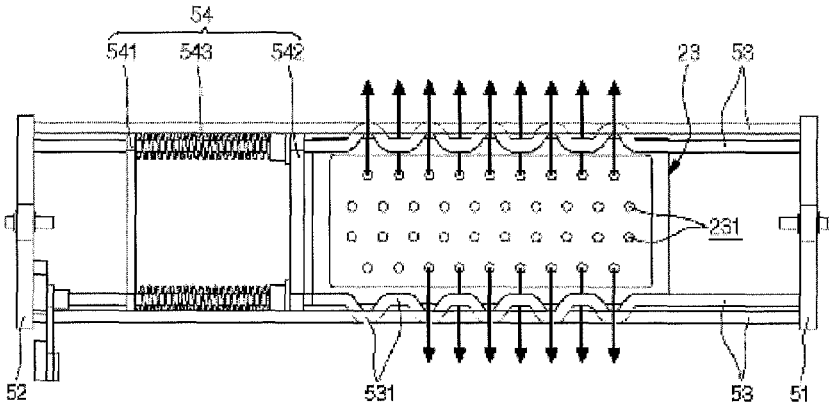
FIG. 44 is a plan view illustrating the agitating member.

FIG. 42 illustrates an example chilling device. FIG. 43 illustrates an example agitating member of the example chilling device. FIG. 44 illustrates the example agitating member.

Referring to FIGS. 42 to 44, a chilling device 10 includes a fan motor assembly 30 to forcibly suck and circulate cool air, and a suction grill 23 for passing cool air is disposed in a case 20. The suction grill 23 includes air holes 231 to discharge cool air in a direction crossing an outer surface of a beverage container 6. The case 20 is opened and closed by a cover 60, so that the beverage container 6 to be chilled can be disposed in the case 20.

The agitating member 50, which is repeatedly swung by a driving assembly 40, may be disposed in the case 20 of the chilling device 10. The agitating member 50 may include a front support 51 defining a front surface of the agitating member 50, a rear support 52 defining a rear surface of the agitating member 50, and a plurality of the holder shafts 53 connecting the front support 51 to the rear support 52. The beverage container 6 is placed on the holder shafts 53.

The holder shafts 53 are provided in a pair at each of the left and right sides of the agitating member 50. A distance between the holder shafts 53 at the lower side of the agitating member 50 is smaller than a distance between the holder shafts 53 at the upper side, so that the beverage container 6 can be stably placed on the holder shafts 53.

The holder shafts 53 at the lower side include a series of indents 531 for facilitating a flow of cool air. The indents 531 are continuously arrayed in a region corresponding to the suction grill 23 to reduce (e.g., minimize) an interference of the holder shafts 53 and cool air discharged from the lower side.

In detail, each of the indents 531 is disposed at a position to correspond to each of the air holes 231 of the suction grill 23. Neighboring ones of the indents 531 are indented to opposite sides to each other. The indents 531 are alternately disposed at a position close to the air holes 231 and a position far from the air holes 231.

Cool air discharged through the air holes 231 collides with the beverage container 6 and flows along the outer surface of the beverage container 6. A portion of the cool air flowing along the outer surface of the beverage container 6 passes through the holder shafts 53 disposed at the lower side. A portion of the cool air is guided to the inside of the holder shaft 53 by the indents 531 disposed inside the holder shaft 53, and the other of the cool air is guided to the outside of the holder shaft 53 by the indents 531 disposed outside the holder shaft 53. That is, cool air from the air holes 231 can be discharged through the inside and outside of the indents 531, without colliding with the holder shafts 53.

Thus, cool air discharged through the air holes 231 corresponding to the indents 531 disposed at the inside of the holder shaft 53 is discharged through the inside of the indents 531, and cool air discharged through the air holes 231 corresponding to the indents 531 disposed at the outside of the holder shaft 53 is discharged through the outside of the indents 531. The indents 531 disposed inside the holder shafts 53 contact the outer surface of the beverage container 6 placed on the agitating member 50, so that the beverage container 6 can be stably placed on the agitating member 50. That is, the indents 531 of the holder shaft 53 stably fix the beverage container 6, and facilitate a flow of cool air discharged through the air holes 231.

The holder shafts 53 are provided with a movable neck holder 54, so that the beverage container 6 having an arbitrary size may be placed on the agitating member 50. The neck holder 54 includes a first member 541, a second member 542, and elastic members 543 disposed between the first and second members 541 and 542, so as to stably fix a beverage container having an arbitrary size or a plurality of beverage containers.

A transmission unit 42 is connected to a side of the holder shaft 53. The transmission unit 42 includes a rotation member 421 connected to a rotation shaft 412 of a driving motor 41, and a connecting rod 422 connecting the rotation member 421 to the holder shafts 53. Accordingly, torque from the driving motor 41 is converted to repeatedly swing the agitating member 50.

Thus, the fan motor assembly 30 is driven to move cool air in the case 20, thereby chilling the beverage container 6. At this point, the driving assembly 40 is driven to swing the agitating member 50, so that the beverage in the beverage container 6 can be agitated while being chilled. Since a portion of the cool air passing through the suction grill 23 and flowing along the outer surface of the beverage container 6 passes through the indents 531 of the holder shafts 53, the cool air efficiently flows, thereby more effectively chilling the beverage container 6.

A refrigerator according to the present disclosure may include various implementations. Hereinafter, a refrigerator is described according to another implementation.

In the current implementation, holder shafts of an agitating member have indents, and guide members are disposed outside the indents to guide cool air, to improve a flow of cool air in a chilling device.

Thus, in the current implementation, the parts are similar to those described above, except for the shape of the holder shafts. A description of previously described parts is not repeated, and like reference numerals denote like elements.

Figure 45:
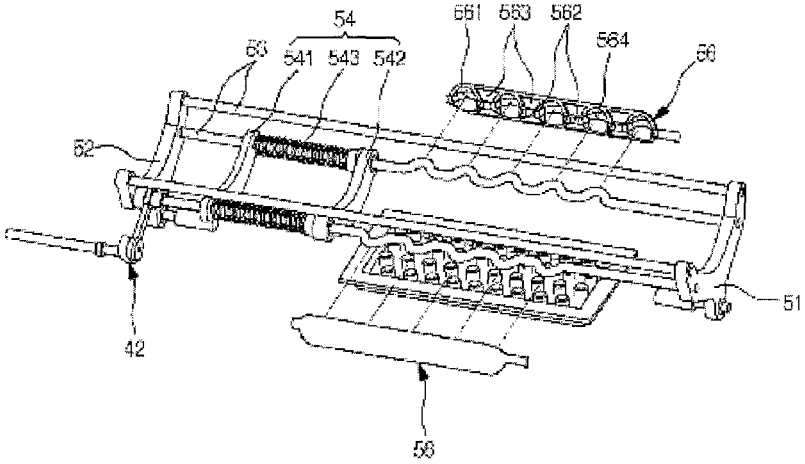
FIG. 45 is a perspective view illustrating an agitating member and guide members.
Figure 46:
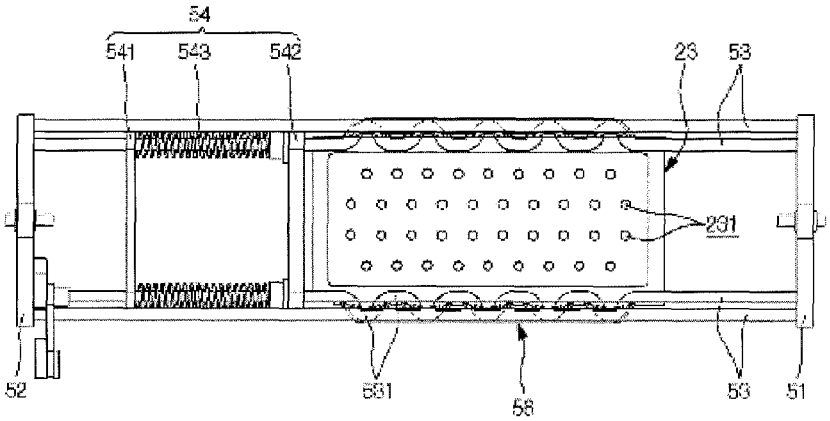
FIG. 46 is a plan view illustrating the agitating member.
Figure 47:
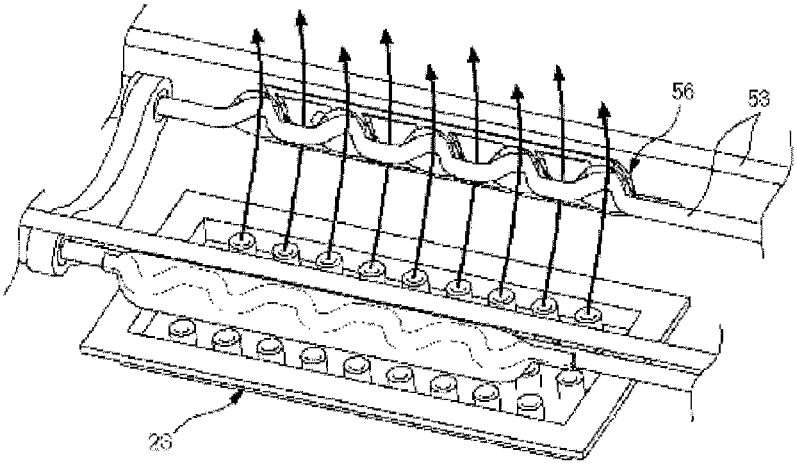
FIG. 47 is a perspective view illustrating a flow of cool air in the agitating member.

FIG. 45 illustrates an example agitating member and example guide members. FIG. 46 illustrates the example agitating member. FIG. 47 illustrates a flow of cool air in the example agitating member.

Referring to FIGS. 45 to 47, a chilling device 10 includes a fan motor assembly 30 to forcibly suck and circulate cool air, and a suction grill 23 for passing cool air is disposed in a case 20. The suction grill 23 includes air holes 231 to discharge cool air in a direction crossing an outer surface of a beverage container 6. The case 20 is opened and closed by a cover 60, so that the beverage container 6 to be chilled can be disposed in the case 20.

The agitating member 50, which is repeatedly swung by a driving assembly 40, may be disposed in the case 20 of the chilling device 10. The agitating member 50 may include a front support 51 defining a front surface of the agitating member 50, a rear support 52 defining a rear surface of the agitating member 50, and a pair of holder shafts 53 connecting the front support 51 to the rear support 52. The beverage container 6 is placed on the holder shafts 53.

The holder shafts 53 are provided in a pair at each of the left and right sides of the agitating member 50. A distance between the holder shafts 53 at the lower side of the agitating member 50 is smaller than a distance between the holder shafts 53 at the upper side, so that the beverage container 6 can be stably placed on the holder shafts 53.

The holder shafts 53 at the lower side include a series of indents 531 for facilitating a flow of cool air. The indents 531 are continuously arrayed in a region corresponding to the suction grill 23 to reduce (e.g., minimize) an interference of the holder shafts 53 and cool air discharged from the lower side.

In detail, each of the indents 531 is disposed at a position to correspond to each of the air holes 231 of the suction grill 23. Neighboring ones of the indents 531 are indented to opposite sides of each other. The indents 531 are alternately disposed at a position close to the air holes 231 and a position far from the air holes 231.

Cool air discharged through the air holes 231 collides with the beverage container 6 and flows along the outer surface of the beverage container 6. A portion of the cool air flowing along the outer surface of the beverage container 6 passes through the holder shafts 53 disposed at the lower side. A portion of the cool air is guided to the inside of the holder shaft 53 by the indents 531 disposed inside the holder shaft 53, and the other of the cool air is guided to the outside of the holder shaft 53 by the indents 531 disposed outside the holder shaft 53. That is, cool air from the air holes 231 can be discharged through the inside and outside of the indents 531, without colliding with the holder shafts 53.

Thus, cool air discharged through the air holes 231 corresponding to the indents 531 disposed at the inside of the holder shaft 53 is discharged through the inside of the indents 531, and cool air discharged through the air holes 231 corresponding to the indents 531 disposed at the outside of the holder shaft 53 is discharged through the outside of the indents 531. The indents 531 disposed inside the holder shafts 53 contact the outer surface of the beverage container 6 placed on the agitating member 50, so that the beverage container 6 can be stably placed on the agitating member 50. That is, the indents 531 of the holder shaft 53 stably fix the beverage container 6, and facilitate a flow of cool air discharged through the air holes 231.

Air guides 56 may be installed on the holder shafts 53 provided with the indents 531. Cool air flowing through the inside and outside of the indents 531 is guided to the beverage container 6 by the air guides 56.

In detail, the air guide 56 is installed on the outer portion of the holder shaft 53, and has a length corresponding to the entire length of a series of the indents 531. Thus, the air guide 56 entirely covers the indents 531. The inner surface of the air guide 56 is provided with recesses 564. Thus, when being installed, the air guide 56 closely contacts the outer surface of the holder shaft 53. The recesses 564 are arrayed from an end of the air guide 56 to the other end, so as to contact all the indents 531. Accordingly, the air guides 56 can be more stably installed on the holder shafts 53.

The inner surface of the air guide 56 has a predetermined curvature to guide cool air contacting the air guide 56 toward the beverage container 6. The inner portion of the air guide 56 is divided into a plurality of spaces to independently guide cool air passing through each of the indents 531.

In detail, the inner surface of the air guide 56 is provided with inner guides 561 and outer guides 562 that are disposed at positions to correspond to the indents 531. The inner guides 561 contact the outer surfaces of the indents 531 disposed outside the holder shaft 53, to guide cool air passing through the inside of the indents 531. The outer guides 562 contact the outer surfaces of the indents 531 disposed inside the holder shaft 53, and support the outer surfaces of the indents 531, and spaces 563 for passing cool air are disposed between the indents 531 and the air guide 56. Thus, cool air passing through the outside of the indents 531 can be guided through the spaces 563 defined by the outer guides 562. Then, the cool air passing through the spaces 563 are guided toward the beverage container 6 along the curvature of the inner surface of the air guide 56.

Thus, a portion of cool air passing through the suction grill 23 collides with the outer surface of the beverage container 6 and moves along the outer surface. Then, the cool air flows through the inside and outside of the indents 531, and is guided toward the beverage container 6 through the inner guides 561 and the outer guides 562, thereby chilling the beverage container 6 again.

The holder shafts 53 are provided with a movable neck holder 54, so that the beverage container 6 having an arbitrary size can be placed on the agitating member 50. The neck holder 54 includes a first member 541, a second member 542, and elastic members 543 disposed between the first and second members 541 and 542, so as to stably fix a beverage container having an arbitrary size or a plurality of beverage containers.

A transmission unit 42 is connected to a side of the holder shaft 53. The transmission unit 42 includes a rotation member 421 connected to a rotation shaft 412 of a driving motor 41, and a connecting rod 422 connecting the rotation member 421 to the holder shafts 53. Accordingly, torque from the driving motor 41 is converted to repeatedly swing the agitating member 50.

Thus, the fan motor assembly 30 is driven to move cool air in the case 20, thereby chilling the beverage container 6. At this point, the driving assembly 40 is driven to swing the agitating member 50, so that the beverage in the beverage container 6 can be agitated while being chilled. The air guides 56 guide cool air, colliding with the beverage container 6 and the holder shafts 53, to the outer surface of the beverage container 6, thereby more effectively chilling the beverage container 6.

A refrigerator according to the present disclosure may include various examples. Hereinafter, a refrigerator is described according to another example.

In the current example, a single driving motor drives a suction fan and an agitating member such that suction of cool air and agitation of a beverage are simultaneously performed during driving of a chilling device.

Thus, in the current example, the parts are similar to those described above, except for a driving assembly. A description of previously described parts is not repeated, and like reference numerals denote like elements.

Figure 48:
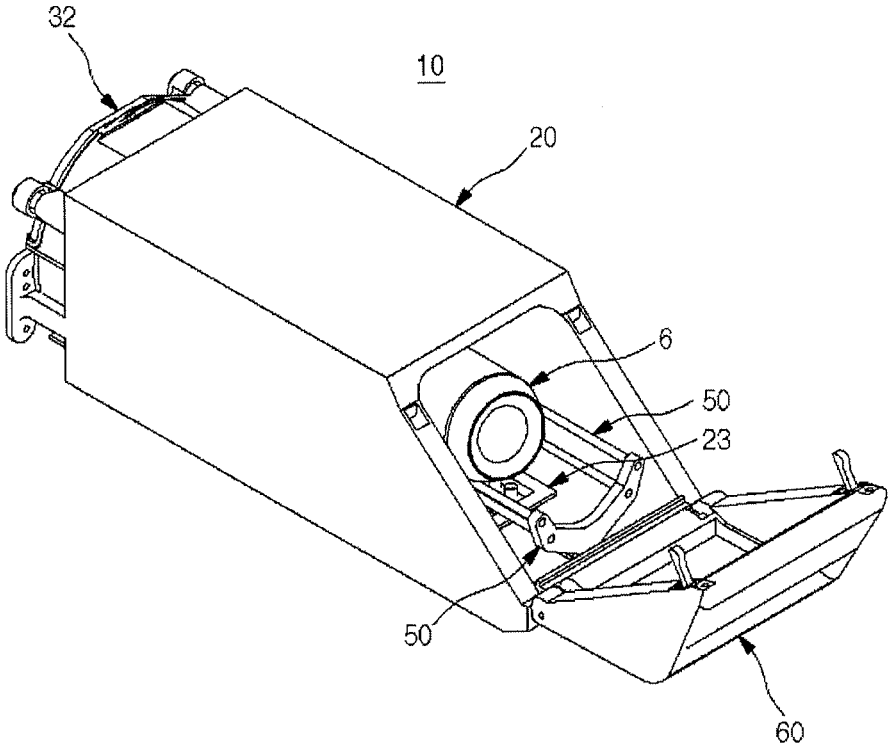
FIG. 48 is a perspective view illustrating a front part of a chilling device.
Figure 49:
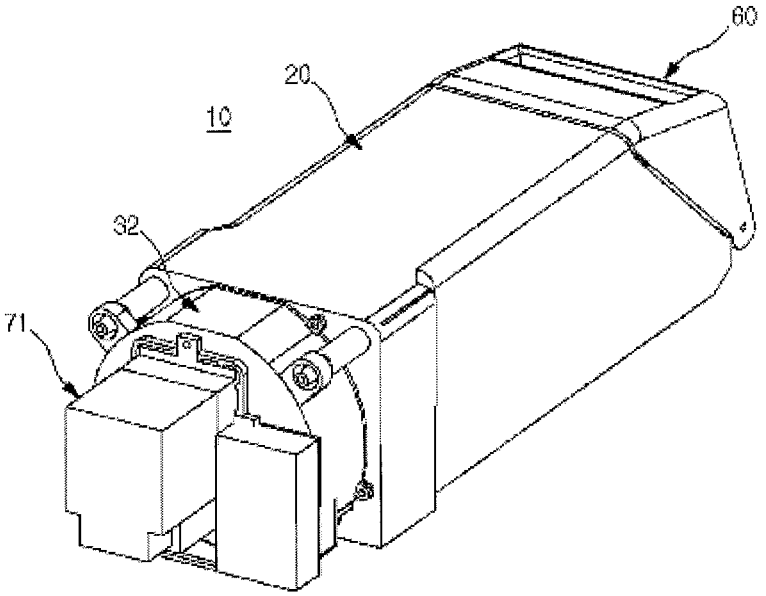
FIG. 49 is a perspective view illustrating the rear part of the chilling device.
Figure 50:
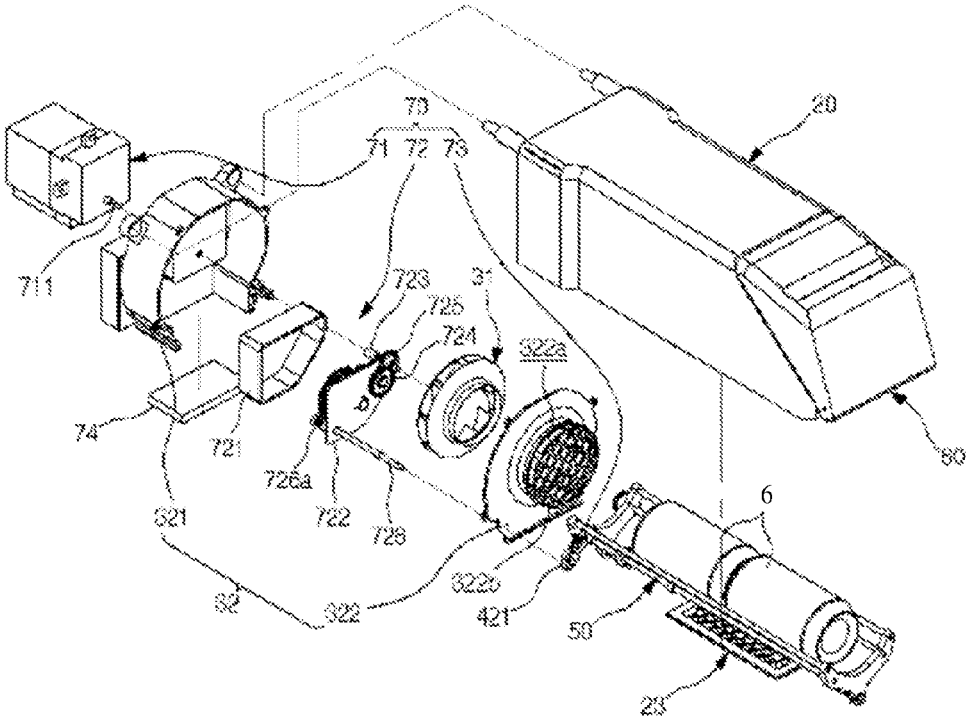
FIG. 50 is an exploded perspective view illustrating the chilling device.
Figure 51:
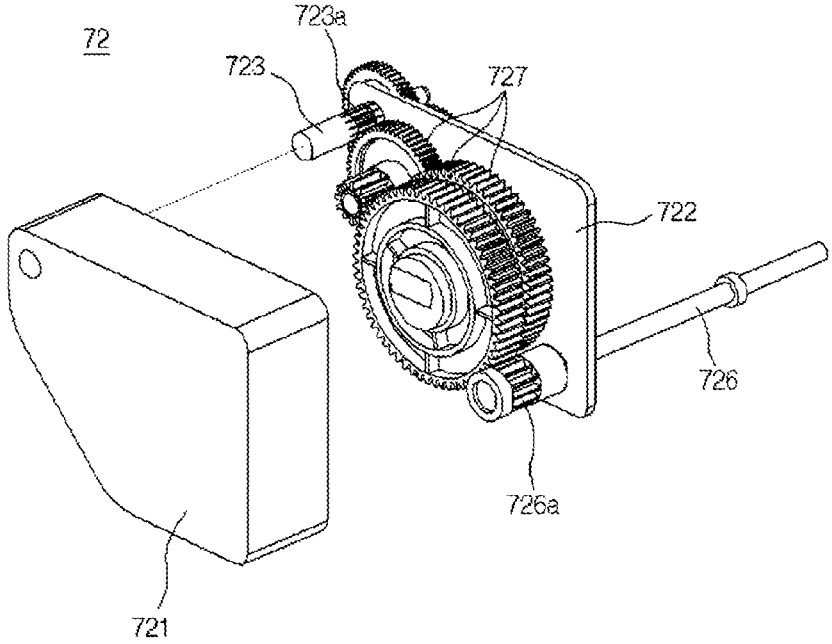
FIG. 51 is an exploded perspective view illustrating a housing of a gear assembly of the chilling device.

FIG. 48 illustrates a front part of an example chilling device. FIG. 49 illustrates the rear part of the example chilling device. FIG. 50 is an exploded perspective view illustrating the example chilling device. FIG. 51 illustrates an example housing of an example gear assembly of the example chilling device.

Referring to FIGS. 48 to 51, a chilling device 10 includes a case 20 defining an appearance of the chilling device 10, and an agitating member 50 disposed in the case 20. A suction grill 23 connected to a suction duct 11 is disposed in the bottom surface of the case 20 to supply cool air into the case 20.

A suction fan 31 may be disposed behind the case 20 to provide an air flow in the case 20. A transmission unit 73 may be disposed in the case 20 to swing the agitating member 50. A driving assembly 70 may be disposed behind the case 20 to simultaneously drive the suction fan 31 and the transmission unit 73.

The driving assembly 70 may include a driving motor 71 generating torque, and a gear assembly 72 transmitting the torque from the driving motor 71 to the suction fan 31 and the transmission unit 73. The driving motor 71 and the gear assembly 72 is described in more detail later.

The fan housing 32 includes a main body 321 defining a space accommodating the suction fan 31, the gear assembly 72, and a damping member 74, and a cover 322 covering a side of the main body 321.

The main body 321 has a side opening covered by the cover 322, and defines a predetermined space with the cover 322. The cover 322 includes a suction opening **322*a* that may be provided with a grill 322*b*** for reducing (e.g., preventing) introduction of a foreign substance.

The main body 321 has a bottom opening that communicates with a return duct 12. The damping member 74 selectively opens and closes the bottom opening of the main body 321. The damping member 74 operates in conjunction with the driving motor 71, and thus, is opened when the driving motor 71 is driven, so that cool air can circulate between the chilling device 10 and a freezer compartment 104 or an evaporating compartment 107. The damping member 74 is closed when the driving motor 71 is stopped, so that cool air is stopped from circulating between the chilling device 10 and a freezer compartment 104 or an evaporating compartment 107.

Thus, when the damping member 74 is opened by driving of the driving motor 71, cool air, which is sucked through the suction duct 11 and the suction grill 23 by the suction fan 31, cools the beverage container 6 in the case 20, then, passes through the suction fan 31, then, is guided by the fan housing 32, and then, is discharged through the return duct 12.

The driving motor 71 is disposed behind the fan housing 32. A rotation shaft 711 of the driving motor 71 passes through the fan housing 32, and is disposed in the fan housing 32. The rotation shaft 711 is coupled to the gear assembly 72 disposed in the fan housing 32 to drive the gear assembly 72. The gear assembly 72 is coupled to the suction fan 31 and the transmission unit 73 to operate the suction fan 31 and the transmission unit 73.

In detail, the gear assembly 72 includes a housing 721 accommodating a plurality gears, and a mounting plate 722 for closing the housing 721 and mounting the gears. A driving shaft 723 is disposed at a side of the mounting plate 722. The driving shaft 723 passes through the mounting plate 722, and is coupled to the rotation shaft 711 of the driving motor 71 to rotate when the driving motor 71 is driven.

The front surface of the mounting plate 722 is provided with a first fan gear 724 that is coupled to a rotation shaft of the suction fan 31 to rotate together with the rotation shaft of the suction fan 31. A second fan gear 725 is disposed on the driving shaft 723 at the front side of the mounting plate 722. The second fan gear 725 engages with the first fan gear 724 to transmit torque from the driving motor 71. Thus, when the driving motor 71 is driven, the first and second fan gears 724 and 725 rotate. The suction fan 31 rotates according to the rotation of the second fan gear 725. At this point, the number of rotations of the suction fan 31 is determined according to a gear ratio of the first fan gear 724 to the second fan gear 725.

Another side of the mounting plate 722 is provided with a transmission shaft 726 for transmitting power to the transmission unit 73. The transmission shaft 726 passes through the mounting plate 722, and an end thereof is coupled to the rotation member 421 of the transmission unit 73 in the case 20.

A transmission shaft gear 726*a* is disposed behind the mounting plate 722, and is formed on the transmission shaft 726. A driving shaft gear 723*a* is disposed behind the mounting plate 722, and is formed on the driving shaft 723. The rear surface of the mounting plate 722 is provided with one or more speed changer gears 727 such that the transmission shaft gear 726*a* moves in conjunction with the driving shaft gear 723*a*. The number of the speed changer gears 727 and a gear ratio thereof may be varied.

Since the frequency of rotations of the suction fan 31 may be higher than that of driving of the transmission unit 42, the speed changer gears 727 may be configured such that the number of rotations of the transmission shaft 726 is smaller than the number of rotations of the driving shaft 723. Thus, unlike the suction fan 31 that rotates at high speed in the case 20, the agitating member 50 can by swung at a stable frequency by the transmission unit 73.

Figure 52:
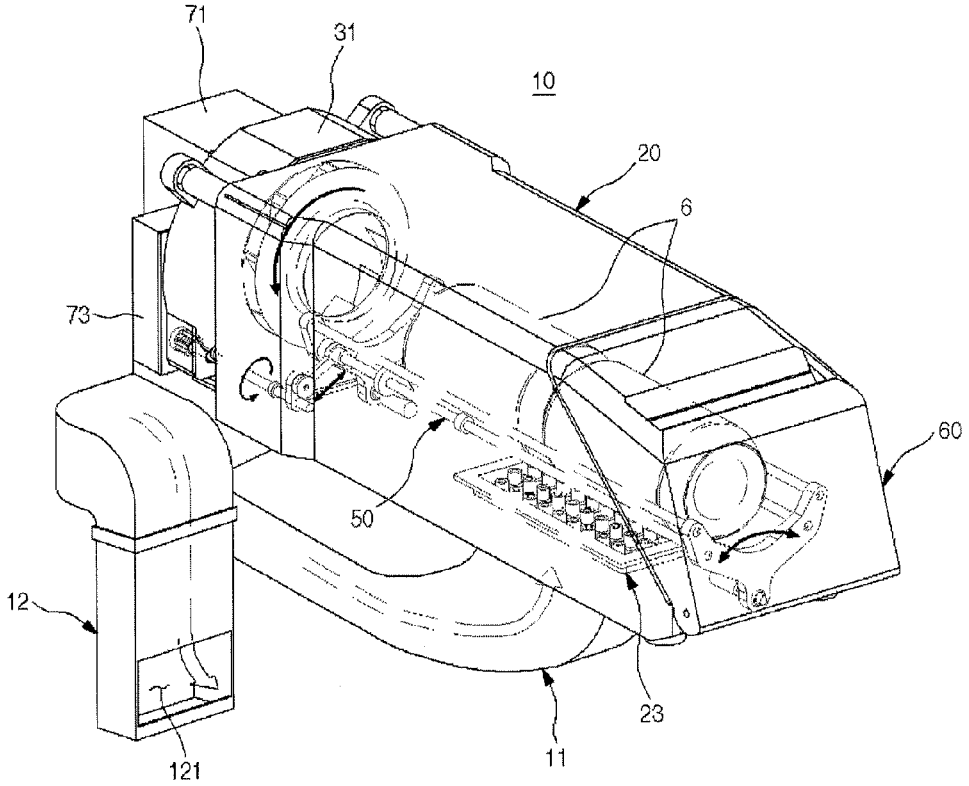
FIG. 52 is a perspective view illustrating an operation of the chilling device.

FIG. 52 illustrates an example of operation of the chilling device.

Referring to FIG. 52 when a signal for operating the chilling device 10 is input according to a user's operation, the driving assembly 70 operates the suction fan 31 and the agitating member 50 at the same time.

In detail, when the driving motor 71 is operated, the rotation shaft 711 of the driving motor 71 rotates the driving shaft 723. Torque from the driving shaft 723 is transmitted to the driving shaft gear 723*a*, the speed changer gears 727, and the transmission shaft gear 726*a*, which engage with one another, and thus, the transmission shaft 726 rotates. Accordingly, the transmission shaft 726 rotates the rotation member 421 of the transmission unit 73. Then, the transmission unit 73 swings the agitating member 50 to agitate a beverage in the beverage container 6 placed on the agitating member 50. Since the transmission unit 73 is the same in configuration as that of the previous examples, except that the transmission unit 73 is coupled to the transmission shaft 726, a description thereof is not repeated.

Torque from the driving shaft 723 is transmitted to the first fan gear 724 and the second fan gear 725, which engage with each other, to rotate the suction fan 31. Thus, the suction fan 31 is driven simultaneously with swing of the agitating member 50 to chill the beverage in the beverage container 6.

When the suction fan 31 rotates, suction force is generated. Then, cool air from the evaporating compartment 107 sequentially passes through the suction duct 11 and the suction grill 23, and is sucked into the case 20 by the suction force. The suction fan axially sucks the cool air from the case 20 to radially discharge the cool air, and the fan housing 32 guides the cool air to the freezer compartment 104 through the return duct 12.

When the suction fan 31 sucks the cool air, the agitating member 50 swings to agitate the beverage in the beverage container 6, thereby quickly chilling the beverage.

The driving motor 71 simultaneously drives the suction fan 31 and the transmission unit 73 to provide a simple structure, and thus the possibility of defects and malfunctions may be reduced (e.g., minimized). In addition, the amount of heat generated in the refrigerator is reduced (e.g., minimized) to improve chilling efficiency of the refrigerator.

The damping member 74 in the fan housing 32 is opened during an operation of the driving motor 71, and is closed during stopping of the driving motor 71, thereby reducing (e.g., preventing) a loss of cool air.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

The invention claimed is:

1. A refrigerator comprising:

a refrigerator body;

a refrigerating compartment and a freezing compartment being configured to maintain operating temperatures that differ, with the freezing compartment having an operating temperature that is lower than an operating temperature of the refrigerating compartment; and a cooling apparatus that is positioned in the refrigerating compartment and that is configured to cool liquid held by a container positioned therein, the cooling apparatus comprising:

a case mounted on an inner wall defining the refrigerating compartment, the case being defined by a front surface, a rear surface, side surfaces, an upper surface, and a lower surface having an air inlet;

an agitating member that is positioned within the case and on which the container is placed;

a power generator configured to generate a driving force to swing the agitating member the power generator comprising:

a motor configured to generate rotation force; and a power transmission unit that connects a rotation shaft of the motor and, the agitating member to convert the rotation force generated by the motor to the driving force that causes the agitating member to swing over an angle, the power transmission unit comprising:

a rotation member that is connected to the rotation shaft of the motor; and a rod with a first end that is connected to the rotation member and a second end that is connected to the agitating member, wherein the agitating member comprises:

a front support defining a front part of the agitating member;

a rear support defining a rear part of the agitating member, an upper end of the rear support being rotatably connected to the upper surface of the case;

a pair of holder shafts that connect a lower end of the front support to a lower end of the rear support and that support the container;

a guide support of which both lower ends are respectively coupled to the pair of holder shafts at a position between the front support and the rear support, wherein an upper end of the guide support is rotatably connected to the upper surface of the case, and a swing axis of the agitating member is configured to pass through the upper ends of the rear support and the guide support;

a neck holder of which both ends are respectively coupled to the pair of holder shafts and movable along the pair of the holder shafts; and a pair of elastic members installed on the pair of holder shafts, respectively, and disposed between the neck holder and the rear support, wherein the neck holder is configured to move along the pair of holder shafts by compression of the pair of elastic members according to a size of the container, wherein when the container is placed on the holder shafts, the swing axis of the agitating member is spaced apart from the container.

2. The refrigerator of claim 1, wherein the first end of the rod is disposed at an eccentric position from a rotation center of the rotation member so that a reciprocating motion of a length direction of the rod is converted into a swinging motion of the agitating member,—for proper antecedent basis.

3. The refrigerator of claim 2, further comprising a connection member that connects the second end of the rod to a rotation shaft of the agitating member, wherein a position at which the second end of the rod is connected to the connection member is eccentrically disposed from a rotation center of the agitating member.

4. The refrigerator of claim 1, wherein the power transmission unit connects to the rear support of the agitating member.

5. The refrigerator of claim 1, wherein the case includes an opening through which the container is placed within the case and removed from the case, further comprising:

a cover configured to open and close the opening of the case, the cover blocking air from escaping the case through the opening when the cover closes the opening of the case and the cooling apparatus operates.

6. The refrigerator of claim 5, wherein the opening of the case is inclined downward, and the cover is rotatably coupled to the case to rotate to open and close the opening of the case.

7. The refrigerator of claim 1, further comprising a partition wall that separates the refrigerating compartment and the freezing compartment, wherein the cooling apparatus is positioned on the partition wall that separates the refrigerating compartment and the freezing compartment.

8. The refrigerator of claim 1, further comprising:

an evaporating compartment that is positioned behind the freezing compartment and that is configured to generate cool air;

a suction grill placed at the air inlet of the case and having a plurality of air through holes;

a suction fan assembly mounted on the rear surface of the case;

a suction duct of which an outlet is connected to the air inlet of the case; and a return duct connected to the suction fan assembly, wherein the cool air from the evaporating compartment introduces to the case through the air inlet, discharges to an outer surface of the container to exchange heat with the liquid, flows rearward toward the suction fan assembly, and discharges through the return duct.

* * * * *